US009835006B2

(12) United States Patent
George et al.

(10) Patent No.: US 9,835,006 B2
(45) Date of Patent: Dec. 5, 2017

(54) WELLBORE PLUG ISOLATION SYSTEM AND METHOD

(71) Applicant: GEODynamics, Inc., Millsap, TX (US)

(72) Inventors: Kevin R. George, Cleburne, TX (US); John T. Hardesty, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 218 days.

(21) Appl. No.: 14/714,924

(22) Filed: May 18, 2015

(65) Prior Publication Data

US 2016/0047196 A1 Feb. 18, 2016

Related U.S. Application Data

(63) Continuation of application No. 14/459,042, filed on Aug. 13, 2014, now Pat. No. 9,062,543.

(51) Int. Cl.
*E21B 43/119* (2006.01)
*E21B 29/00* (2006.01)
(Continued)

(52) U.S. Cl.
CPC ..... *E21B 33/124* (2013.01); *E21B 23/06* (2013.01); *E21B 31/002* (2013.01); *E21B 33/12* (2013.01);
(Continued)

(58) Field of Classification Search
CPC ..... E21B 23/01; E21B 29/002; E21B 34/063; E21B 43/119; E21B 43/25; E21B 43/26; E21B 43/261; E21B 43/263
See application file for complete search history.

(56) References Cited

U.S. PATENT DOCUMENTS 2,732,195 A 1/1956 Ljungstrom
2,754,910 A 7/1956 Derrick et al.
(Continued)

FOREIGN PATENT DOCUMENTS

WO WO 2014039632 A2 3/2014

OTHER PUBLICATIONS

ISA/US, International Search Report and Written Opinion for PCT/US2015/031841 dated Aug. 5, 2015.
(Continued)

*Primary Examiner* — Cathleen R Hutchins
(74) *Attorney, Agent, or Firm* — Sudhakar V. Allada; David W. Carstens; Carstens & Cahoon, LLP

(57) ABSTRACT

A wellbore plug isolation system and method for positioning plugs to isolate fracture zones in a horizontal, vertical, or deviated wellbore is disclosed. The system/method includes a wellbore casing laterally drilled into a hydrocarbon formation, a wellbore setting tool (WST) that sets a large inner diameter (ID) restriction sleeve member (RSM), and a restriction plug element (RPE). The WST is positioned along with the RSM at a desired wellbore location. After the WST sets and seals the RSM, a conforming seating surface (CSS) is formed in the RSM. The CSS is shaped to engage/receive RPE deployed into the wellbore casing. The engaged/seated RPE isolates heel ward and toe ward fluid communication of the RSM to create a fracture zone. The RPE's are removed or left behind prior to initiating well production without the need for a milling procedure. A large ID RSM diminishes flow constriction during oil production.

7 Claims, 44 Drawing Sheets

(51) Int. Cl.

| | |
|---|---|
| ***E21B 33/124*** | (2006.01) |
| ***E21B 43/14*** | (2006.01) |
| ***E21B 43/26*** | (2006.01) |
| ***E21B 33/12*** | (2006.01) |
| ***E21B 43/116*** | (2006.01) |
| ***E21B 23/06*** | (2006.01) |
| ***E21B 31/00*** | (2006.01) |

(52) U.S. Cl.
CPC ..... *E21B 33/1204* (2013.01); *E21B 43/116* (2013.01); *E21B 43/14* (2013.01); *E21B 43/26* (2013.01)

(56) References Cited

U.S. PATENT DOCUMENTS

| | | | |
|---|---|---|---|
| 2,780,450 | A | 2/1957 | Ljungstrom |
| 2,849,070 | A | 8/1958 | Maly |
| 2,906,123 | A | 9/1959 | Vernet et al. |
| 2,923,535 | A | 2/1960 | Ljungstrom |
| 3,072,189 | A | 1/1963 | MacSporran |
| 3,103,973 | A | 9/1963 | Mullen |
| 3,208,530 | A | 9/1965 | Allen |
| 3,832,243 | A | 8/1974 | Donkersloot et al. |
| 4,424,865 | A | 1/1984 | Payton, Jr. |
| 4,515,213 | A | 5/1985 | Rogen et al. |
| 5,040,283 | A | 8/1991 | Pelgrom |
| 5,070,788 | A | 12/1991 | Carisella et al. |
| 5,159,145 | A | 10/1992 | Carisella et al. |
| 6,474,414 | B1 | 11/2002 | Gonzalez |
| 6,828,531 | B2 | 12/2004 | Spencer |
| 6,923,263 | B2 | 8/2005 | Eden |
| 6,942,032 | B2 | 9/2005 | La Rovere |
| 7,258,169 | B2 | 8/2007 | Fripp |
| 7,290,609 | B2 | 11/2007 | Wardlaw |
| 7,350,582 | B2 | 4/2008 | McKeachnie et al. |
| 7,625,846 | B2 | 12/2009 | Cooke, Jr. |
| 7,647,964 | B2 | 1/2010 | Akbar et al. |
| 7,735,567 | B2 | 6/2010 | O'Malley et al. |
| 7,743,825 | B2 | 6/2010 | O'Malley et al. |
| 7,886,825 | B2 | 2/2011 | Van Hal |
| 8,025,104 | B2 | 9/2011 | Cooke, Jr. |
| 8,178,476 | B2 | 5/2012 | Xie et al. |
| 8,191,644 | B2 | 6/2012 | Rytlewski et al. |
| 8,215,385 | B2 | 7/2012 | Cooke, Jr. |
| 8,276,670 | B2 | 10/2012 | Patel |
| 8,283,174 | B2 | 10/2012 | Van Hal |
| 8,342,240 | B2 | 1/2013 | Richard et al. |
| 8,439,108 | B2 | 5/2013 | Cooke, Jr. |
| 8,485,265 | B2 | 7/2013 | Marya et al. |
| 8,622,133 | B2 | 1/2014 | Kaminsky |
| 8,726,991 | B2 | 5/2014 | Boney |
| 8,905,147 | B2 | 12/2014 | Fripp et al. |
| 9,062,543 | B1 | 6/2015 | Snider et al. |
| 9,068,428 | B2 | 6/2015 | Mazyar et al. |
| 9,080,098 | B2 | 7/2015 | Xu et al. |
| 9,243,472 | B1 | 1/2016 | Snider et al. |
| 2002/0060071 | A1 | 5/2002 | Grundmann |
| 2003/0132224 | A1 | 7/2003 | Spencer |
| 2003/0164237 | A1 | 9/2003 | Butterfield, Jr. |
| 2004/0231845 | A1 | 11/2004 | Cooke |
| 2005/0109511 | A1 | 5/2005 | Spencer |
| 2005/0211436 | A1 | 9/2005 | Fripp |
| 2006/0144591 | A1 | 7/2006 | Gonzalez |
| 2007/0169935 | A1 | 7/2007 | Akbar et al. |
| 2007/0225175 | A1 | 9/2007 | Cooke |
| 2007/0240885 | A1 | 10/2007 | O'Malley et al. |
| 2008/0015120 | A1 | 1/2008 | Cooke |
| 2008/0066904 | A1 | 3/2008 | Van Hal |
| 2008/0115932 | A1 | 5/2008 | Cooke |
| 2008/0149345 | A1 | 6/2008 | Marya et al. |
| 2008/0149351 | A1 | 6/2008 | Marya et al. |
| 2008/0210423 | A1 | 9/2008 | Boney |
| 2008/0230219 | A1 | 9/2008 | Kaminsky |
| 2009/0255686 | A1 | 10/2009 | Richard et al. |
| 2010/0078173 | A1 | 4/2010 | Buytaert et al. |
| 2010/0243242 | A1 | 9/2010 | Boney et al. |
| 2010/0270031 | A1 | 10/2010 | Patel |
| 2010/0294507 | A1 | 11/2010 | Tanton |
| 2010/0300675 | A1 | 12/2010 | Johnson et al. |
| 2011/0036570 | A1 | 2/2011 | La Rovere et al. |
| 2011/0132609 | A1 | 6/2011 | Van Hal |
| 2011/0132611 | A1 | 6/2011 | Rytlewski et al. |
| 2011/0146985 | A1 | 6/2011 | Xie et al. |
| 2011/0303423 | A1 | 12/2011 | Kaminsky |
| 2012/0181032 | A1 | 7/2012 | Naedler et al. |
| 2012/0199349 | A1 | 8/2012 | Themig et al. |
| 2012/0267101 | A1 | 10/2012 | Cooke, Jr. |
| 2012/0276356 | A1 | 11/2012 | Xu et al. |
| 2012/0318513 | A1 | 12/2012 | Mazyer et al. |
| 2013/0087334 | A1 | 4/2013 | Buytaert et al. |
| 2013/0087335 | A1 | 4/2013 | Carragher |
| 2013/0133897 | A1 | 5/2013 | Baihly et al. |
| 2013/0206425 | A1 | 8/2013 | Mazyar et al. |
| 2013/0264056 | A1 | 10/2013 | Stout |
| 2013/0319669 | A1* | 12/2013 | DuPree ..... E21B 43/261 166/281 |
| 2013/0327540 | A1 | 12/2013 | Hamid et al. |
| 2014/0027128 | A1 | 1/2014 | Johnson et al. |
| 2014/0060830 | A1 | 3/2014 | Love |
| 2014/0060837 | A1 | 3/2014 | Love |
| 2014/0069636 | A1 | 3/2014 | Kaminsky |
| 2014/0069637 | A1 | 3/2014 | Kaminsky |
| 2014/0096950 | A1 | 4/2014 | Pyecroft et al. |
| 2014/0151054 | A1 | 6/2014 | Norrid |
| 2014/0190685 | A1 | 7/2014 | Frazier et al. |
| 2015/0008003 | A1 | 1/2015 | Lafleur |
| 2015/0060069 | A1 | 3/2015 | Potapenko et al. |

OTHER PUBLICATIONS

Extended European Search Report and Search Opinion dated Jul. 17, 2017 for European Application No. 15832132.3.

* cited by examiner

*Prior Art.*

WELLBORE PLUG ISOLATION SYSTEM AND METHOD

CROSS REFERENCE TO RELATED APPLICATIONS

This application is a continuation application of non-provisional patent application Ser. No. 14/459,042, entitled WELLBORE PLUG ISOLATION SYSTEM. AND METHOD, filed Aug. 13, 2014.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to oil and gas extraction. Specifically, the invention attempts to isolate fracture zones through selectively positioning restriction elements within a wellbore casing.

PRIOR ART AND BACKGROUND OF THE INVENTION

Prior Art Background

The process of extracting oil and gas typically consists of operations that include preparation, drilling, completion, production and abandonment.

Preparing a drilling site involves ensuring that it can be properly accessed and that the area where the rig and other equipment will be placed has been properly graded. Drilling pads and roads must be built and maintained which includes the spreading of stone on an impermeable liner to prevent impacts from any spills but also to allow any rain to drain properly.

In the drilling of oil and gas wells, a wellbore is formed using a drill bit that is urged downwardly at a lower end of a drill string. After drilling the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

A special tool, called a perforating gun, is lowered to the rock layer. This perforating gun is then fired, creating holes through the casing and the cement and into the targeted rock. These perforating holes connect the rock holding the oil and gas and the well bore.

Since these perforations are only a few inches long and are performed more than a mile underground, no activity is detectable on the surface. The perforation gun is then removed before for the next step, hydraulic fracturing. Stimulation fluid, which is a mixture of over 90% water and sand, plus a few chemical additives, is pumped under controlled conditions into deep, underground reservoir formations. The chemicals are used for lubrication and to keep bacteria from forming and to carry the sand. These chemicals are typically non-hazardous and range in concentrations from 0.1% to 0.5% by volume and are needed to help improve the performance and efficiency of the hydraulic fracturing. This stimulation fluid is pumped at high pressure out through the perforations made by the perforating gun. This process creates fractures in the shale rock which contains the oil and natural gas.

In many instances a single wellbore may traverse multiple hydrocarbon formations that are otherwise isolated from one another within the Earth. It is also frequently desired to treat such hydrocarbon bearing formations with pressurized treatment fluids prior to producing from those formations. In order to ensure that a proper treatment is performed on a desired formation, that formation is typically isolated during treatment from other formations traversed by the wellbore. To achieve sequential treatment of multiple formations, the casing adjacent to the toe of a horizontal, vertical, or deviated wellbore is first perforated while the other portions of the casing are left unperforated. The perforated zone is then treated by pumping fluid under pressure into that zone through perforations. Following treatment a plug is placed adjacent to the perforated zone. The process is repeated until all the zones are perforated. The plugs are particularly useful in accomplishing operations such as isolating perforations in one portion of a well from perforations in another portion or for isolating the bottom of a well from a wellhead. The purpose of the plug is to isolate some portion of the well from another portion of the well.

Subsequently, production of hydrocarbons from these zones requires that the sequentially set plugs be removed from the well. In order to reestablish flow past the existing plugs an operator must remove and/or destroy the plugs by milling, drilling, or dissolving the plugs.

Prior Art System Overview (0100)

As generally seen in the system diagram of FIG. 1 (0100), prior art systems associated with oil and gas extraction may include a wellbore casing (0120) laterally drilled into a wellbore. A plurality of frac plugs (0110, 0111, 0112, 0113) may be set to isolate multiple hydraulic fracturing zones (0101, 0102, 0103). Each frac plug is positioned to isolate a hydraulic fracturing zone from the rest of the unperforated zones. The positions of frac plugs may be defined by preset sleeves in the wellbore casing. For example, frac plug (0111) is positioned such that hydraulic fracturing zone (0101) is isolated from downstream (injection or toe end) hydraulic fracturing zones (0102, 0103). Subsequently, the hydraulic fracturing zone (0101) is perforated using a perforation gun and fractured. Preset plug/sleeve positions in the casing, precludes change of fracture zones locations after a wellbore casing has been installed. Therefore, there is a need to position a plug at a desired location after a wellbore casing has been installed without depending on a predefined sleeve location integral to the wellbore casing to position the plug.

Furthermore, after well completions, sleeves used to set frac plugs may have a smaller inner diameter constricting fluid flow when well production is initiated. Therefore, there is a need for a relatively large inner diameter sleeves after well completion that allow for unrestricted well production fluid flow.

Additionally, frac plugs can be inadvertently set at undesired locations in the wellbore casing creating unwanted constrictions. The constrictions may latch wellbore tools that are run for future operations and cause unwanted removal process. Therefore, there is a need to prevent premature set conditions caused by conventional frac plugs.

Prior Art Method Overview (0200)

As generally seen in the method of FIG. 2 (0200), prior art associated with oil and gas extraction includes site preparation and installation of a wellbore casing (0120) (0201). Preset sleeves may be installed as an integral part of the wellbore casing (0120) to position frac plugs for isolation. After setting a frac plug and isolating a hydraulic fracturing zone is step (0202), a perforating gun is positioned in the isolated zone in step (0203). Subsequently, the perforating gun detonates and perforates the wellbore casing and the cement into the hydrocarbon formation. The perforating gun is next moved to an adjacent position for further perforation until the hydraulic fracturing zone is completely perforated. In step (0204), hydraulic fracturing fluid is pumped into the perforations at high pressures. The steps comprising of setting up a plug (0202), isolating a hydraulic fracturing zone, perforating the hydraulic fracturing zone (0203) and pumping hydraulic fracturing fluids into the perforations (0204), are repeated until all hydraulic fracturing zones in the wellbore casing are processed. In step (0205), if all hydraulic fracturing zones are processed, the plugs are milled out with a milling tool and the resulting debris is pumped out or removed from the wellbore casing (0206). In step (0207) hydrocarbons are produced by pumping out from the hydraulic fracturing stages.

The step (0206) requires that removal/milling equipment be run into the well on a conveyance string which may typically be wire line, coiled tubing or jointed pipe. The process of perforating and plug setting steps represent separate "trip" into and out of the wellbore with the required equipment. Each trip is time consuming and expensive. In addition, the process of drilling and milling the plugs creates debris that needs to be removed in another operation. Therefore, there is a need for isolating multiple hydraulic fracturing zones without the need for a milling operation. Furthermore, there is a need for positioning restrictive plug elements that could be removed in a feasible, economic, and timely manner before producing gas.

Deficiencies in the Prior Art

The prior art as detailed above suffers from the following deficiencies:

- Prior art systems do not provide for positioning a ball seat at a desired location after a wellbore casing has been installed, without depending on a predefined sleeve location integral to the wellbore casing to position the plug.
- Prior art systems do not provide for isolating multiple hydraulic fracturing zones without the need for a milling operation.
- Prior art systems do not provide for positioning restrictive elements that could be removed in a feasible, economic, and timely manner.
- Prior art systems do not provide for setting larger inner diameter sleeves to allow unrestricted well production fluid flow.
- Prior art systems cause undesired premature preset conditions preventing further wellbore operations.

While some of the prior art may teach some solutions to several of these problems, the core issue of isolating hydraulic fracturing zones without the need for a milling operation has not been addressed by prior art.

OBJECTIVES OF THE INVENTION

Accordingly, the objectives of the present invention are (among others) to circumvent the deficiencies in the prior art and affect the following objectives:

- Provide for positioning a ball seat at a desired location after a wellbore casing has been installed, without depending on a predefined sleeve location integral to the wellbore casing to position the plug.
- Provide for isolating multiple hydraulic fracturing zones without the need for a milling operation.
- Provide for positioning restrictive elements that could be removed in a feasible, economic, and timely manner.
- Provide for setting larger inner diameter sleeves to allow unrestricted well production fluid flow.
- Provide for eliminating undesired premature preset conditions that prevent further wellbore operations.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The present invention provides a system to isolate fracture zones in a horizontal, vertical, or deviated wellbore without the need for a milling operation. The system includes a wellbore casing laterally drilled into a hydrocarbon formation, a setting tool that sets a large inner diameter (ID) restriction sleeve member (RSM), and a restriction plug element (RPE). A setting tool deployed on a wireline or coil tubing into the wellbore casing sets and seals the RSM at a desired wellbore location. The setting tool forms a conforming seating surface (CSS) in the RSM. The CSS is shaped to engage/receive RPE deployed into the wellbore casing. The engaged/seated RPE isolates toe ward and heel ward fluid communication of the RSM to create a fracture zone. The RPEs are removed or pumped out or left behind without the need for a milling operation. A large ID RSM diminishes flow constriction during oil production.

Method Overview

The present invention system may be utilized in the context of an overall gas extraction method, wherein the wellbore plug isolation system described previously is controlled by a method having the following steps:

(1) installing the wellbore casing;
(2) deploying the WST along with the RSM and a perforating gun string assembly (GSA) to a desired wellbore location in the wellbore casing;
(3) setting the RSM at the desired wellbore location with the WST and forming a seal;
(4) perforating the hydrocarbon formation with the perforating GSA;
(5) removing the WST and perforating GSA from the wellbore casing;
(6) deploying the RPE into the wellbore casing to seat in the RSM and creating a hydraulic fracturing stage;
(7) fracturing the stage with fracturing fluids;
(8) checking if all hydraulic fracturing stages in the wellbore casing have been completed, if not so, proceeding to the step (2);
(9) enabling fluid flow in production direction; and
(10) commencing oil and gas production from the hydraulic fracturing stages.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
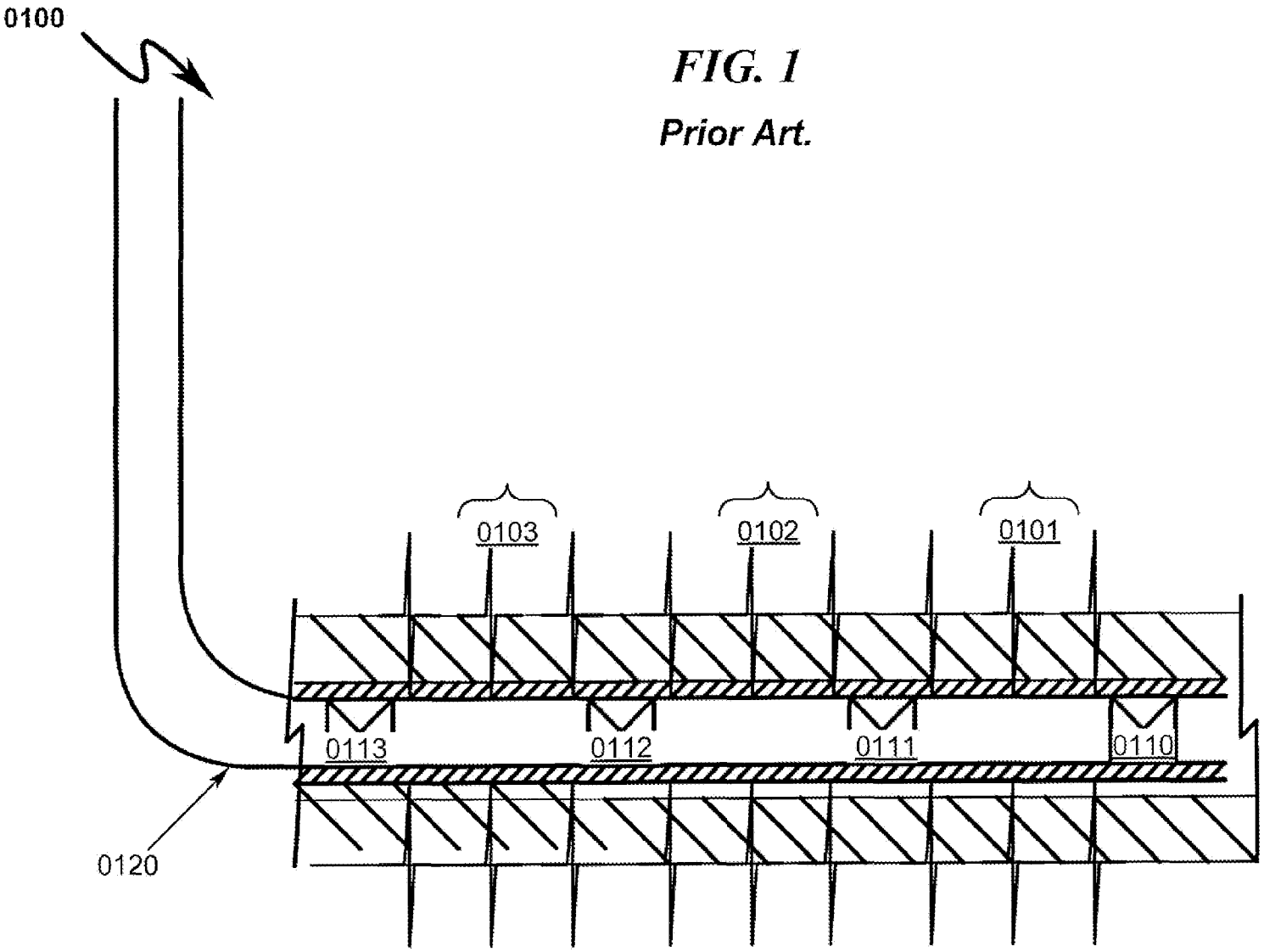
FIG. 1 Prior Art.
FIG. 1 illustrates a system block overview diagram describing how prior art systems use plugs to isolate hydraulic fracturing zones.
Figure 2:
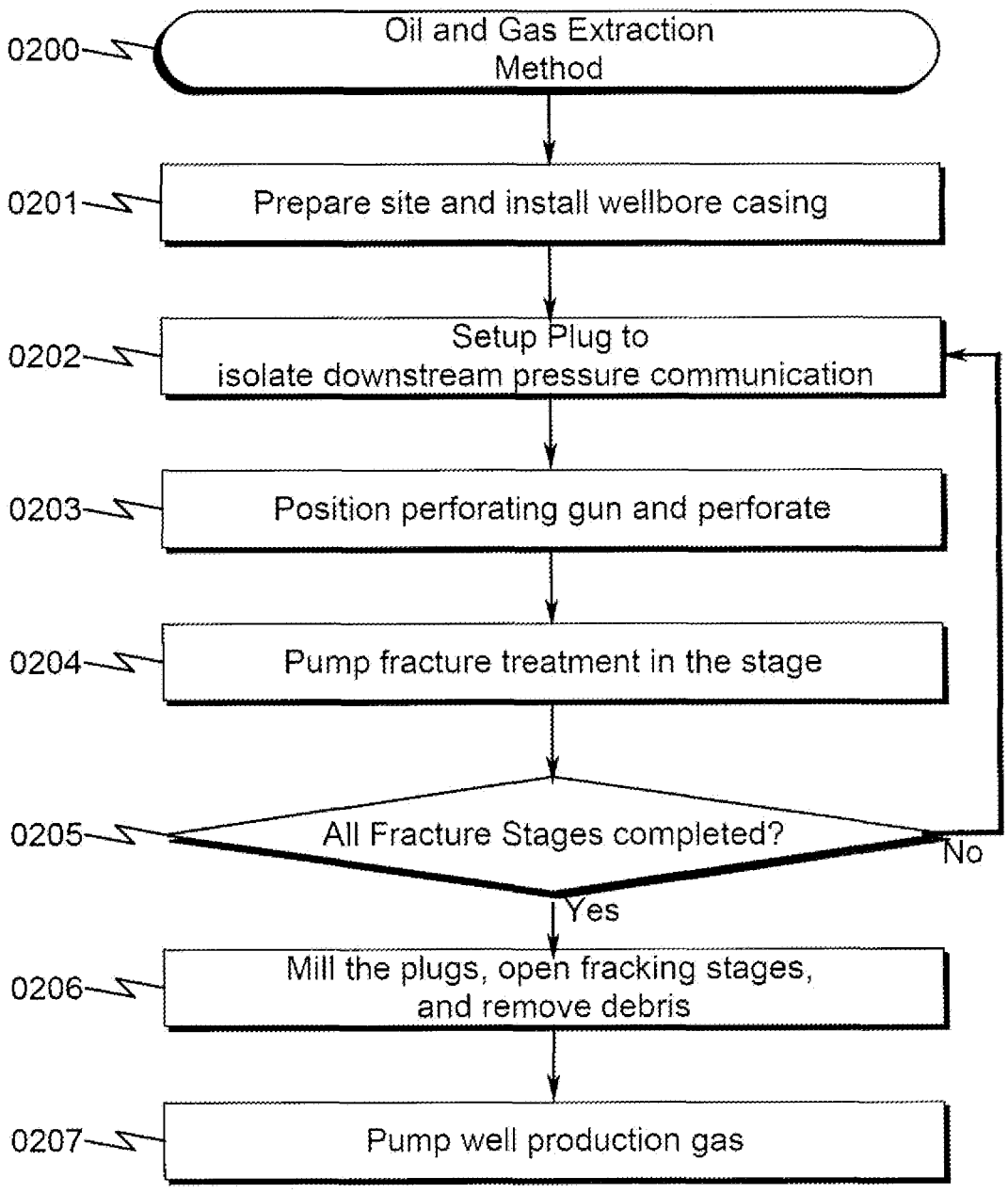
FIG. 2 illustrates a flowchart describing how prior art systems extract gas from hydrocarbon formations.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a wellbore plug isolation system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Glossary of Terms

RSM: Restriction Sleeve Member, a cylindrical member positioned at a selected wellbore location.

RPE: Restriction Plug Element, an element configured to isolate and block fluid communication.

CSS: Conforming Seating Surface, a seat formed within RSM.

ICD: Inner Casing Diameter, inner diameter of a wellbore casing.

ICS: Inner Casing Surface, inner surface of a wellbore casing.

ISD: Inner Sleeve Diameter, inner diameter of a RSM.

ISS: Inner Sleeve Surface, inner surface of a RSM.

WST: Wellbore Setting Tool, a tool that functions to set and seal RSMs.

GSA: Gun String Assembly, a cascaded string of perforating guns coupled to each other.

Preferred Embodiment System Block Diagram (0300, 0400)

Figure 3:
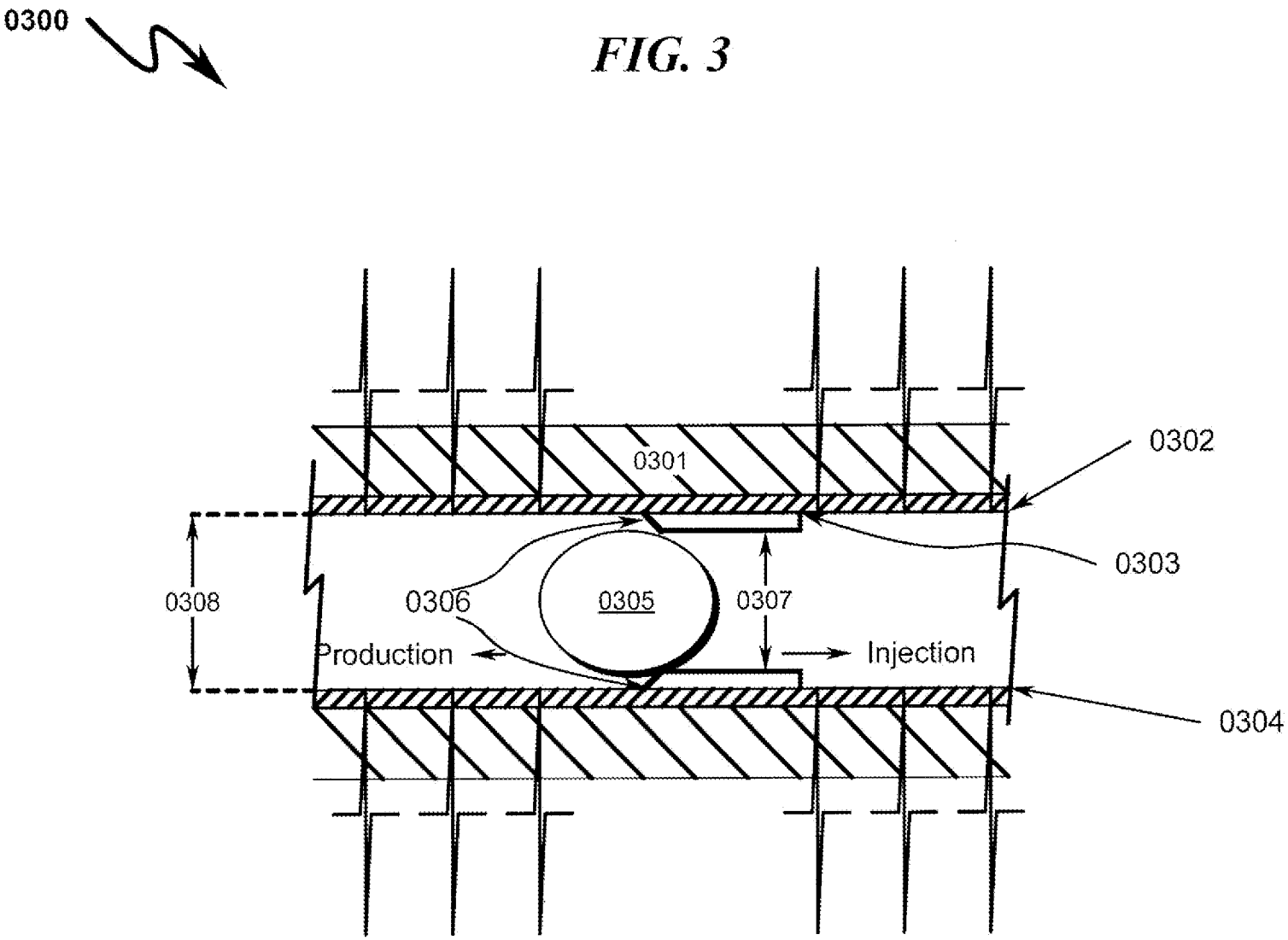
FIG. 3 illustrates an exemplary system side view of a spherical restriction plug element/restriction sleeve member overview depicting a presently preferred embodiment of the present invention.
Figure 3A:
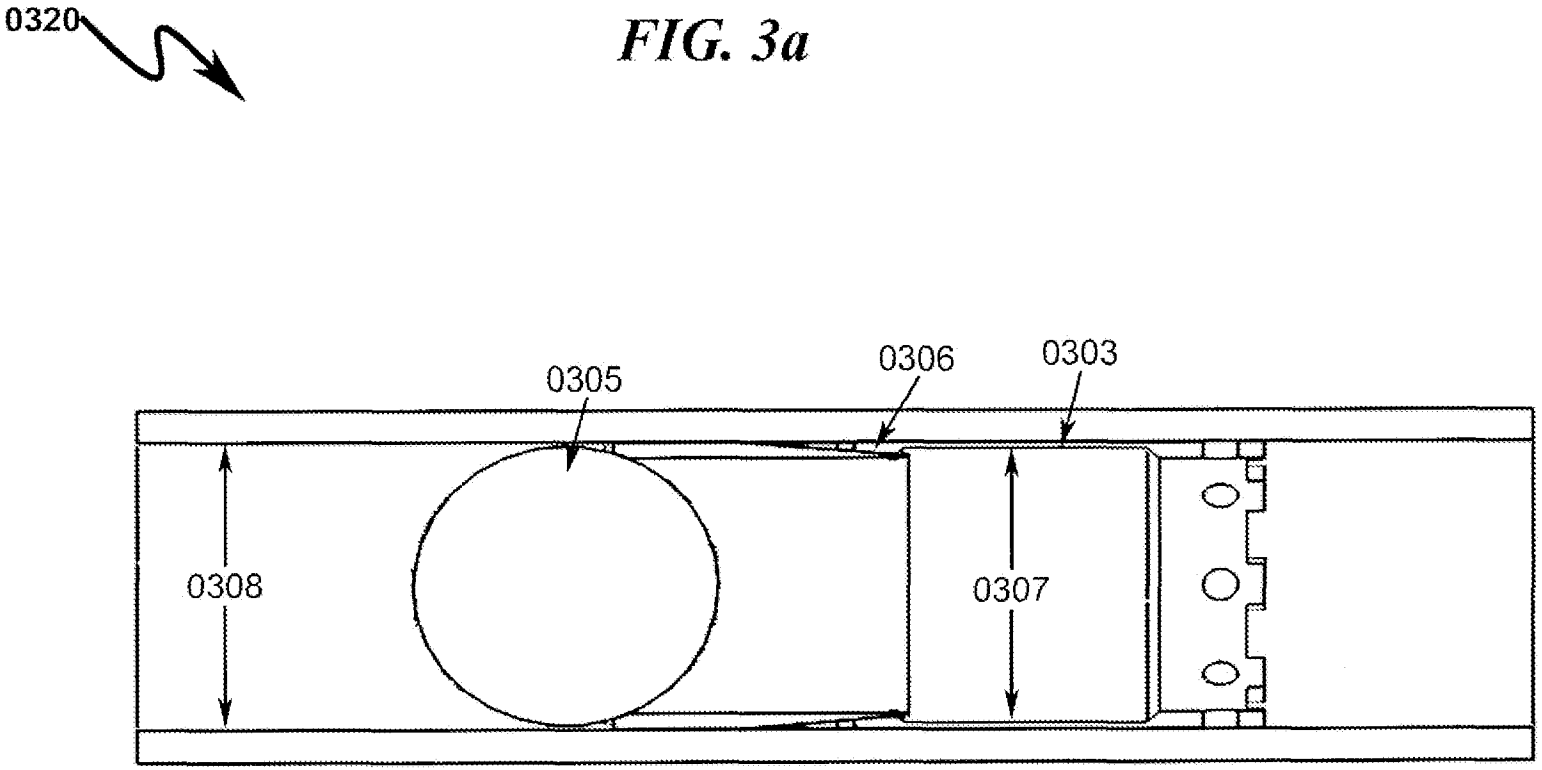
FIG. 3*a* illustrates an exemplary system side view of a spherical restriction plug element/restriction sleeve member overview depicting a presently preferred embodiment of the present invention.
Figure 4:
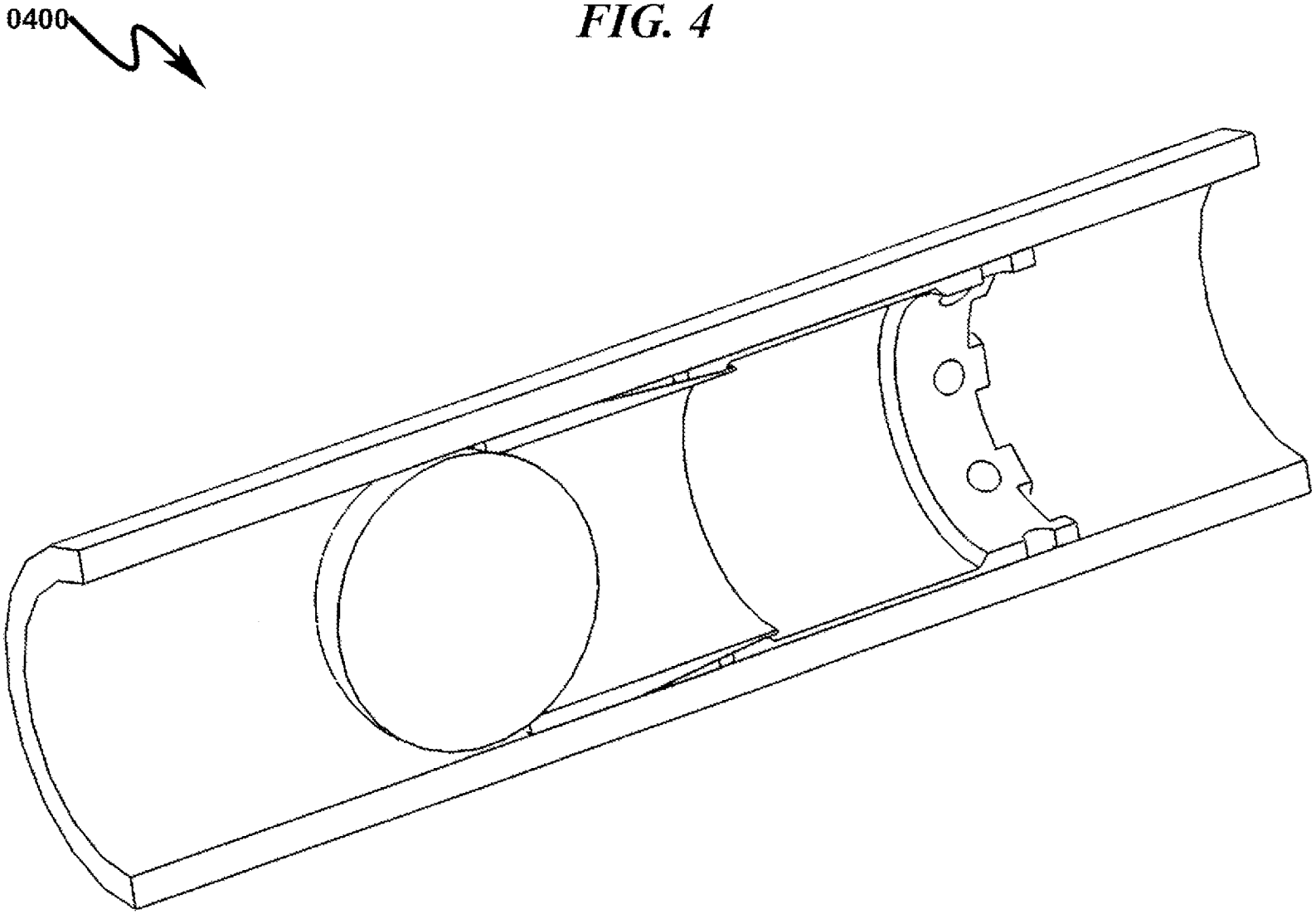
FIG. 4 illustrates a side perspective view of a spherical restriction plug element/restriction sleeve member depicting a preferred exemplary system embodiment.

The present invention may be seen in more detail as generally illustrated in FIG. 3 (0300) and FIG. 3*a* (0320), wherein a wellbore casing (0304) is installed inside a hydrocarbon formation (0302) and held in place by wellbore cement (0301). The wellbore casing (0304) may have an inside casing surface (ICS) associated with an inside casing diameter (ICD) (0308). For example, ICD (0308) may range from 2¾ inch to 12 inches. A restriction sleeve member (RSM) (0303) that fits inside of the wellbore casing is disposed therein by a wellbore setting tool (WST) to seal against the inside surface of the wellbore casing. The seal may be leaky or tight depending on the setting of RSM (0303). The RSM (0303) may be a hollow cylindrical member having an inner sleeve surface and an outer sleeve surface. The RSM (0303) may be concentric with the wellbore casing and coaxially fit within the ICS. In one preferred exemplary embodiment, the seal prevents RSM (0303) from substantial axially or longitudinally sliding along the inside surface of the wellbore casing. The RSM (0303) may be associated with an inner sleeve diameter (ISD) (0307) that is configured to fit within ICD (0308) of the wellbore casing (0304). In another preferred exemplary embodiment, ISD (0307) is large enough to enable unrestricted fluid movement through inside sleeve surface (ISS) during production. The ratio of ISD (0307) to ICD (0308) may range from 0.5 to 0.99. For example, ICD may be 4.8 inches and ISD may be 4.1 inches. In the foregoing example, the ratio of ISD (0307) and ICD (0308) is 0.85. The diameter of ISD (0307) may further degrade during production from wellbore fluids enabling fluid flow on almost the original diameter of the well casing. In a further preferred exemplary embodiment, RSM (0303) may be made from a material comprising of aluminum, iron, steel, titanium, tungsten, copper, bronze, brass, plastic, composite, natural fiber, and carbide. The RSM (0303) may be made of degradable material or a commercially available material.

In a preferred exemplary embodiment, the WST may set RSM (0303) to the ICS in compression mode to form an inner profile on the RSM (0303). The inner profile could form a tight or leaky seal preventing substantial axial movement of the RSM (0303). In another preferred exemplary embodiment, the WST may set RSM (0303) to the ICS in expansion mode providing more contact surface for sealing RSM (0303) against ICS. Further details of setting RSM (0303) through compression and expansion modes are further described below in FIG. 15.

In another preferred exemplary embodiment, the WST may set RSM (0303) using a gripping/sealing element disposed of therein with RSM (0303) to grip the outside surface of RSM (0303) to ICS. Further details of setting RSM (0303) through compression and expansion modes are described below in FIG. 11 (1100).

In another preferred exemplary embodiment, the WST may set RSM (0303) at any desired location within wellbore casing (0304). The desired location may be selected based on information such as the preferred hydrocarbon formation area, fraction stage, and wellbore conditions. The desired location may be chosen to create uneven hydraulic fracturing stages. For example, a shorter hydraulic fracturing stage may comprise a single perforating position so that the RSM locations are selected close to each other to accommodate the perforating position. Similarly, a longer hydraulic fracturing stage may comprise multiple perforating positions so that the RSM locations are selected as far to each other to accommodate the multiple perforating positions. Shorter and longer hydraulic fracturing positions may be determined based on the specific information of hydrocarbon formation (0302). A mudlog analyzes the mud during drilling operations for hydrocarbon information at locations in the wellbore. Prevailing mudlog conditions may be monitored to dynamically change the desired location of RSM (0303).

The WST may create a conforming seating surface (CSS) (0306) within RSM (0303). The WST may form a beveled edge on the production end (heel end) of the RSM (0303) by constricting the inner diameter region of RSM (0303) to create the CSS (0306). The inner surface of the CSS (0306) could be formed such that it seats and retains a restriction plug element (RPE) (0305). The diameter of the RPE (0305) is chosen such that it is less than the outer diameter and greater than the inner diameter of RSM (0303). The CSS (0306) and RPE (0305) may be complementary shaped such that RPE (0305) seats against CSS (0306). For example, RPE (0306) may be spherically shaped and the CSS (0306) may be beveled shaped to enable RPE (0305) to seat in CSS (0306) when a differential pressure is applied. The RPE (0305) may pressure lock against CSS (0306) when differential pressure is applied i.e., when the pressure upstream (production or heel end) of the RSM (0303) location is greater than the pressure downstream (injection or toe end) of the RSM (0303). The differential pressure established across the RSM (0303) locks RPE (0305) in place isolating downstream (injection or toe end) fluid communication. According to one preferred exemplary embodiment, RPE (0305) seated in CSS (0306) isolates a zone to enable hydraulic fracturing operations to be performed in the zone without affecting downstream (injection or toe end) hydraulic fracturing stages. The RPE (0305) may also be configured in other shapes such as a plug, dart or a cylinder. It should be noted that one skilled in the art would appreciate that any other shapes conforming to the seating surface may be used for RPEs to achieve similar isolation affect as described above.

According to another preferred exemplary embodiment, RPE (0305) may seat directly in RSM (0303) without the need for a CSS (0306). In this context, RPE (0305) may lock against the vertical edges of the RSM (0303) which may necessitate a larger diameter RPE (0305).

According to yet another preferred exemplary embodiment, RPE (0305) may degrade over time in the well fluids eliminating the need to be removed before production. The RPE (0305) degradation may also be accelerated by acidic components of hydraulic fracturing fluids or wellbore fluids, thereby reducing the diameter of RPE (0305) enabling it to flow out (pumped out) of the wellbore casing or flow back (pumped back) to the surface before production phase commences.

In another preferred exemplary embodiment, RPE (0305) may be made of a metallic material, non-metallic material, a carbide material, or any other commercially available material.

Preferred Embodiment Multistage System Diagram (0500)

Figure 5:
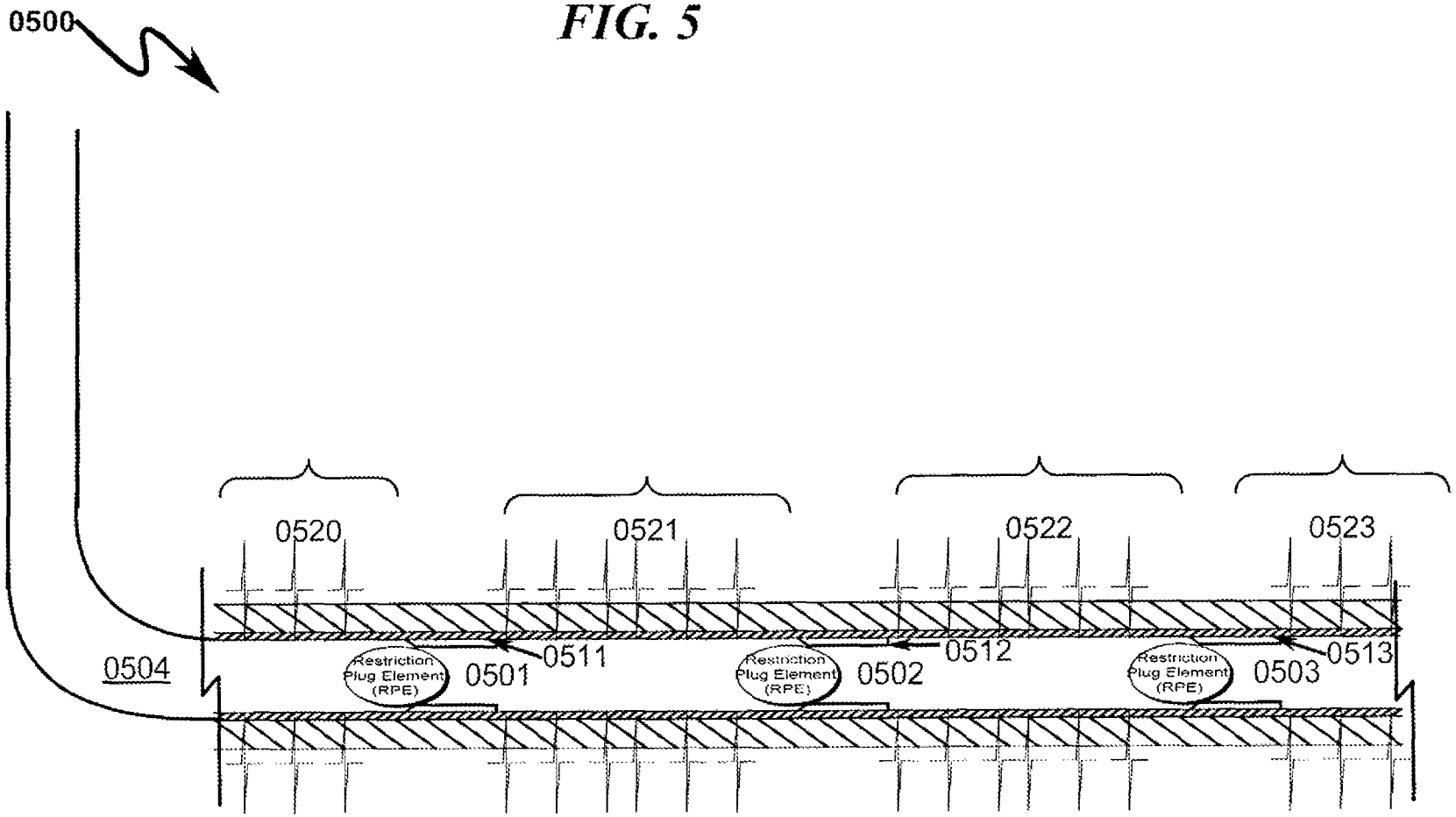
FIG. 5 illustrates an exemplary wellbore system overview depicting multiple stages of a preferred embodiment of the present invention.

The present invention may be seen in more detail as generally illustrated in FIG. 5 (0500), wherein a wellbore casing (0504) is shown after hydraulic fracturing is performed in multiple stages (fracture intervals) according to a method described herewith below in FIG. 6 (0600). A plurality of stages (0520, 0521, 0522, 0523) are created by setting RSMs (0511, 0512, 0513) at desired positions followed by isolating each stage successively with restriction plug elements RPEs (0501, 0502, 0503). A RSM (0513) may be set by a WST followed by positioning a perforating gun string assembly (GSA) in hydraulic fracturing zone (0522) and perforating the interval. Subsequently, RPE (0503) is deployed and the stage (0522) is hydraulically fractured. The WST and the perforating GSA are removed for further operations. Thereafter, RSM (0512) is set and sealed by WST followed by a perforation operation. Another RPE (0502) is deployed to seat in RSM (0512) to form hydraulic fracturing zone (0521). Thereafter the stage (0521) is hydraulically fracturing. Similarly, hydraulic fracturing zone (0520) is created and hydraulically fractured.

According to one aspect of a preferred exemplary embodiment, RSMs may be set by WST at desired locations to enable RPEs to create multiple hydraulic fracturing zones in the wellbore casing. The hydraulic fracturing zones may be equally spaced or unevenly spaced depending on wellbore conditions or hydrocarbon formation locations.

According to another preferred exemplary embodiment, RPEs are locked in place due to pressure differential established across RSMs. For example, RPE (0502) is locked in the seat of RSM (0512) due to a positive pressure differential established across RSM (0512) i.e., pressure upstream (hydraulic fracturing stages 0520, 0521 and stages towards heel of the wellbore casing) is greater than pressure downstream (hydraulic fracturing stages 0522, 0523 and stages towards toe of the wellbore casing).

According a further preferred exemplary embodiment, RPEs (0501, 0502, 0503) may degrade over time, flowed back by pumping, or flowed into the wellbore, after completion of all stages in the wellbore, eliminating the need for additional milling operations.

According a further preferred exemplary embodiment the RPE's may change shape or strength such that they may pass through a RSM in either the production (heel end) or injection direction (toe end). For example RPE (0512) may degrade and change shape such it may pass through RSM (0511) in the production direction or RSM (0513) in the injection direction. The RPEs may also be degraded such that they are in between the RSMs of current stage and a previous stage restricting fluid communication towards the injection end (toe end) but enabling fluid flow in the production direction (heel end). For example, RPE (0502) may degrade such it is seated against the injection end (toe end) of RSM (0511) that may have flow channels. Flow channels in the RSM are further described below in FIG. 32 (3200) and FIG. 34 (3400).

According to yet another preferred exemplary embodiment, inner diameters of RSMs (0511, 0512, 0513) may be the same and large enough to allow unrestricted fluid flow during well production operations. The RSMs (0511, 0512, 0513) may further degrade in well fluids to provide an even larger diameter comparable to the inner diameter of the well casing (0504) allowing enhanced fluid flow during well production. The degradation could be accelerated by acids in the hydraulic fracturing fluids.

Preferred Exemplary Restriction Plug Elements (RPE)

It should be noted that some of the material and designs of the RPE described below may not be limited and should not be construed as a limitation. This basic RPE design and materials may be augmented with a variety of ancillary embodiments, including but not limited to:

- Made of multi layered materials, where at least one layer of the material melts or deforms at temperature allowing the size or shape to change.
- May be a solid core with an outer layer of meltable material.
- May or may not have another outer layer, such as a rubber coating.
- May be a single material, non-degradable.
- Outer layer may or may not have holes in it, such that an inner layer could melt and liquid may escape.
- Passage ways through them which are filled with meltable, degradable, or dissolving materials.
- Use of downhole temperature and pressure, which change during the stimulation and subsequent well warm up to change the shape of barriers with laminated multilayered materials.
- Use of a solid core that is degradable or erodible.
- Use of acid soluble alloy balls.
- Use of water dissolvable polymer frac balls.
- Use of poly glycolic acid balls.

Preferred Exemplary Wellbore Plug Isolation Flowchart Embodiment (0600)

Figure 6:
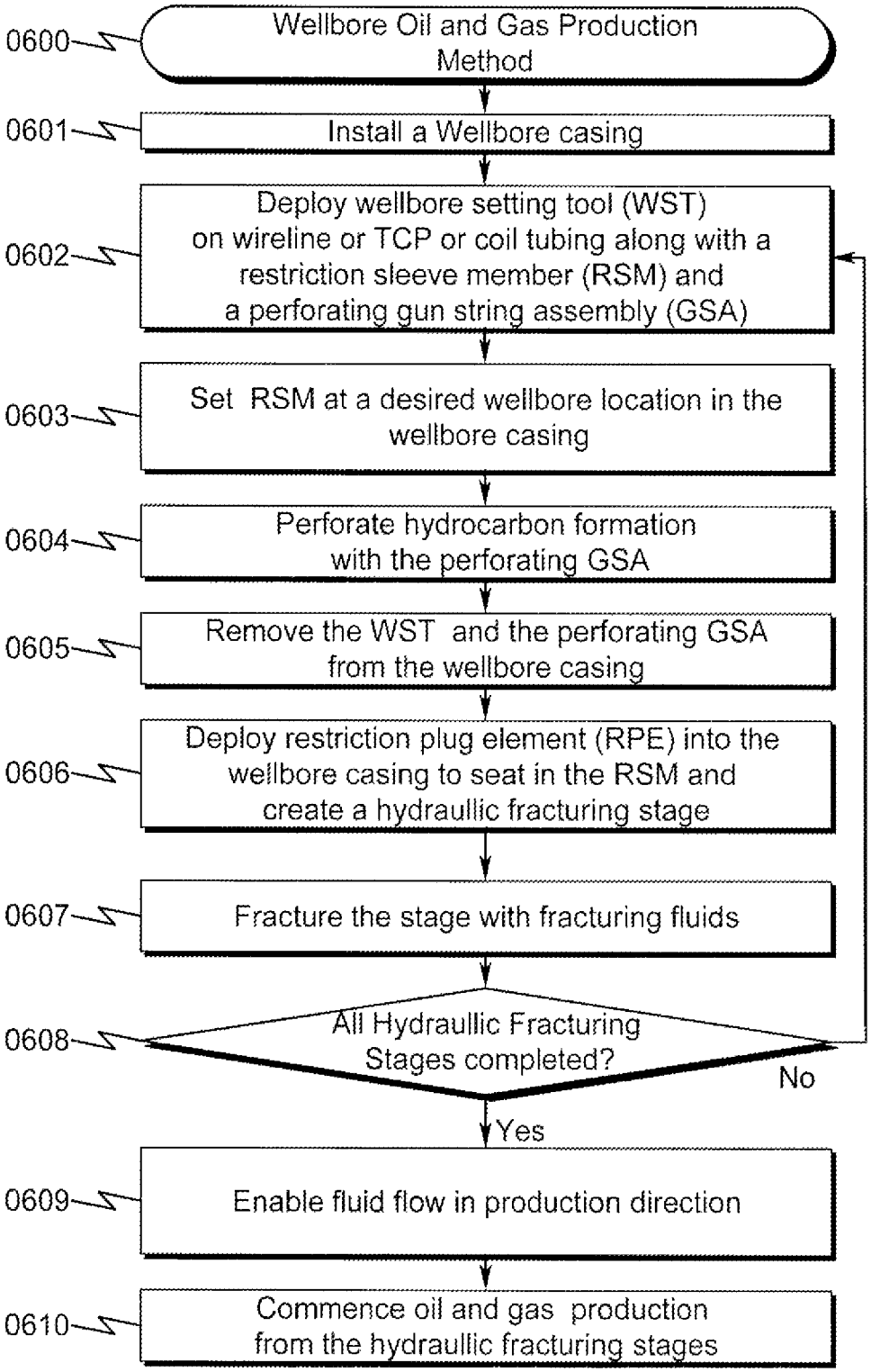
FIG. 6 illustrates a detailed flowchart of a preferred exemplary wellbore plug isolation method used in some preferred exemplary invention embodiments.

As generally seen in the flow chart of FIG. 6 (0600), a preferred exemplary wellbore plug isolation method may be generally described in terms of the following steps:

(1) installing the wellbore casing (0601);

(2) deploying the WST along with the RSM to a desired wellbore location in the wellbore casing along with a perforating gun string assembly (GSA); the WST could be deployed by wireline, coil tube, or tubing-conveyed perforating (TCP) (0602); the perforating GSA may comprise plural perforating guns;

(3) setting the RSM at the desired wellbore location with the WST; the WST could set RSM with a power charge or pressure (0603); The power charge generates pressure inside the setting tool that sets the RSM; the RSM may or may not have a conforming seating surface (CSS); the CSS may be machined or formed by the WST at the desired wellbore location;

(4) perforating hydrocarbon formation with the perforating GSA; the perforating GSA may perforate one interval at a time followed by pulling the GSA and perforating the next interval in the stage; the perforation operation is continued until all the intervals in the stage are completed;

(5) removing the WST and the perforating GSA from the wellbore casing; the WST could be removed by wireline, coil tube, or TCP (0605);

(6) deploying the RPE to seat in the RSM isolating fluid communication between upstream (heel or production end) of the RSM and downstream (toe or injection end) of the RSM and creating a hydraulic fracturing stage; RPE may be pumped from the surface, deployed by gravity, or set by a tool; If a CSS is present in the RSM, the RPE may be seated in the CSS; RPE and CSS complementary shapes enable RPE to seat into the CSS; positive differential pressure may enable RPE to be driven and locked into the CSS (0606);

(7) fracturing the hydraulic fracturing stage; by pumping hydraulic fracturing fluid at high pressure to create pathways in hydrocarbon formations (0607);

(8) checking if all hydraulic fracturing stages in the wellbore casing have been completed, if not so, proceeding to step (0602); prepare to deploy the WST to a different wellbore location towards the heel end of the already fractured stage; hydraulic fracturing stages may be determined by the length of the casing installed in the hydrocarbon formation; if all stages have been fractured proceed to step (0609), (0608);

(9) enabling fluid flow in the production (heel end) direction; fluid flow may been enabled through flow channels designed in the RSM while the RPEs are positioned in between the RSMs; fluid flow may also be been enabled through flow channels designed in the RPEs and RSMs; alternatively RPEs may also be removed from the wellbore casing or the RPEs could be flowed back to surface, pumped into the wellbore, or degraded in the presence of wellbore fluids or acid (0609); and

(10) commencing oil and gas production from all the hydraulically fractured stages (0610).

Preferred Embodiment Side View Cylindrical Restriction Plug System Block Diagram (0700, 0800)

Figure 7:
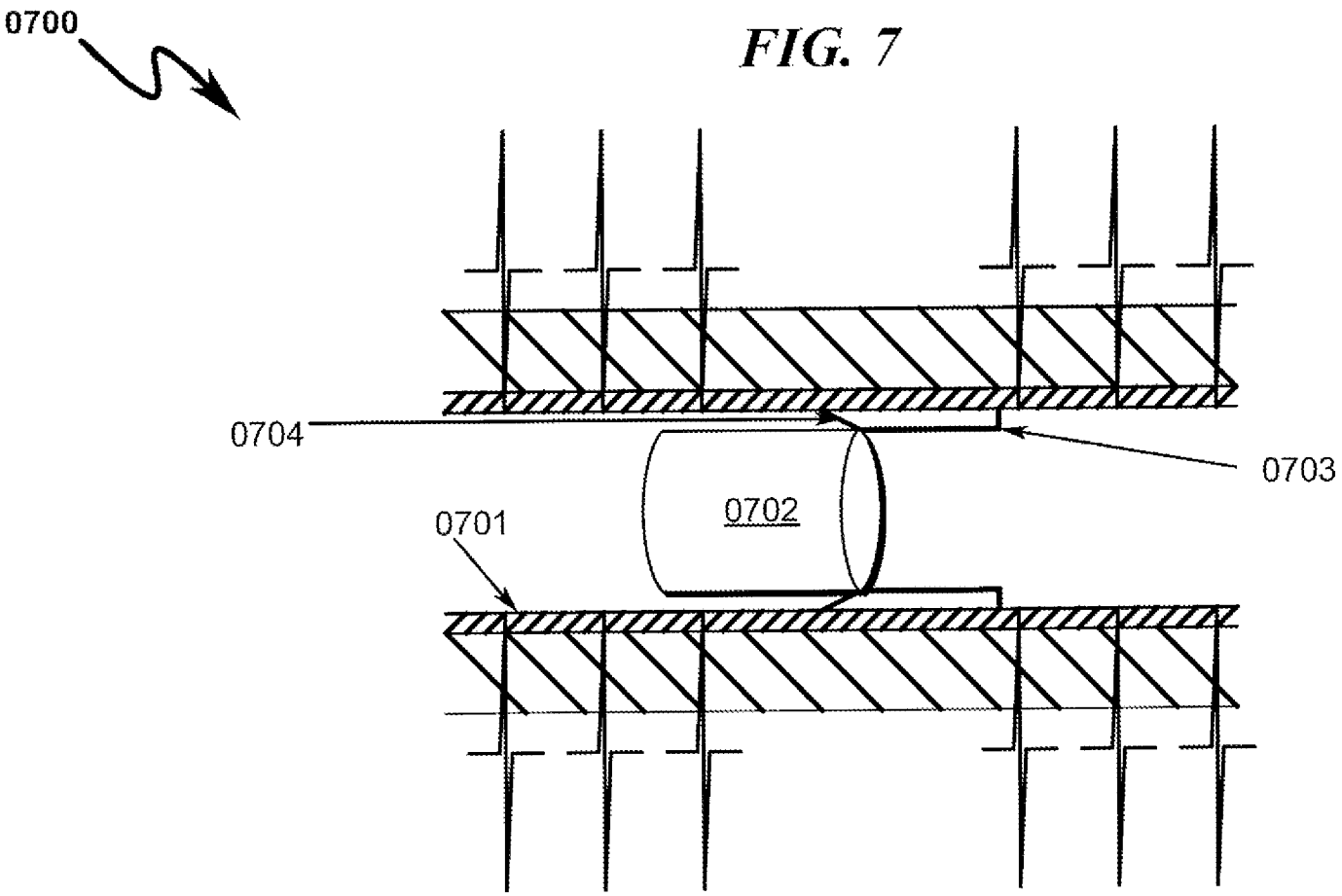
FIG. 7 illustrates a side view of a cylindrical restriction plug element seated in a restriction sleeve member depicting a preferred exemplary system embodiment.
Figure 8:
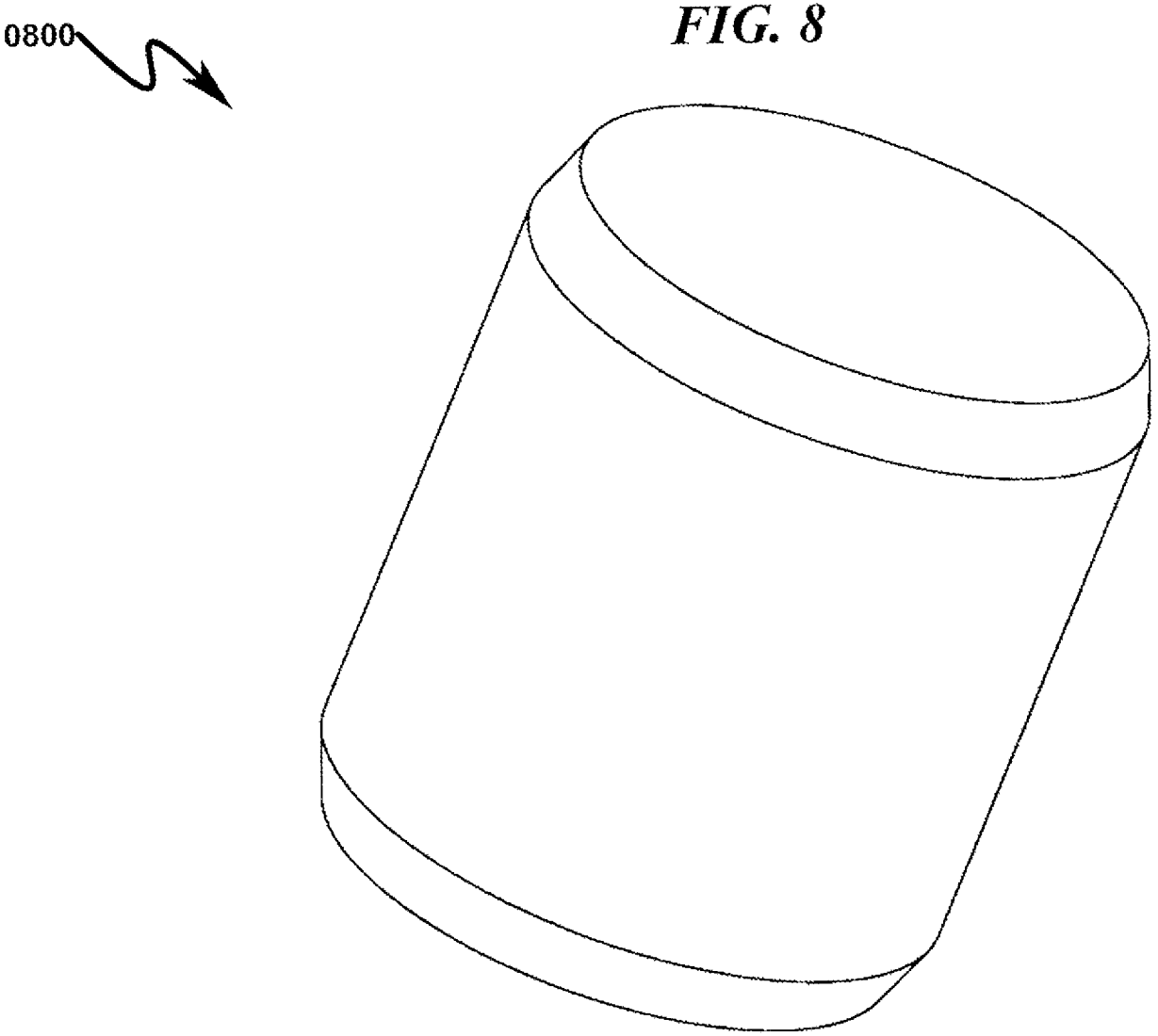
FIG. 8 illustrates a side perspective view of a cylindrical restriction plug element seated in a restriction sleeve member depicting a preferred exemplary system embodiment.

One preferred embodiment may be seen in more detail as generally illustrated in FIG. 7 (0700) and FIG. 8 (0800), wherein a cylindrical restrictive plug element (0702) is seated in CSS (0704) to provide downstream pressure isolation. A wellbore casing (0701) is installed in a hydrocarbon formation. A wellbore setting tool may set RSM (0703) at a desired location and seal it against the inside surface of the wellbore casing (0701). The WST may form a CSS (0704) in the RSM (0703) as described by foregoing method described in FIG. 6 (0600). According to one preferred exemplary embodiment, a cylindrical shaped restrictive plug element (RPE) (0702) may be deployed into the wellbore casing to seat in CSS (0704).

The diameter of the RPE (0702) is chosen such that it is less than the outer diameter and greater than the inner diameter of RSM (0703). The CSS (0704) and RPE (0702) may be complementary shaped such that RPE (0702) seats against CSS (0704). For example, RPE (0702) may be cylindrically shaped and CSS (0704) may be beveled shaped to enable RPE (0702) to seat in CSS (0704) when a differential pressure is applied. The RPE (0702) may pressure lock against CSS (0704) when differential pressure is applied.

It should be noted that, if a CSS is not present in the RSM (0703) or not formed by the WST, the cylindrical RPE (0702) may directly seat against the edges of the RSM (0703).

Preferred Embodiment Side View Dart Restriction Plug System Block Diagram (0900-1020)

Figure 9:
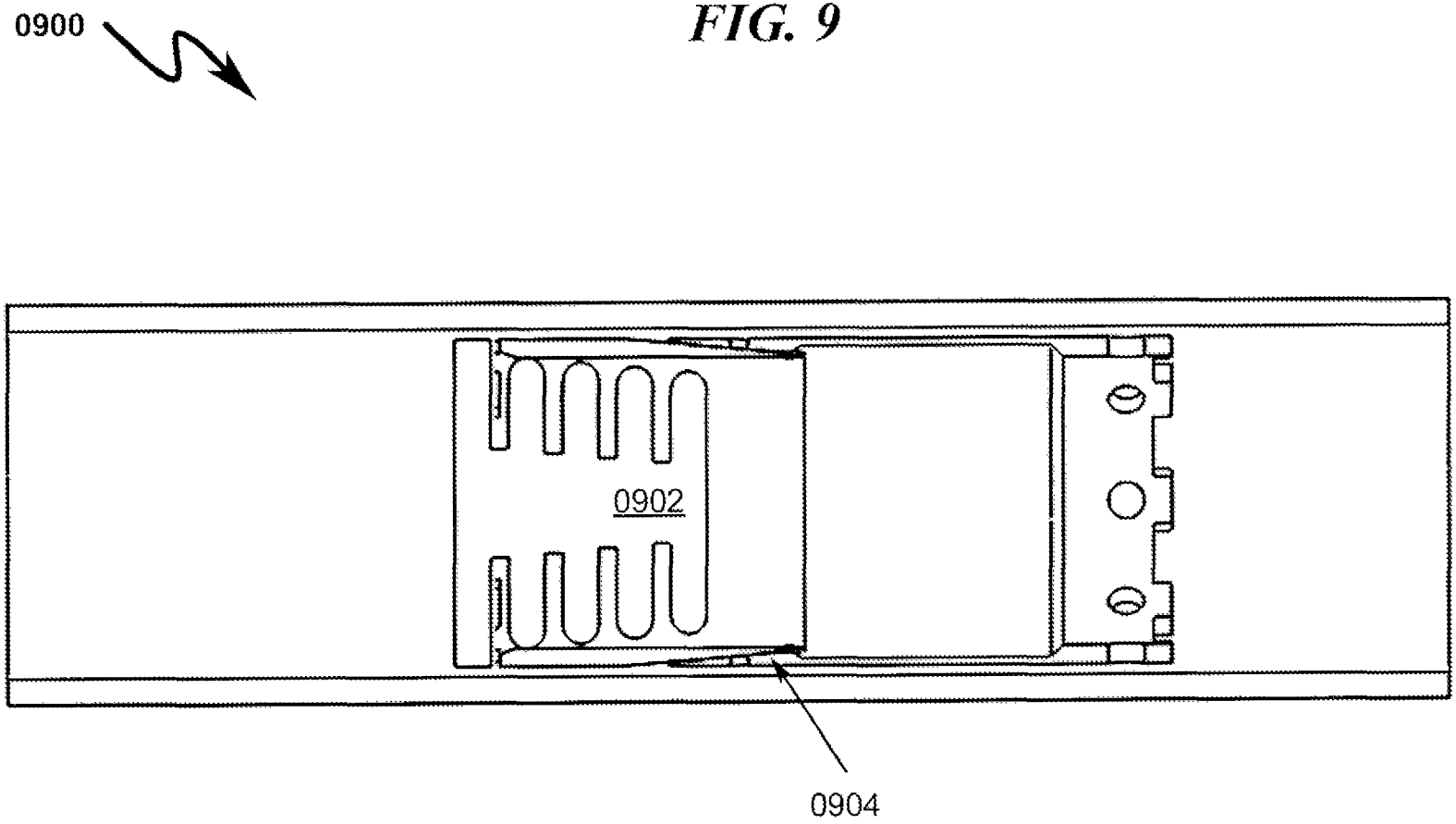
FIG. 9 illustrates a side view of a dart restriction plug element seated in a restriction sleeve member depicting a preferred exemplary system embodiment.
Figure 10:
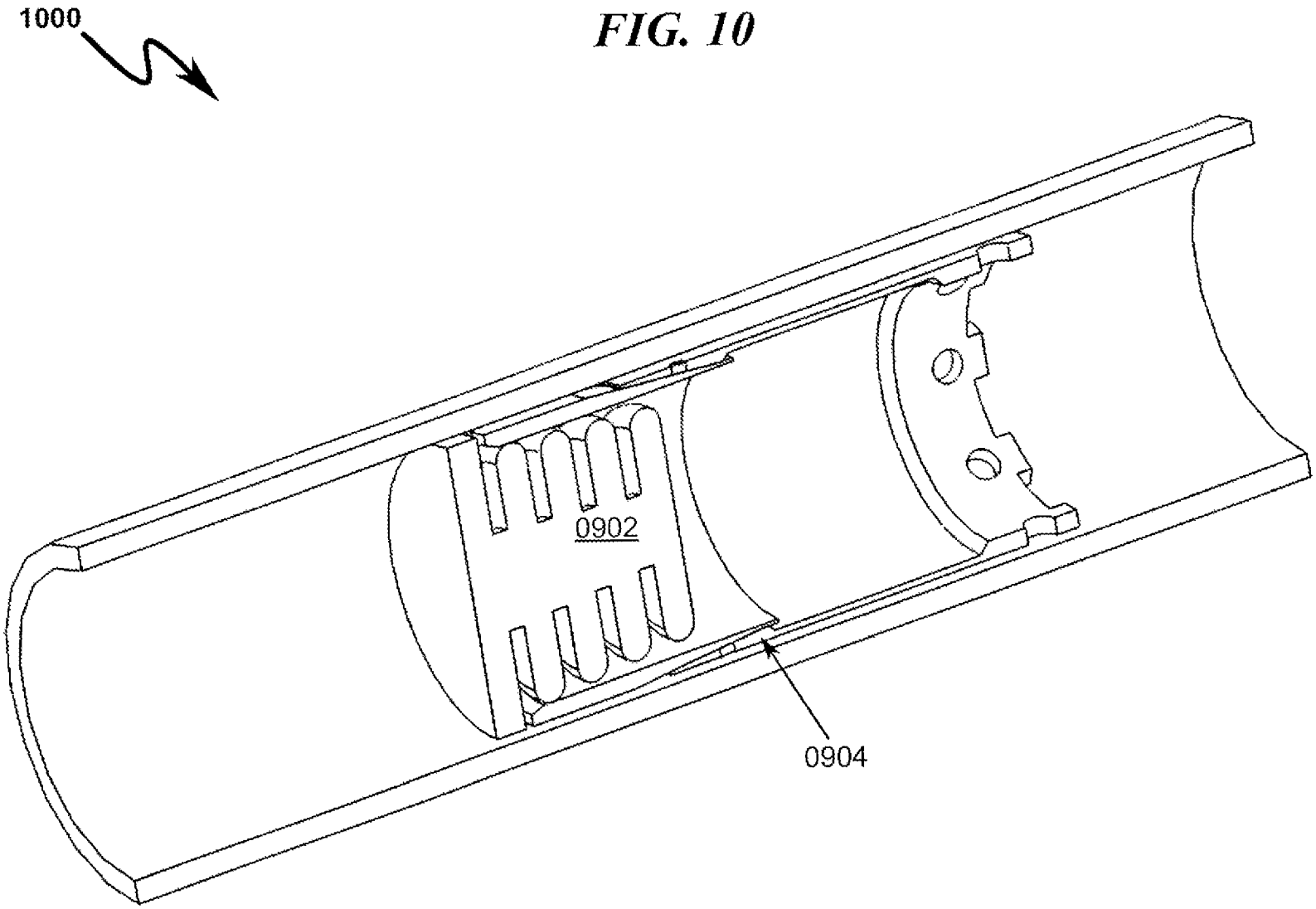
FIG. 10 illustrates a side perspective view of a dart restriction plug element seated in a restriction sleeve member depicting a preferred exemplary system embodiment.
Figure 10A:
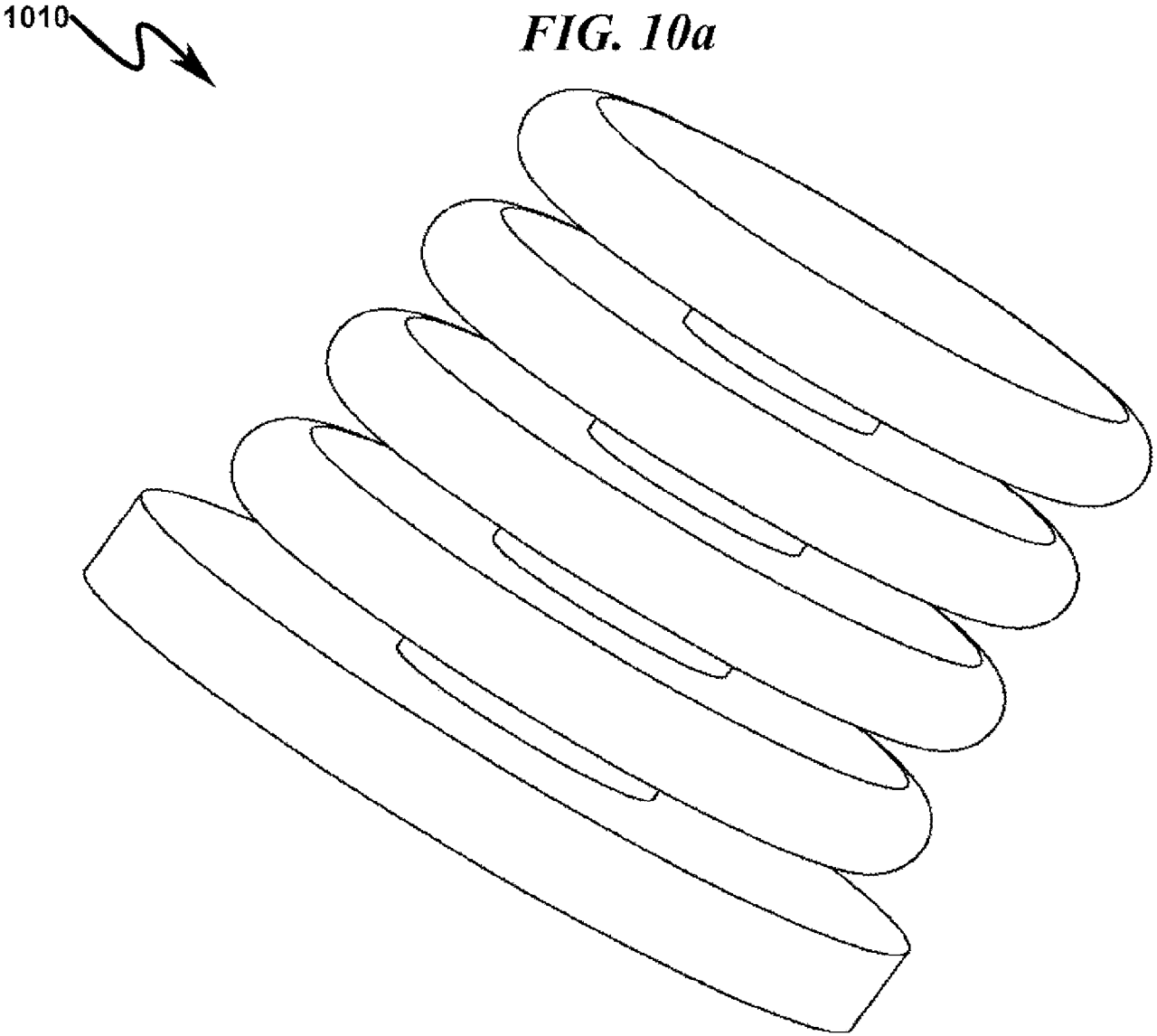
FIG. 10*a* illustrates a side perspective view of a dart restriction plug element depicting a preferred exemplary system embodiment.
Figure 10B:
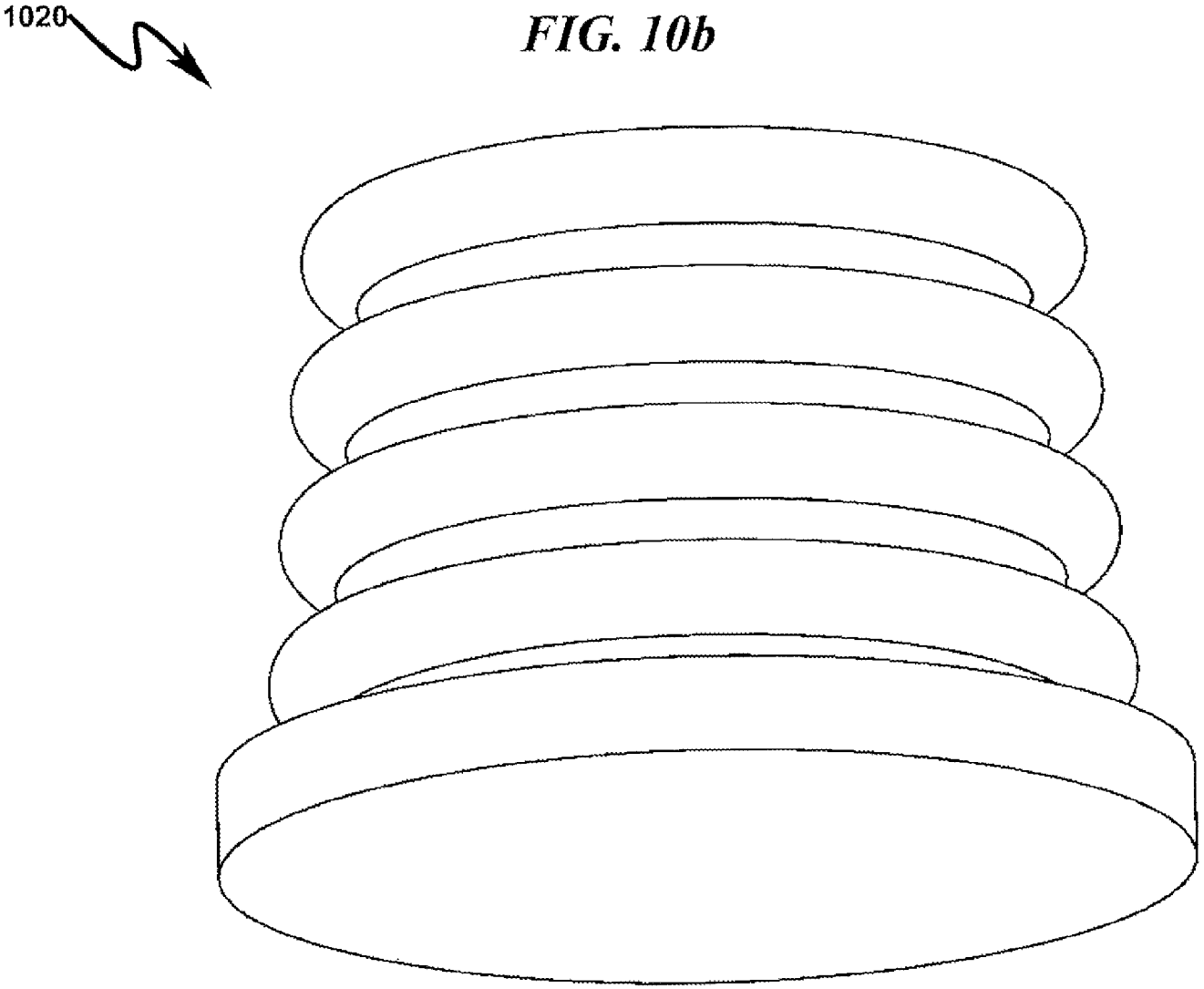
FIG. 10*b* illustrates another perspective view of a dart restriction plug element depicting a preferred exemplary system embodiment.

Yet another preferred embodiment may be seen in more detail as generally illustrated in FIG. 9 (0900), FIG. 10 (1000), FIG. 10*a* (1010), and FIG. 10*b* (1020) wherein a dart shaped restrictive plug element (0902) is seated in CSS (0904) to provide pressure isolation. According to a similar process described above in FIG. 7, RPE (0902) is used to isolate and create fracture zones to enable perforation and hydraulic fracturing operations in the fracture zones. As shown in the perspective views of the dart RPE in FIG. 10*a* (1010) and FIG. 10*b* (1020), the dart RPE is complementarily shaped to be seated in the RSM. The dart RPE (0902) is designed such that the fingers of the RPE (0902) are compressed during production enabling fluid flow in the production direction.

Preferred Embodiment Side Cross Section View of a Restriction Sleeve Member System Block Diagram (1100, 1200)

Figure 11:
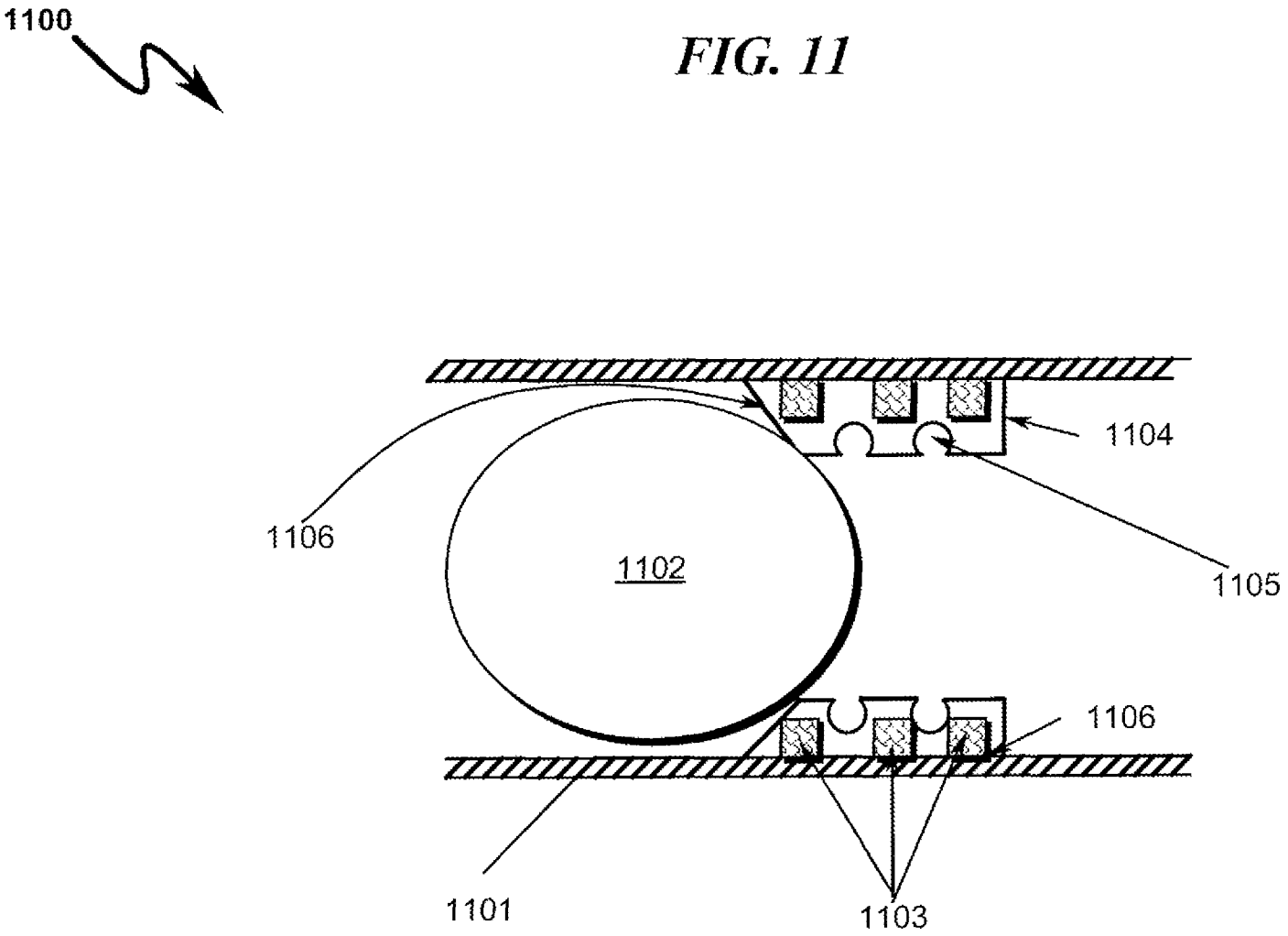
FIG. 11 illustrates a side view of a restriction sleeve member sealed with an elastomeric element depicting a preferred exemplary system embodiment.
Figure 12:
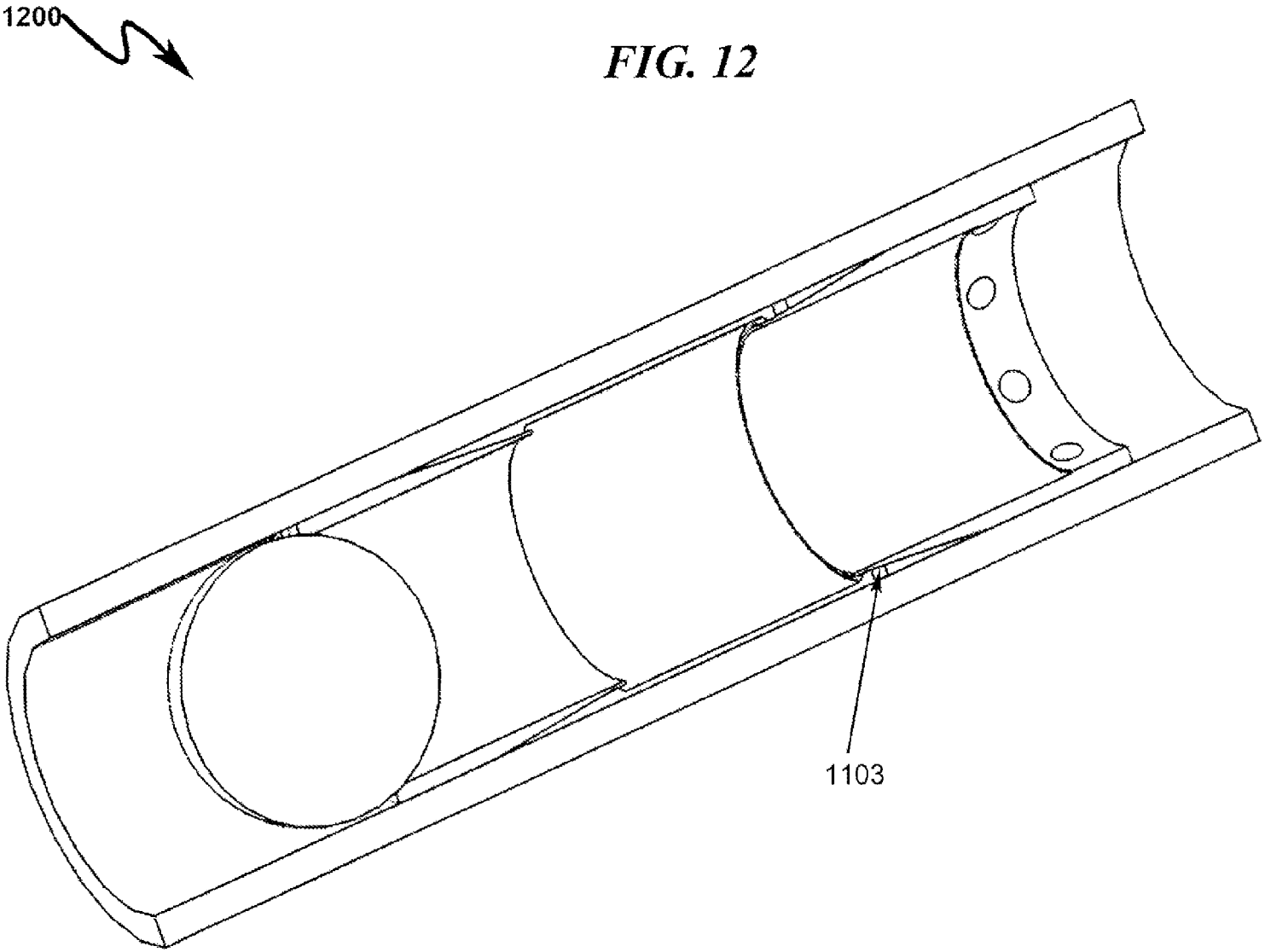
FIG. 12 illustrates a side perspective view of a restriction sleeve member sealed with gripping/sealing element depicting a preferred exemplary system embodiment.

One preferred embodiment may be seen in more detail as generally illustrated in FIG. 11 (1100) and FIG. 12 (1200), wherein a restrictive sleeve member RSM (1104) is sealed against the inner surface of a wellbore casing (1101) with a plurality of gripping/sealing elements (1103). Gripping elements may be elastomers, carbide buttons, or wicker forms. After a wellbore casing (1101) is installed, a wellbore setting tool may be deployed along with RSM (1104) to a desired wellbore location. The WST may then compress the RSM (1104) to form plural inner profiles (1105) on the inside surface of the RSM (1104) at the desired location. In one preferred exemplary embodiment, the inner profiles (1105) may be formed prior to deploying to the desired wellbore location. The compressive stress component in the inner profiles (1104) may aid in sealing the RSM (1104) to the inner surface of a wellbore casing (1101). A plurality of gripping/sealing elements (1103) may be used to further strengthen the seal (1106) to prevent substantial axial or longitudinal movement of RSM (1104). The gripping elements (1103) may be an elastomer, carbide buttons, or wicker forms that can tightly grip against the inner surface of the wellbore casing (1101). The seal (1106) may be formed by plural inner profiles (1104), plural gripping elements (1103), or a combination of inner profiles (1104) and gripping elements (1103). Subsequently, the WST may form a CSS (1106) and seat a RPE (1102) to create downstream isolation (toe end) as described by the foregoing method in FIG. 6 (0600).

Preferred Embodiment Side Cross Section View of Inner and Outer Profiles of a Restriction Sleeve Member System Block Diagram (1300-1700)

Figure 13:
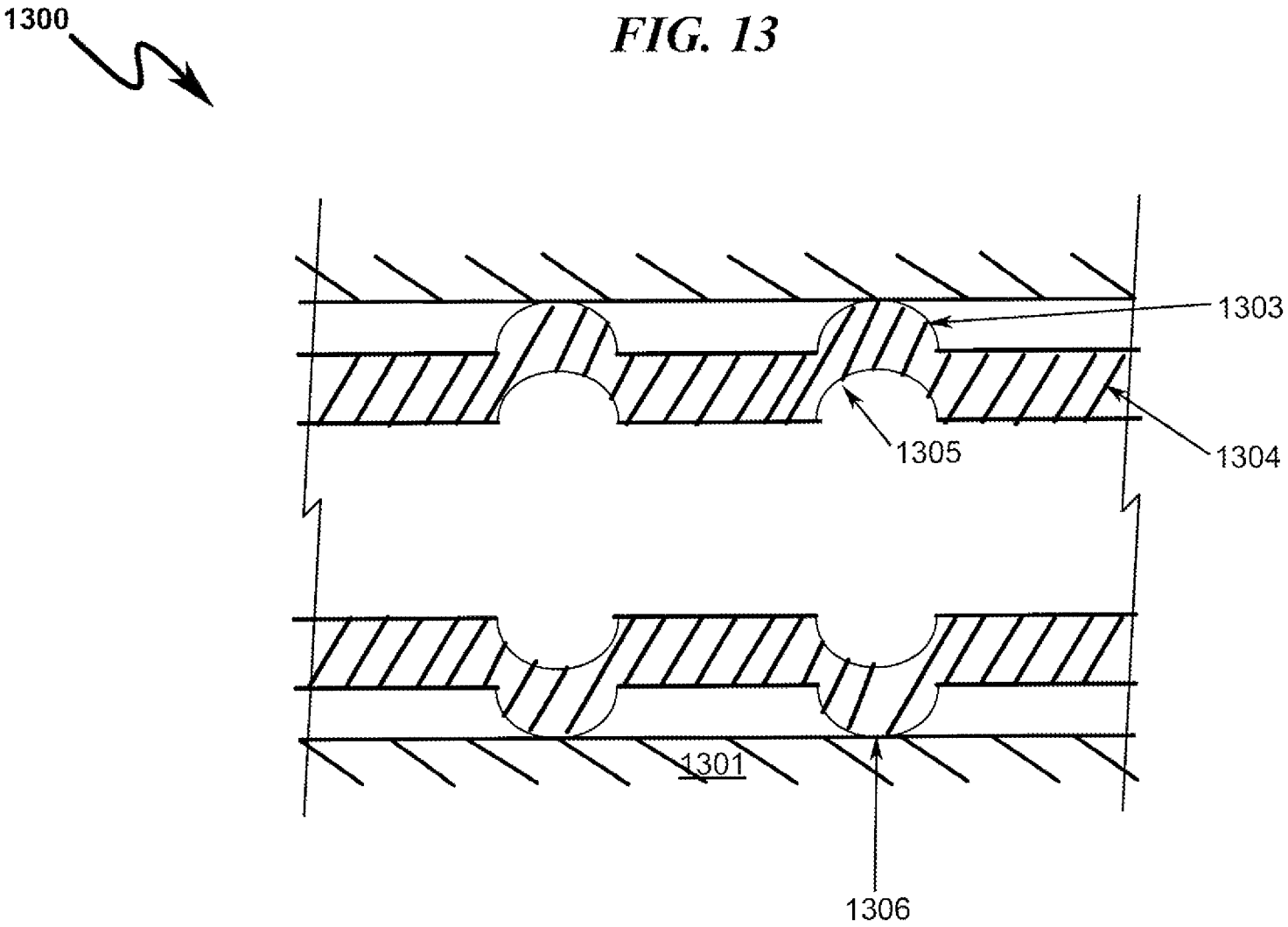
FIG. 13 illustrates side view of an inner profile of a restriction sleeve member sealed against an inner surface of a wellbore casing depicting a preferred exemplary system embodiment.
Figure 14:
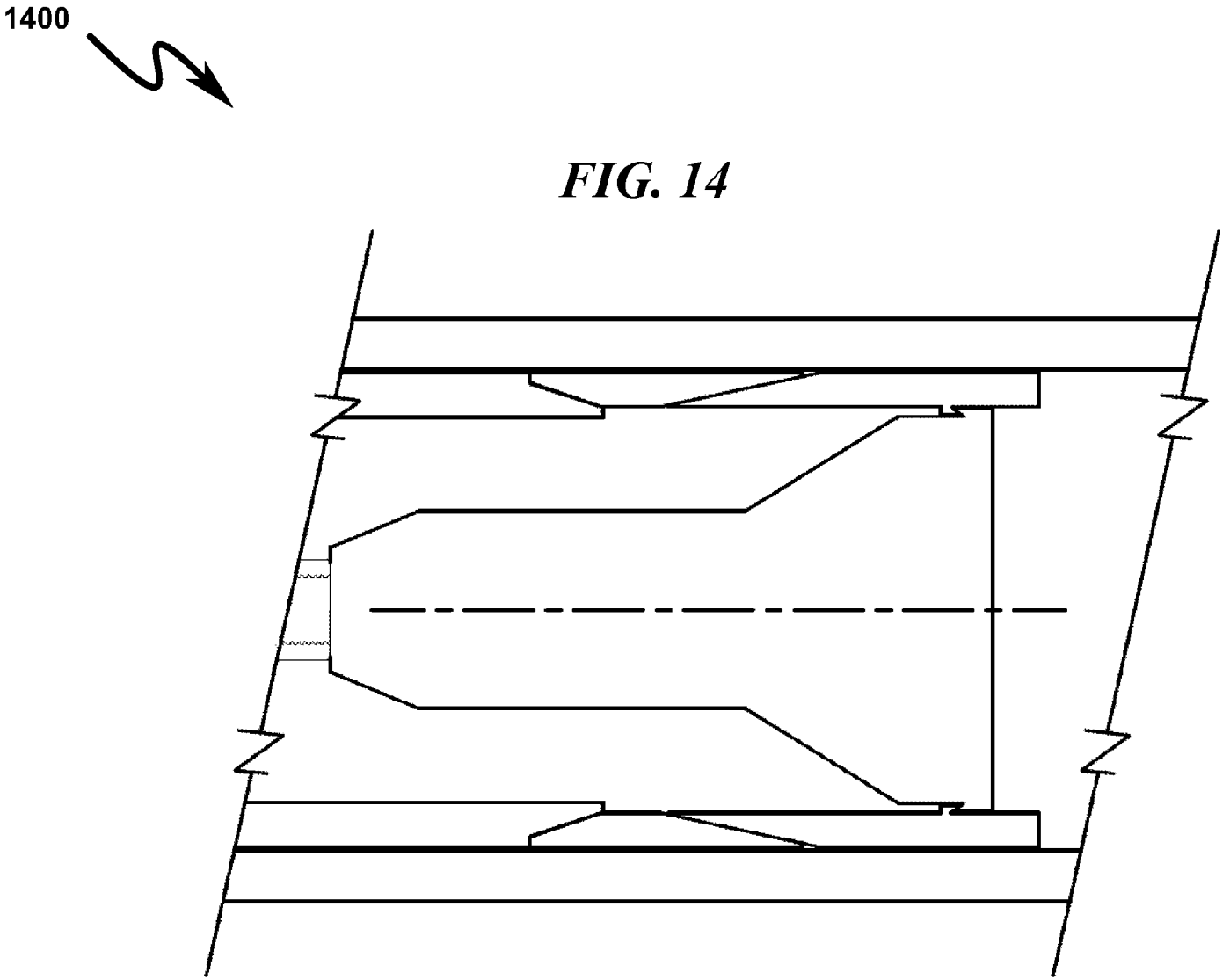
FIG. 14 illustrates an expanded view of a wellbore setting tool setting a restriction sleeve member depicting a preferred exemplary system embodiment.

Yet another preferred embodiment may be seen in more detail as generally illustrated in FIG. 13 (1300), wherein a restrictive sleeve member RSM (1304) is sealed against the inner surface of a wellbore casing (1301). After a wellbore casing (1301) is installed, a wellbore setting tool may be deployed along with RSM (1304) to a desired wellbore location. The WST may then compress the RSM (1304) to form plural inner profiles (1305) on the inside surface of the RSM (1304) and plural outer profiles (1303) on the outside surface of the RSM (1304) at the desired location. In one preferred exemplary embodiment, the inner profiles (1305) and outer profiles (1303) may be formed prior to deploying to the desired wellbore location. The compressive stress component in the inner profiles (1304) and outer profiles (1303) may aid in sealing the RSM (1304) to the inner surface of a wellbore casing (1301). The outer profiles (1303) may directly contact the inner surface of the wellbore casing at plural points of the protruded profiles to provide a seal (1306) and prevent axial or longitudinal movement of the RSM (1304).

Figure 15:
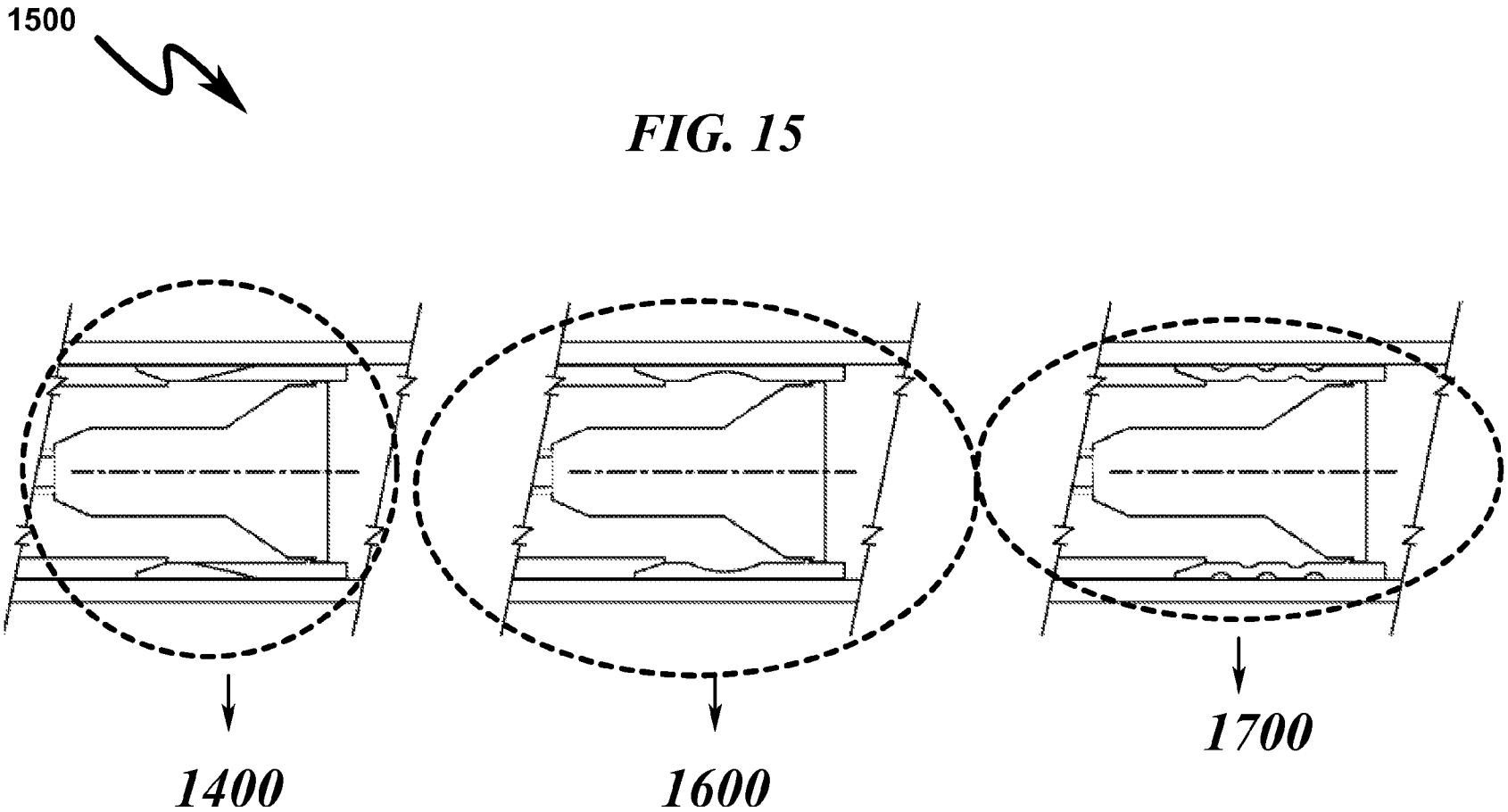
FIG. 15 illustrates a wellbore setting tool creating inner and outer profiles in the restriction sleeve member depicting a preferred exemplary system embodiment.
Figure 16:
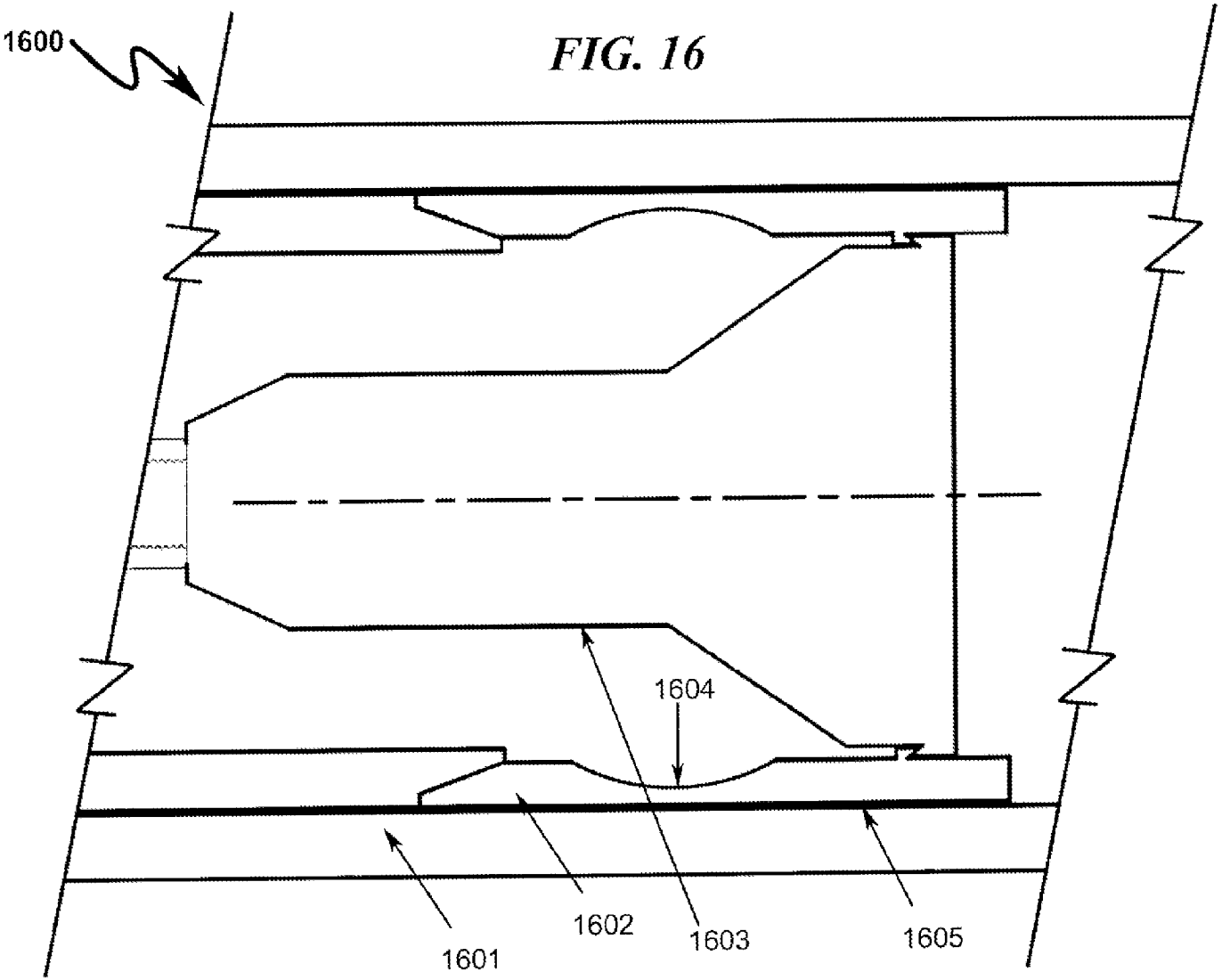
FIG. 16 illustrates a detailed cross section view of a wellbore setting tool creating inner profiles in the restriction sleeve member depicting a preferred exemplary system embodiment.
Figure 17:
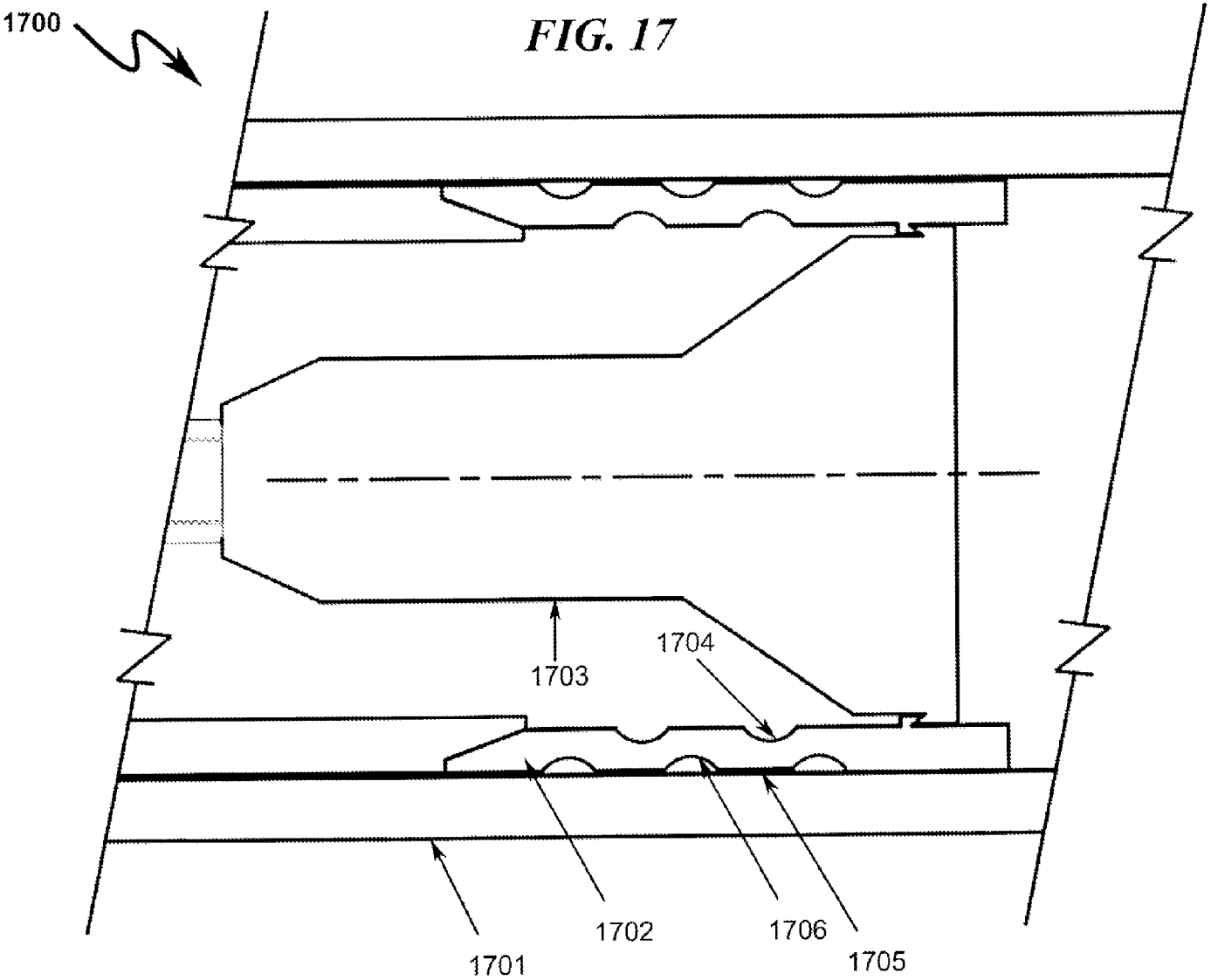
FIG. 17 illustrates a detailed cross section view of a wellbore setting tool creating inner profiles and outer profiles in the restriction sleeve member depicting a preferred exemplary system embodiment.

Similarly, FIG. 15 (1500) illustrates a wireline setting tool creating inner and outer profiles in restriction sleeve members for sealing against the inner surface of the wellbore casing. FIG. 16 (1600) illustrates a detailed cross section view of a WST (1603) that forms an inner profile (1604) in a RSM (1602) to form a seal (1605) against the inner surface of wellbore casing (1601). Likewise, FIG. 17 (1700) illustrates a detailed cross section view of a WST (1703) that forms an inner profile (1704) and an outer profile (1706) in a RSM (1702) to form a seal (1705) against the inner surface of wellbore casing (1701). According to a preferred exemplary embodiment, inner and outer profiles in a RSM forms a seal against an inner surface of the wellbore casing preventing substantial axial and longitudinal movement of the RSM during perforation and hydraulic fracturing process.

Preferred Embodiment Wellbore Setting Tool (WST) System Block Diagram (1800-2200)

Figure 18:
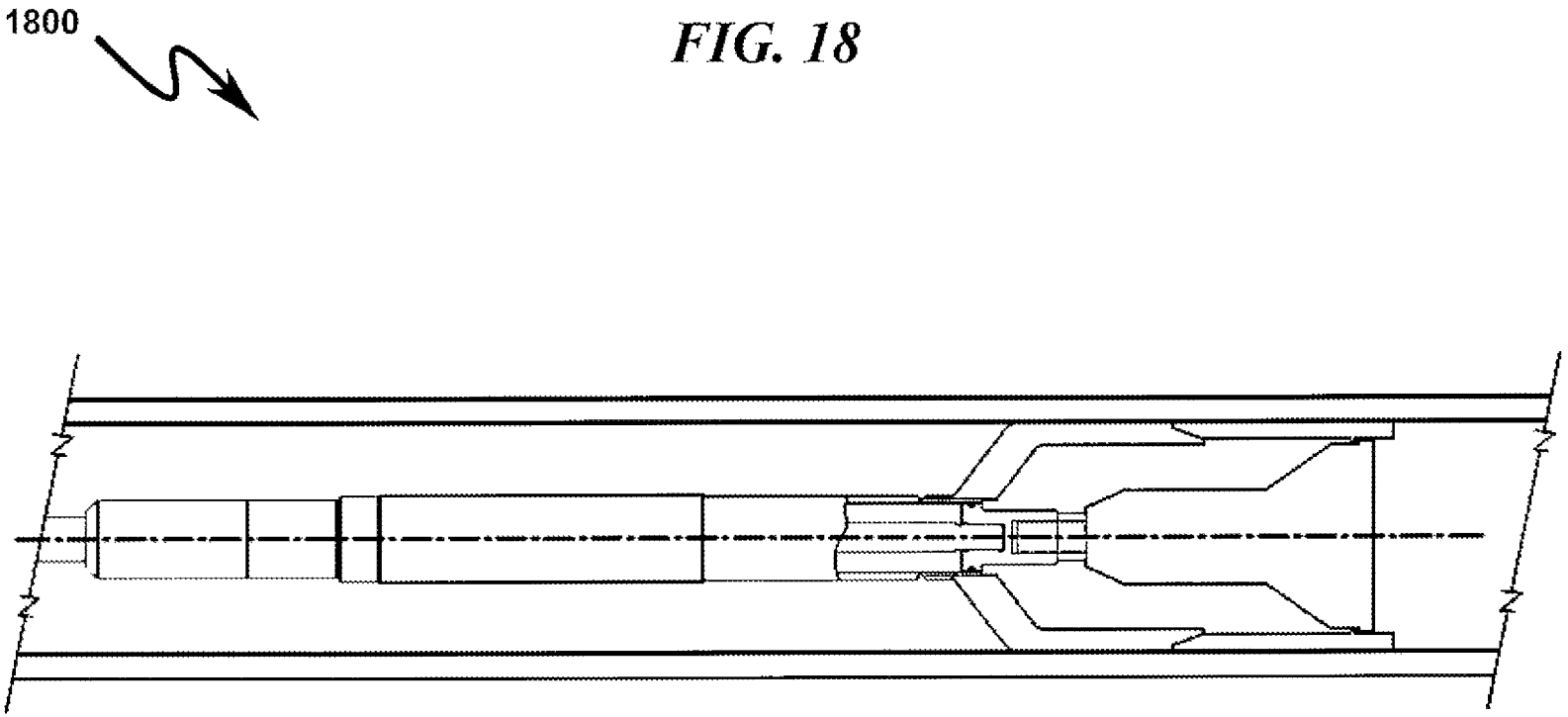
FIG. 18 illustrates a cross section view of a wellbore setting tool setting a restriction sleeve member depicting a preferred exemplary system embodiment.
Figure 19:
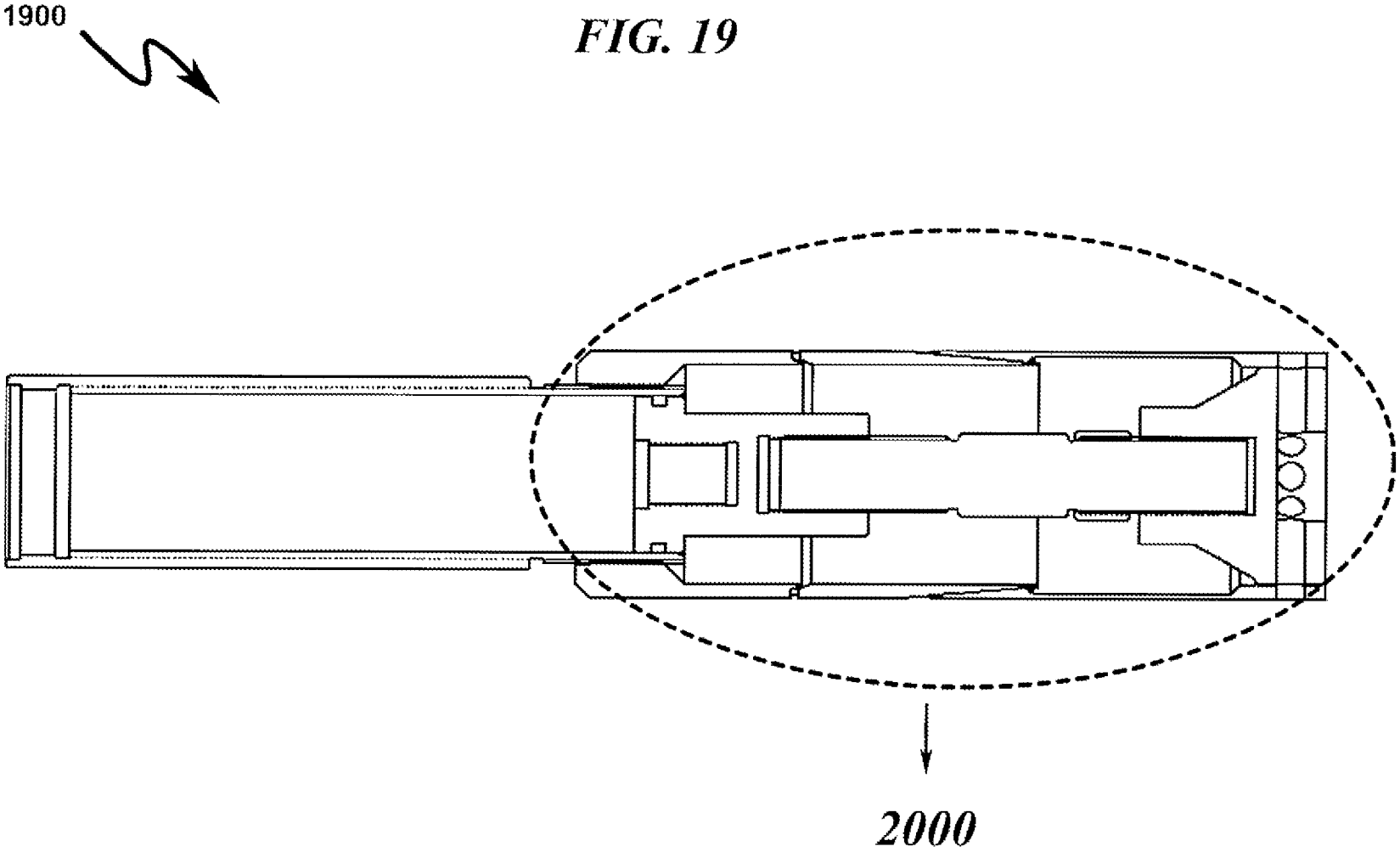
FIG. 19 illustrates a detailed cross section view of a wellbore setting tool setting a restriction sleeve member depicting a preferred exemplary system embodiment.
Figure 20:
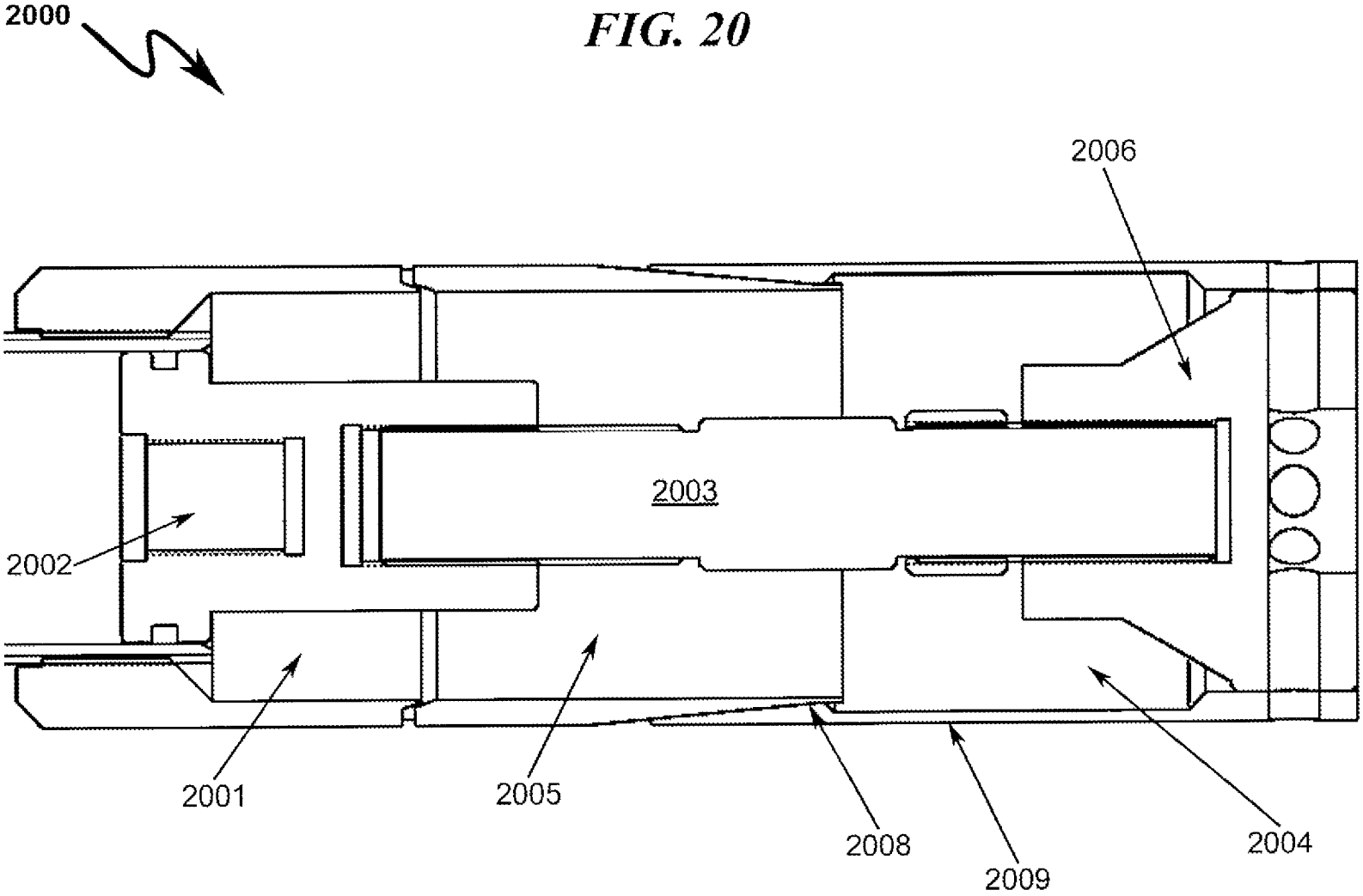
FIG. 20 illustrates a detailed side section view of a wellbore setting tool setting a restriction sleeve member depicting a preferred exemplary system embodiment.
Figure 21:
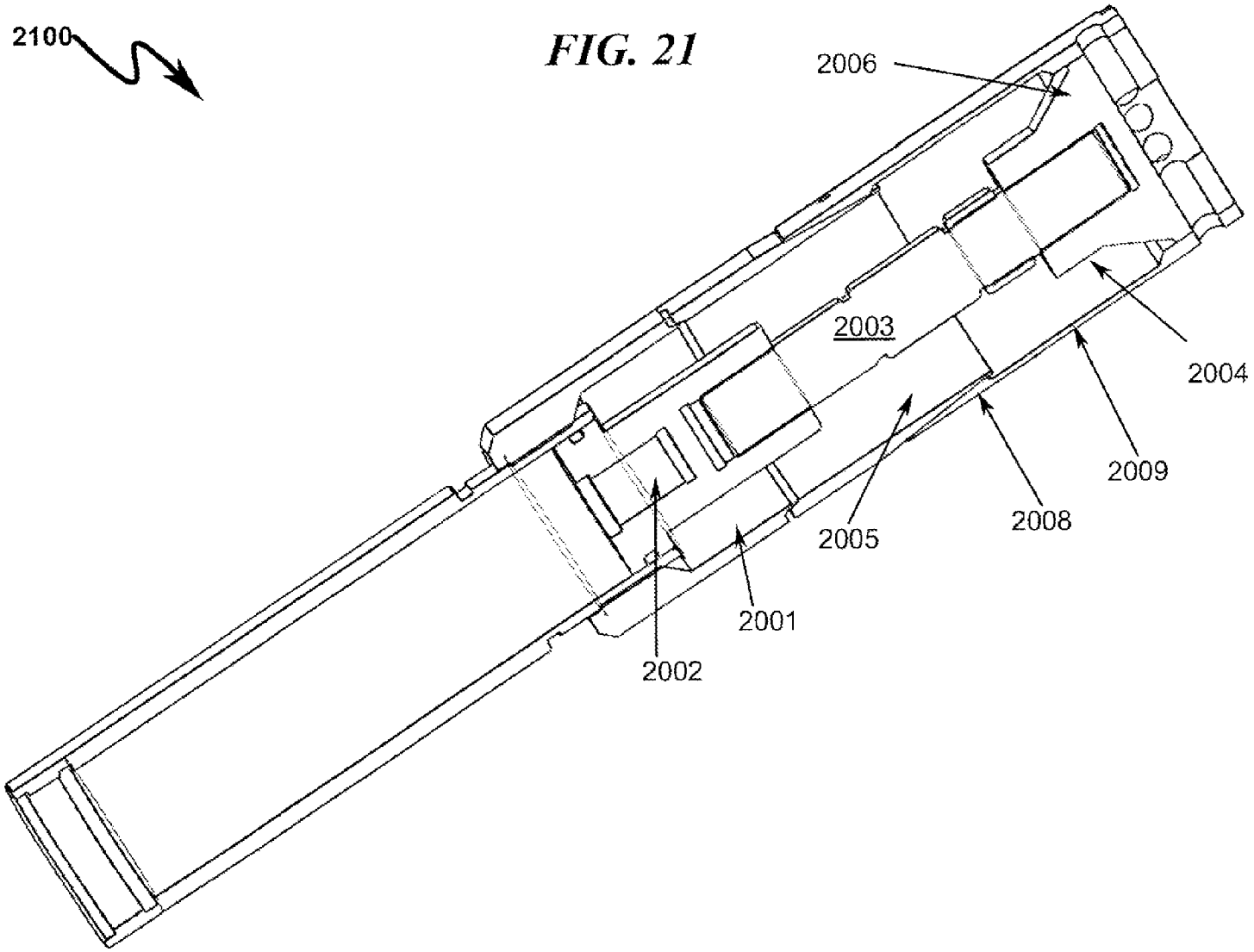
FIG. 21 illustrates a detailed perspective view of a wellbore setting tool setting a restriction sleeve member depicting a preferred exemplary system embodiment.
Figure 22:
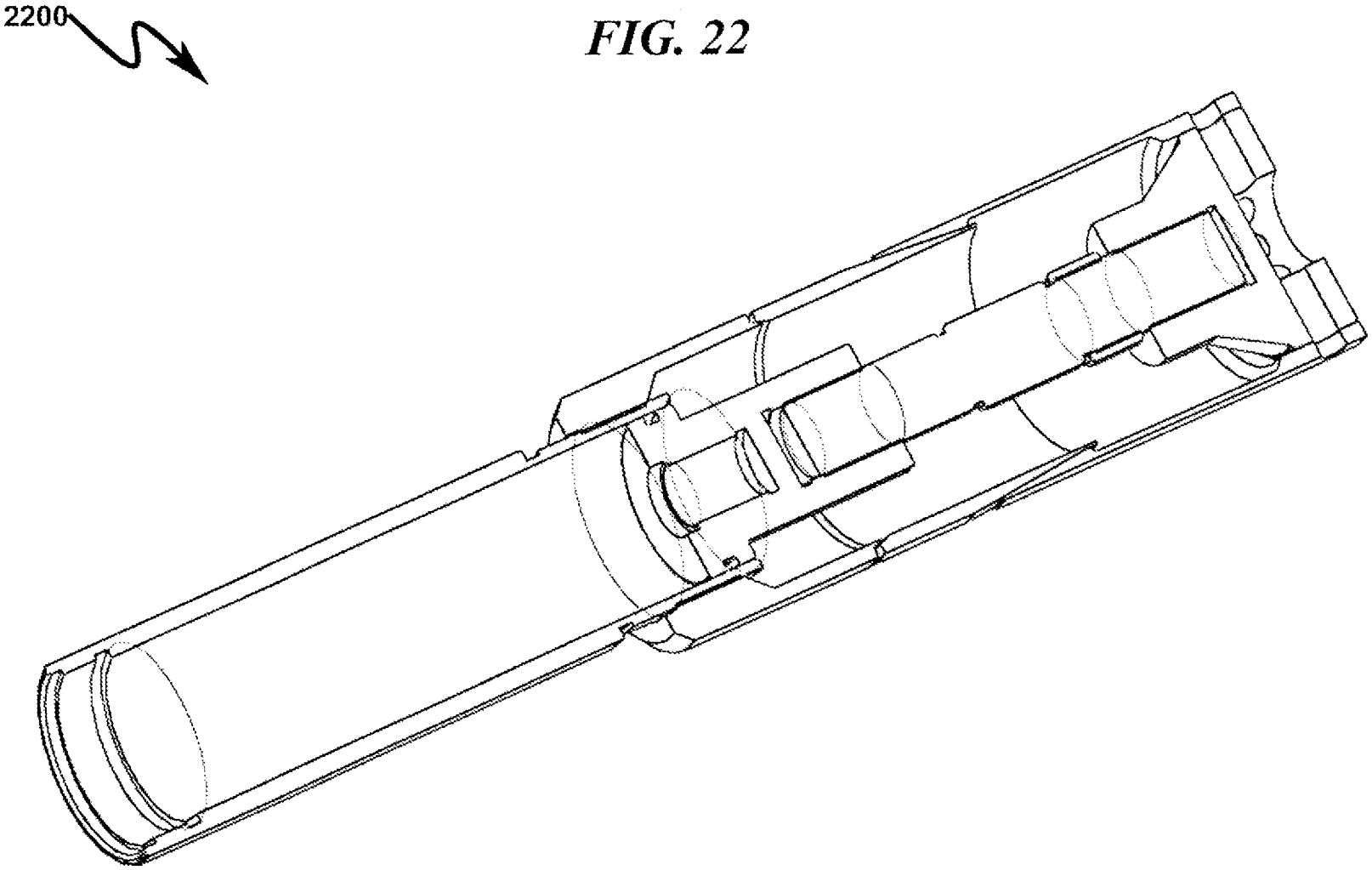
FIG. 22 illustrates another detailed perspective view of a wellbore setting tool setting a restriction sleeve member depicting a preferred exemplary system embodiment.

FIG. 18 (1800) and FIG. 19 (1900) show a front cross section view of a WST. According to a preferred exemplary embodiment, a wellbore setting tool (WST) may be seen in more detail as generally illustrated in FIG. 20 (2000). A WST-RSM sleeve adapter (2001) holds the RSM (2008) in place until it reaches the desired location down hole. After the RSM (2008) is at the desired location the WST-RSM sleeve adapter (2001) facilitates a reactionary force to engage the RSM (2008). When the WST (2002) is actuated, a RSM swaging member and plug seat (2005) provides the axial force to swage an expanding sleeve (2004) outward. A RSM-ICD expanding sleeve (2004) hoops outward to create a sealing surface between the RSM (2008) and inner casing diameter (ICD) (2009). After the WST (2002) actuation is complete, it may hold the RSM (2008) to the ICD (2009) by means of sealing force and potential use of other traction adding devices such as carbide buttons or wicker forms. The WST-RSM piston (2006) transmits the actuation force from the WST (2002) to the RSM (2008) by means of a shear set, which may be in the form of a machined ring or shear pins. The connecting rod (2003) holds the entire assembly together during the setting process. During activation, the connecting rod (2003) may transmit the setting force from the WST (2002) to the WST piston (2006). FIG. 21 (2100) and FIG. 22 (2200) show perspective views of the WST (2002) in more detail.

Preferred Embodiment Wellbore Plug Isolation System Block Diagram (2300-3100)

Figure 23:
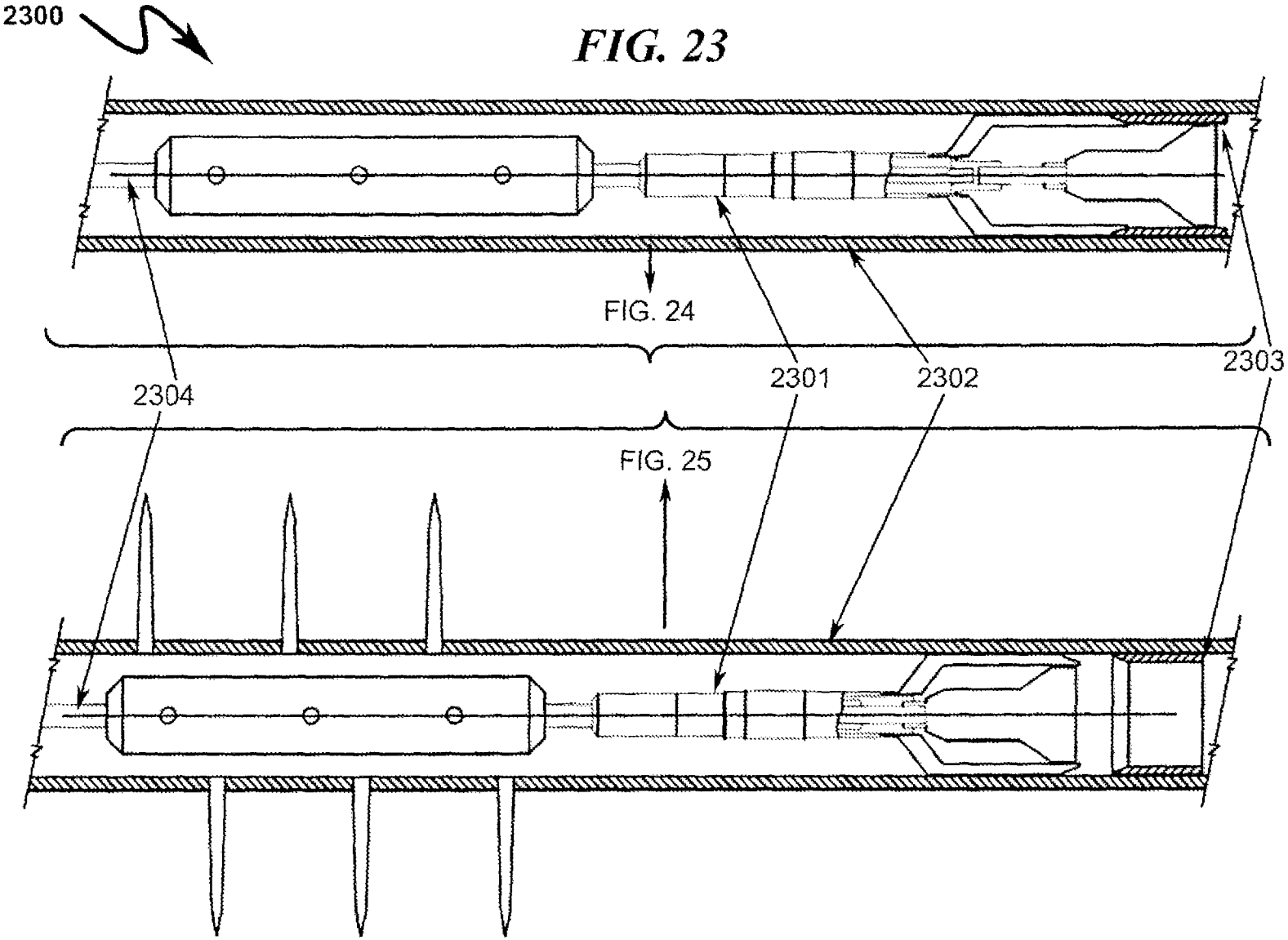
FIG. 23 illustrates a cross section view of a wellbore setting tool setting a restriction sleeve member and removing the tool depicting a preferred exemplary system embodiment.
Figure 31:
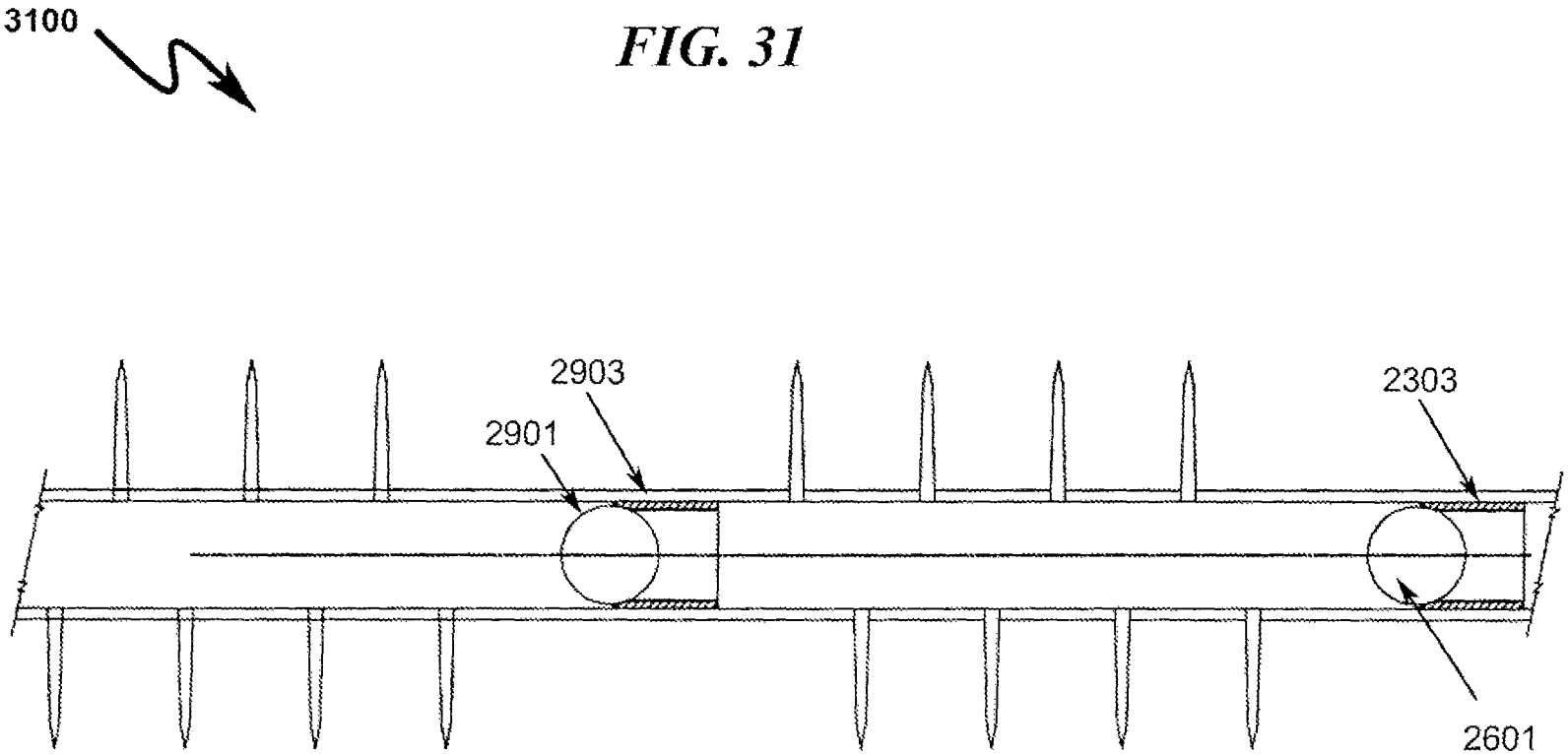
FIG. 31 illustrates a detailed cross section view of a spherical restriction plug element seated in a second restriction sleeve member depicting a preferred exemplary system embodiment.

As generally seen in the aforementioned flow chart of FIG. 6 (0600), the steps implemented for wellbore plug isolation are illustrated in FIG. 23 (2300)-FIG. 31 (3100).

Figure 24:
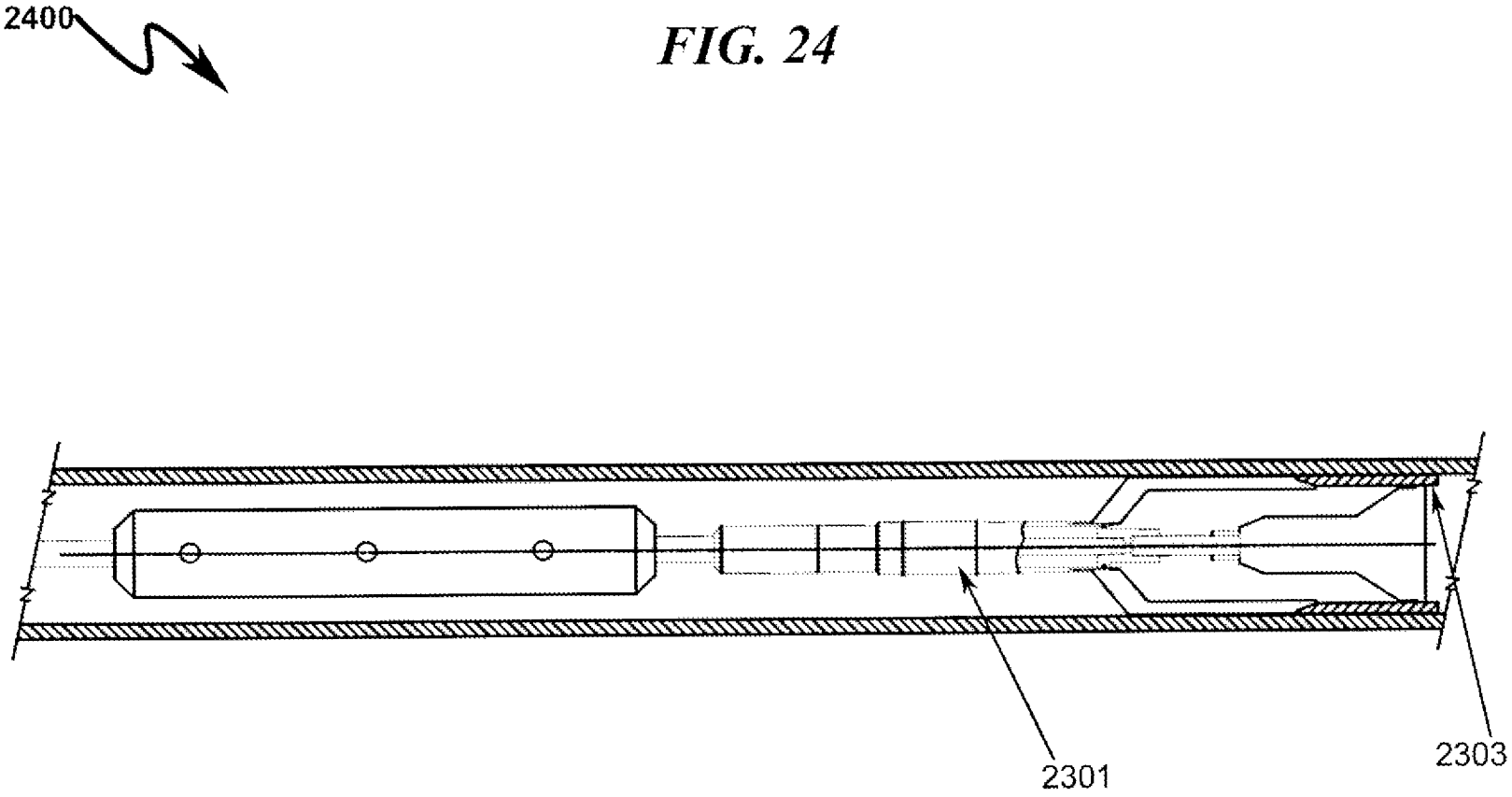
FIG. 24 illustrates a detailed cross section view of wellbore setting tool setting a restriction sleeve member depicting a preferred exemplary system embodiment.

As described above in steps (0601), (0602), and (0603) FIG. 23 (2300) shows a wellbore setting tool (WST) (2301) setting a restriction sleeve member (2303) on the inside surface of a wellbore casing (2302). The WST (2301) may create a conforming seating surface (CSS) in the RSM (2303) or the CSS may be pre-machined. A wireline (2304) or TCP may be used to pump WST (2301) to a desired location in the wellbore casing (2302). FIG. 24 (2400) shows a detailed view of setting the RSM (2303) at a desired location.

Figure 25:
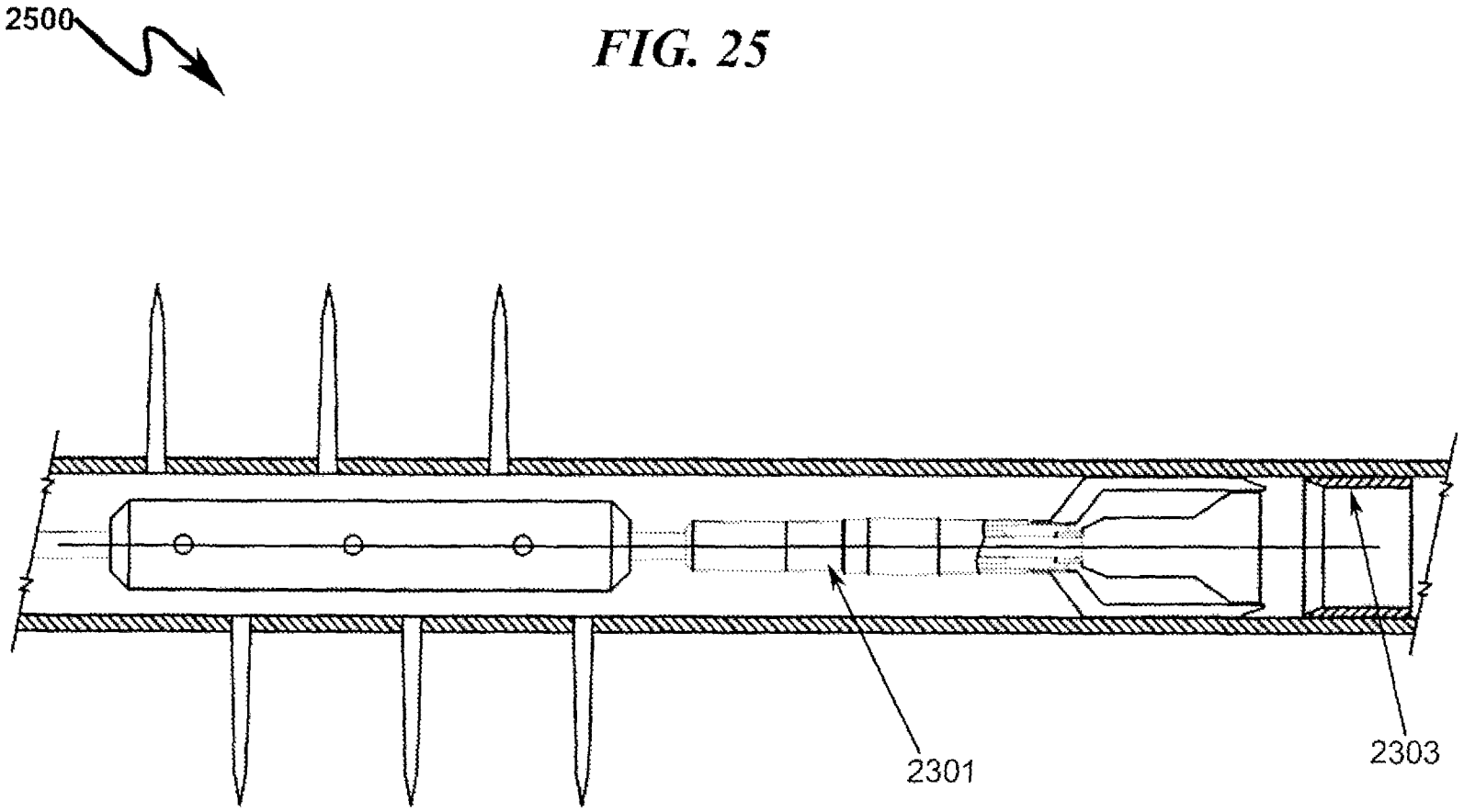
FIG. 25 illustrates a cross section view of wellbore setting tool removed from wellbore casing depicting a preferred exemplary system embodiment.

FIG. 25 (2500) illustrates the stage perforated with perforating guns after setting the RSM (2303) and removing WST (2301) as aforementioned in steps (0604) and (0605).

Figure 26:
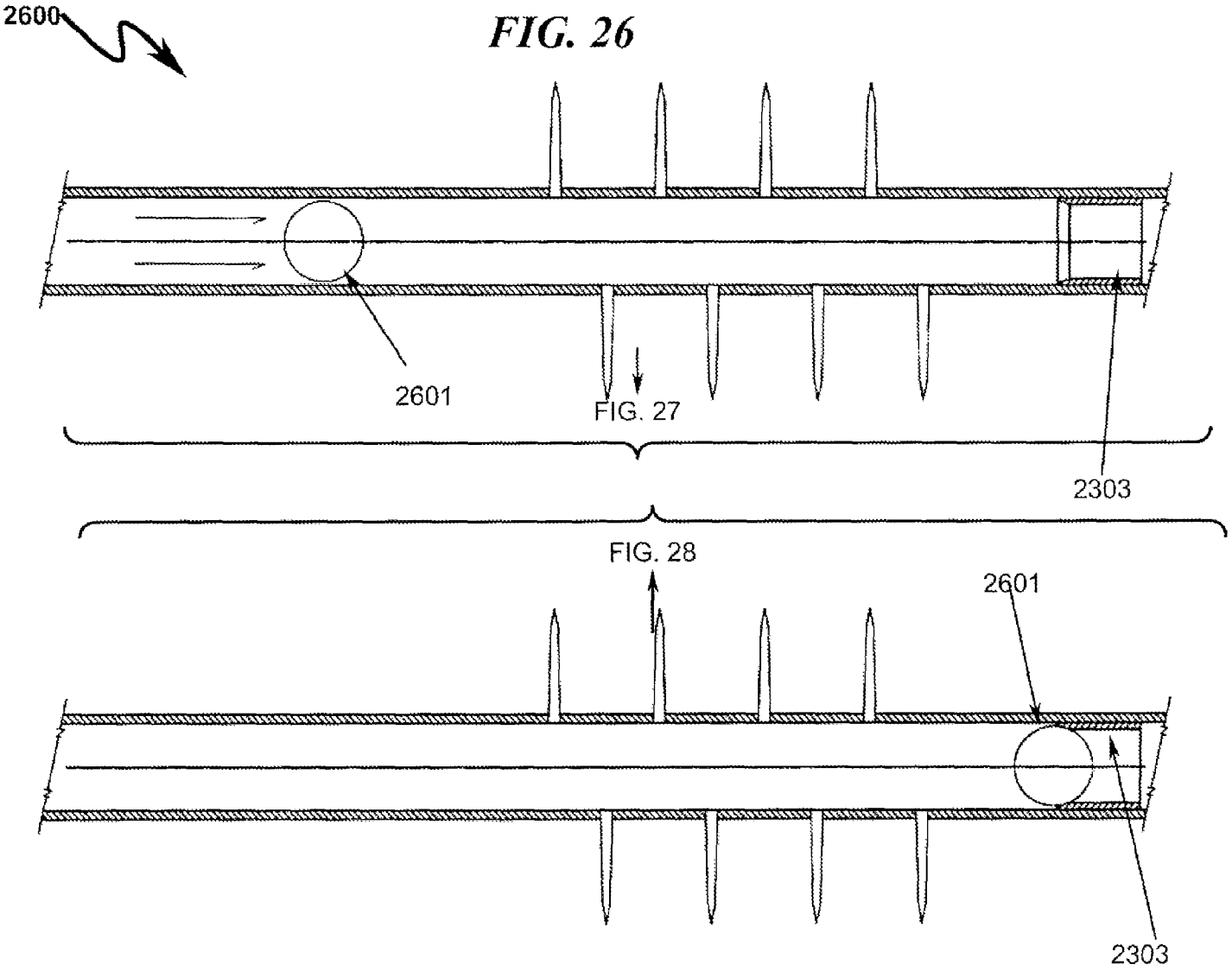
FIG. 26 illustrates a cross section view of a spherical restriction plug element deployed and seated into a restriction sleeve member depicting a preferred exemplary system embodiment.
Figure 27:
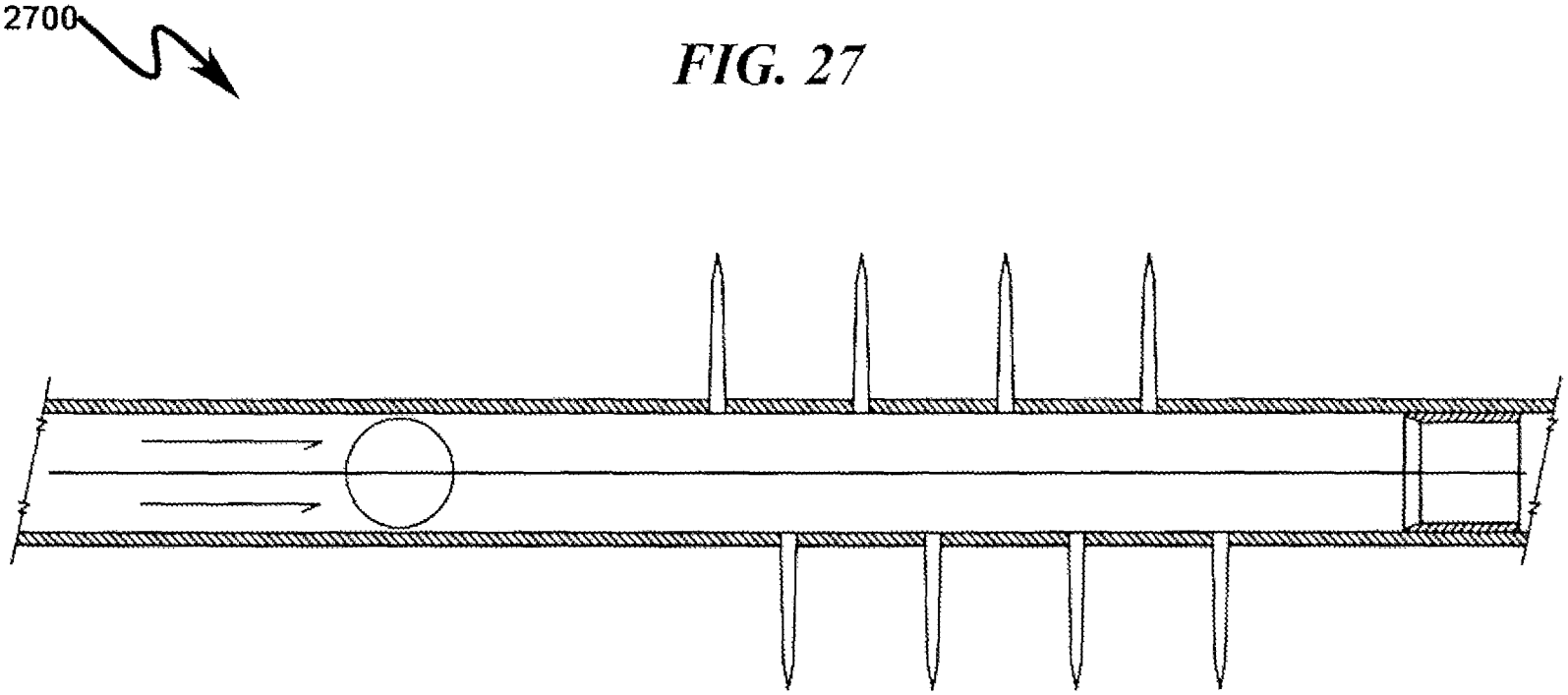
FIG. 27 illustrates a detailed cross section view of a spherical restriction plug element deployed into a restriction sleeve member depicting a preferred exemplary system embodiment.
Figure 28:
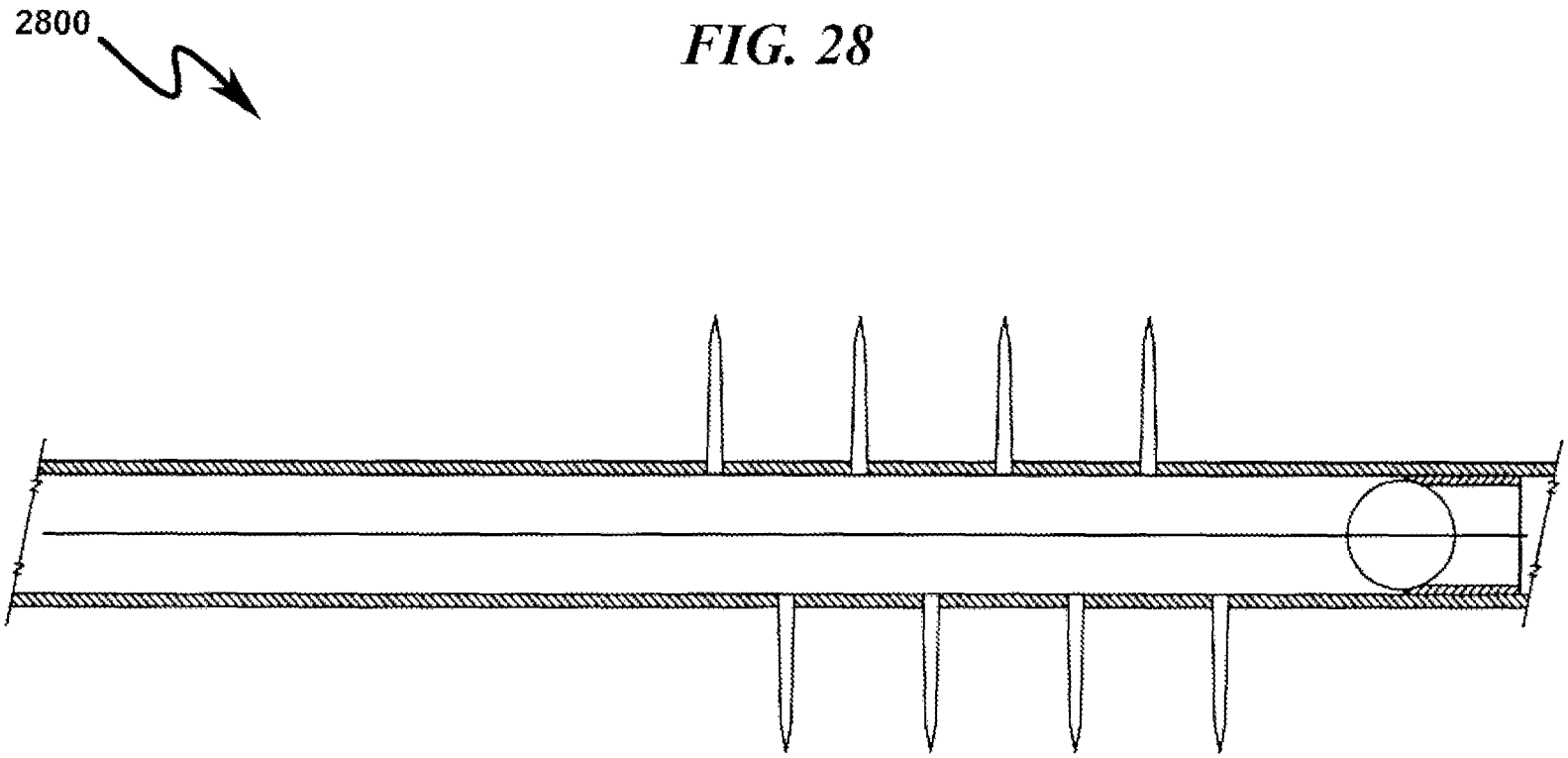
FIG. 28 illustrates a detailed cross section view of a spherical restriction plug element seated in a restriction sleeve member depicting a preferred exemplary system embodiment.

FIG. 26 (2600) illustrates a restriction plug element (RPE) (2601) deployed into the wellbore casing as described in step (0606). The RPE (2601) may seat in the conforming seating surface in RSM (2303) or directly in the RSM if the CSS is not present. After the RPE (2601) is seated, the stage is isolated from toe end pressure communication. The isolated stage is hydraulically fractured as described in step (0607). FIG. 27 (2700) shows details of RPE (2601) deployed into the wellbore casing. FIG. 28 (2800) shows details of RPE (2601) seated in RSM (2303).

Figure 29:
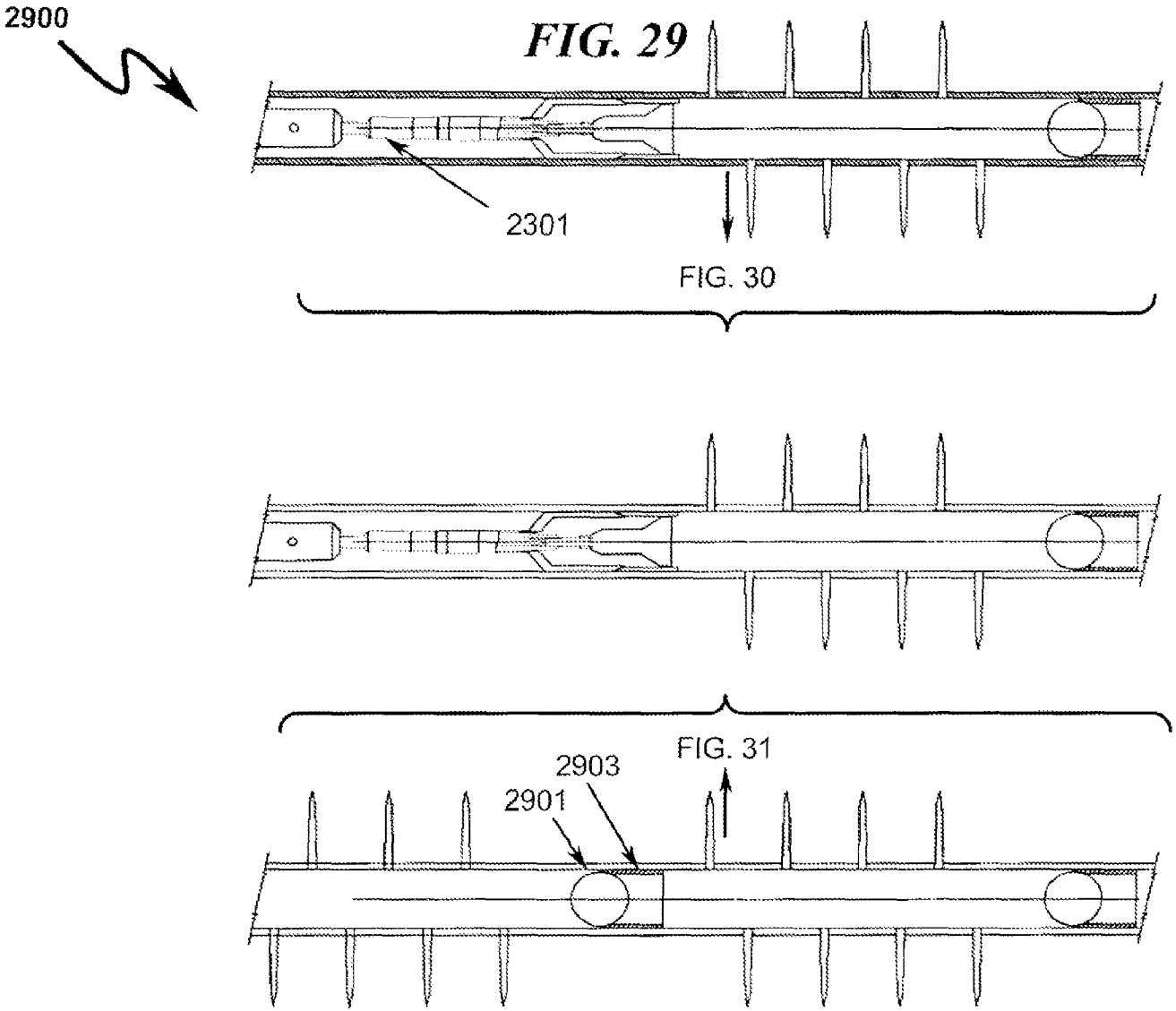
FIG. 29 illustrates a cross section view of wellbore setting tool setting a restriction sleeve member and a seating a second restriction plug element depicting a preferred exemplary system embodiment.
Figure 30:
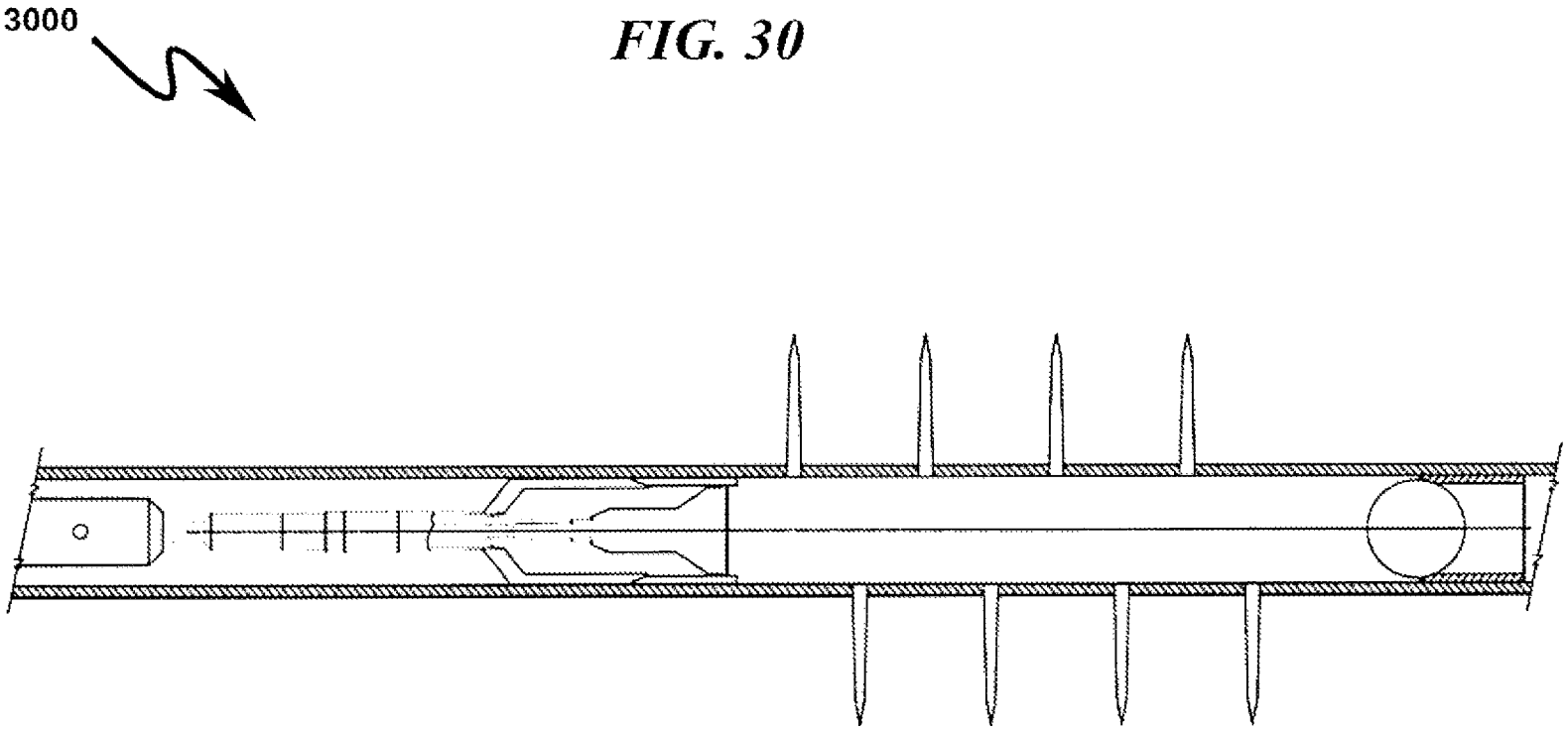
FIG. 30 illustrates a detailed cross section view of wellbore setting tool setting a second restriction sleeve member depicting a preferred exemplary system embodiment.

FIG. 29 (2900) illustrates a WST (2301) setting another RSM (2903) at another desired location towards heel of the RSM (2303). Another RPE (2901) is deployed to seat in the RSM (2903). The RPE (2901) isolates another stage toe ward of the aforementioned isolated stage. The isolated stage is fractured with hydraulic fracturing fluids. FIG. 30 (3000) shows a detailed cross section view of WST (2301) setting RSM (2903) at a desired location. FIG. 31 (3100) shows a detailed cross section view of an RPE (2901) seated in RSM (2903). When all the stages are complete as described in (0608) the RPEs may remain in between the RSMs or flowed back or pumped into the wellbore (0609). According to a preferred exemplary embodiment, the RPE's and RSM's are degradable which enables larger inner diameter to efficiently pump oil and gas without restrictions and obstructions.

Preferred Embodiment Restriction Sleeve Member (RSM) with Flow Channels Block Diagram (3200-3400)

Figure 32:
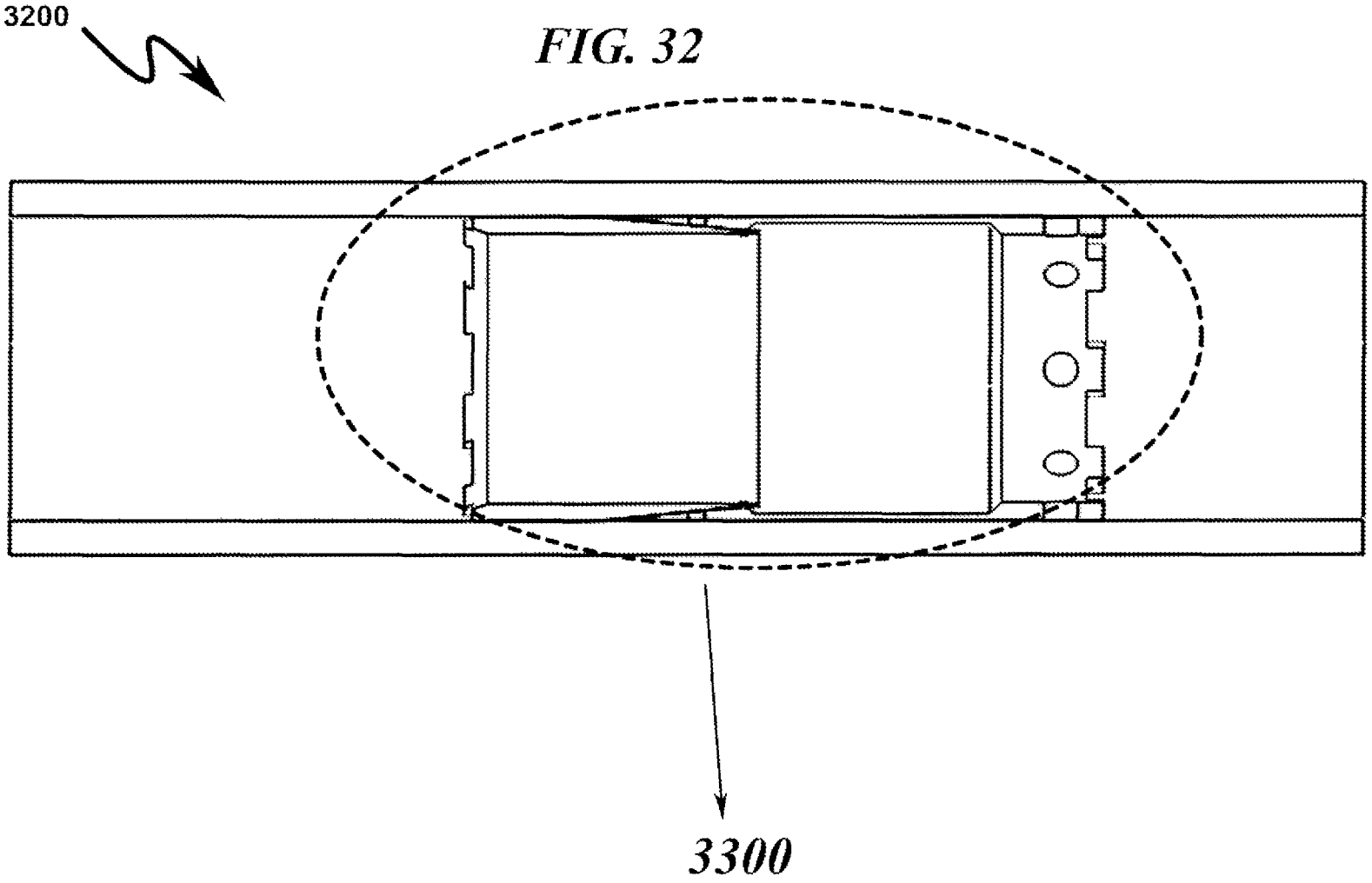
FIG. 32 illustrates a cross section view of a restriction sleeve member with flow channels according to a preferred exemplary system embodiment.
Figure 33:
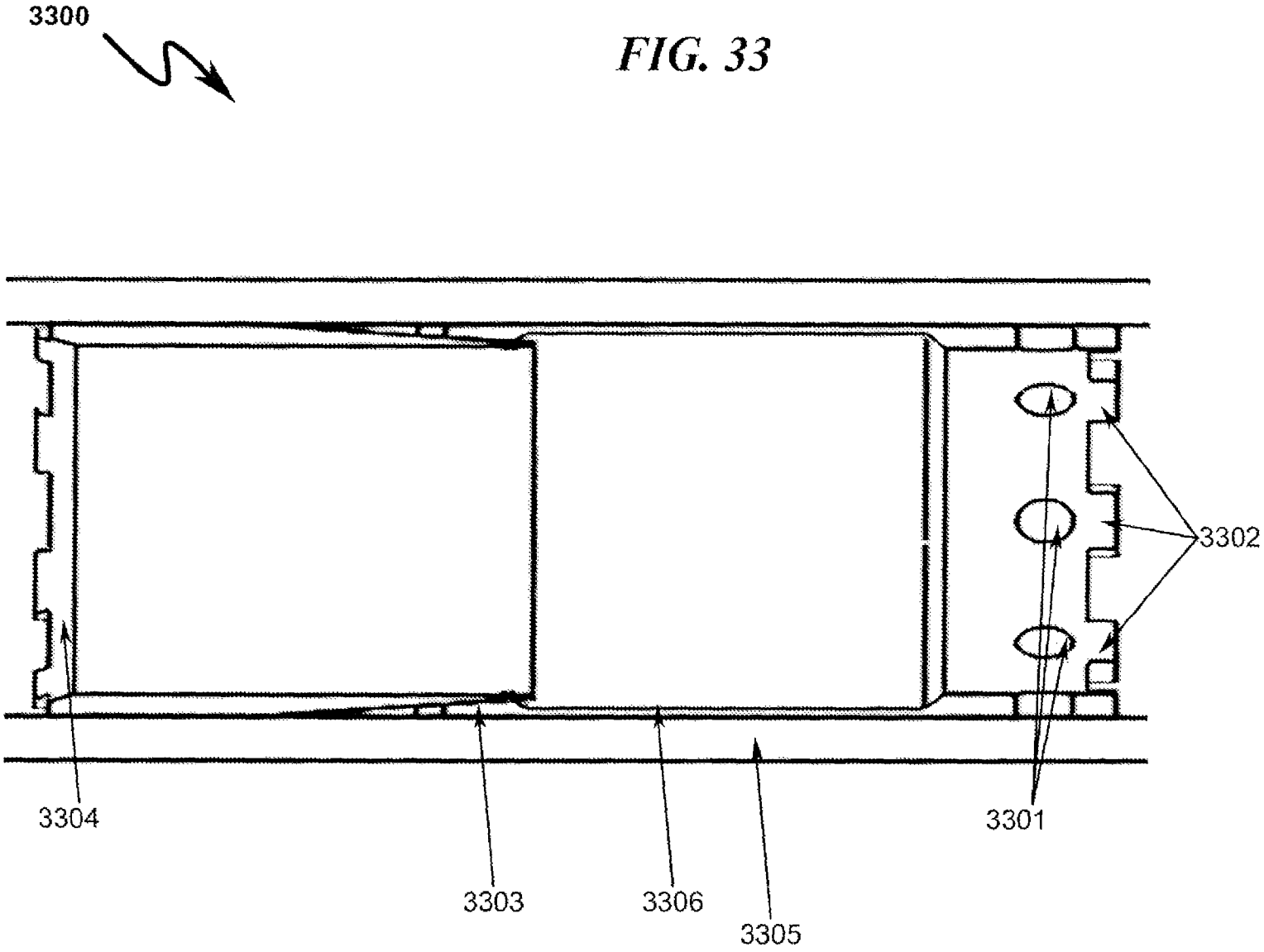
FIG. 33 illustrates a detailed cross section view of a restriction sleeve member with flow channels according to a preferred exemplary system embodiment.
Figure 34:
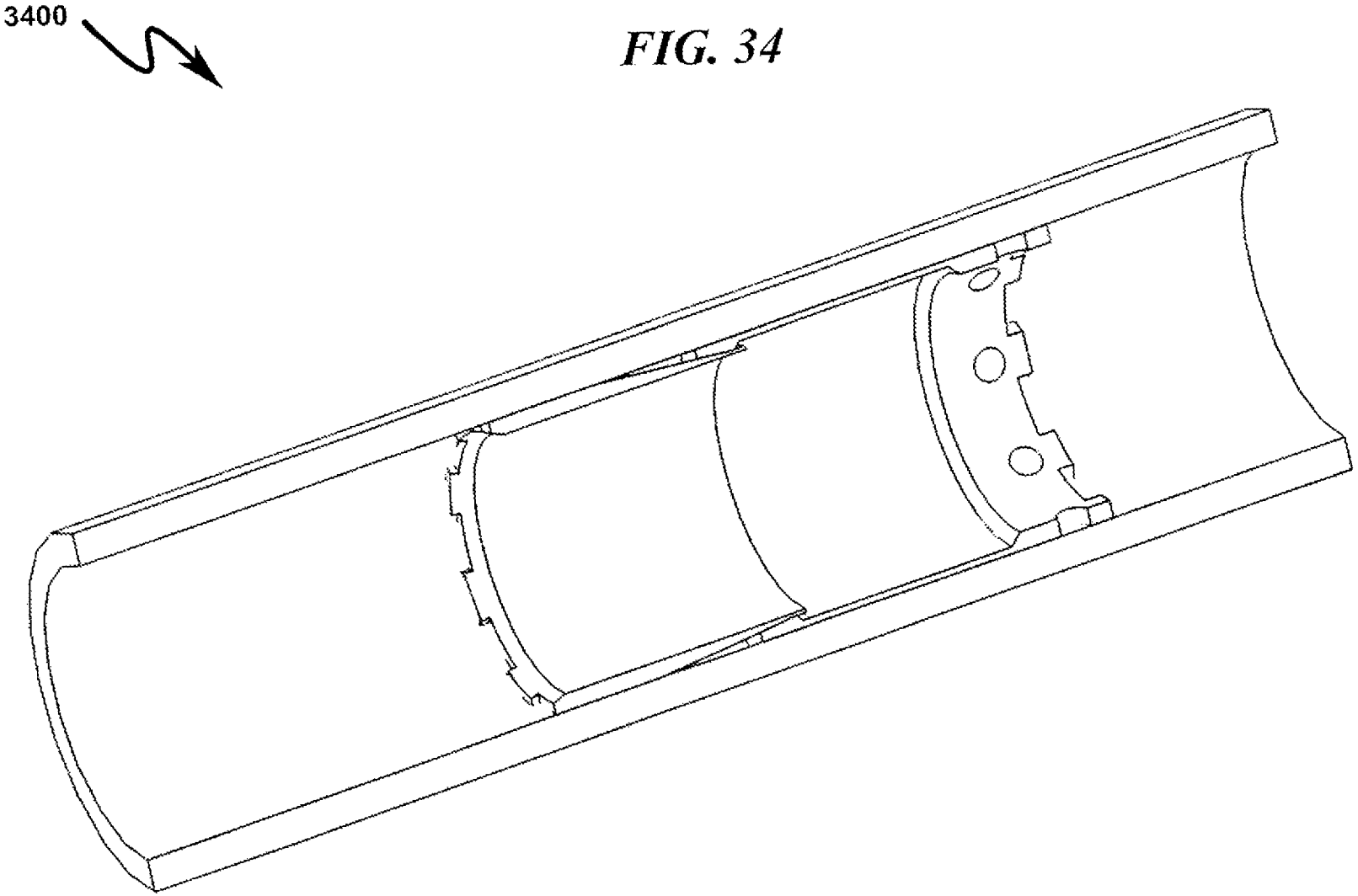
FIG. 34 illustrates a perspective view of a restriction sleeve member with flow channels according to a preferred exemplary system embodiment.

A further preferred embodiment may be seen in more detail as generally illustrated in FIG. 32 (3200), FIG. 33 (3300) and FIG. 34 (3400), wherein a restrictive sleeve member RSM (3306) comprising flow channels (3301) is set inside a wellbore casing (3305). A conforming seating surface (CSS) (3303) may be formed in the RSM (3306). The flow channels (3301) are designed in RSM (3306) to enable fluid flow during oil and gas production. The flow channels provide a fluid path in the production direction when restriction plug elements (RPE) degrade but are not removed after all stages are hydraulically fractured as aforementioned in FIG. 6 (0600) step (0609). The channels (3301) are designed such that there is unrestricted fluid flow in the production direction (heel ward) while the RPEs block fluid communication in the injection direction (toe ward). Leaving the RPEs in place provides a distinct advantage over the prior art where a milling operation is required to mill out frac plugs that are positioned to isolate stages.

According to yet another preferred embodiment, the RSMs may be designed with fingers on either end to facilitate milling operation, if needed. Toe end fingers (3302) and heel end fingers (3304) may be designed on the toe end and heel end the RSM (3306) respectively. In the context of a milling operation, the toe end fingers may be pushed towards the heel end fingers of the next RSM (toe ward) such that the fingers are intertwined and interlocked. Subsequently, all the RSMs may be interlocked with each other finally eventually mill out in one operation as compared to the current method of milling each RSM separately.

Preferred Embodiment Wellbore Setting Tool (WST) System Double Set Block Diagram (3500-3700)

Figure 35:
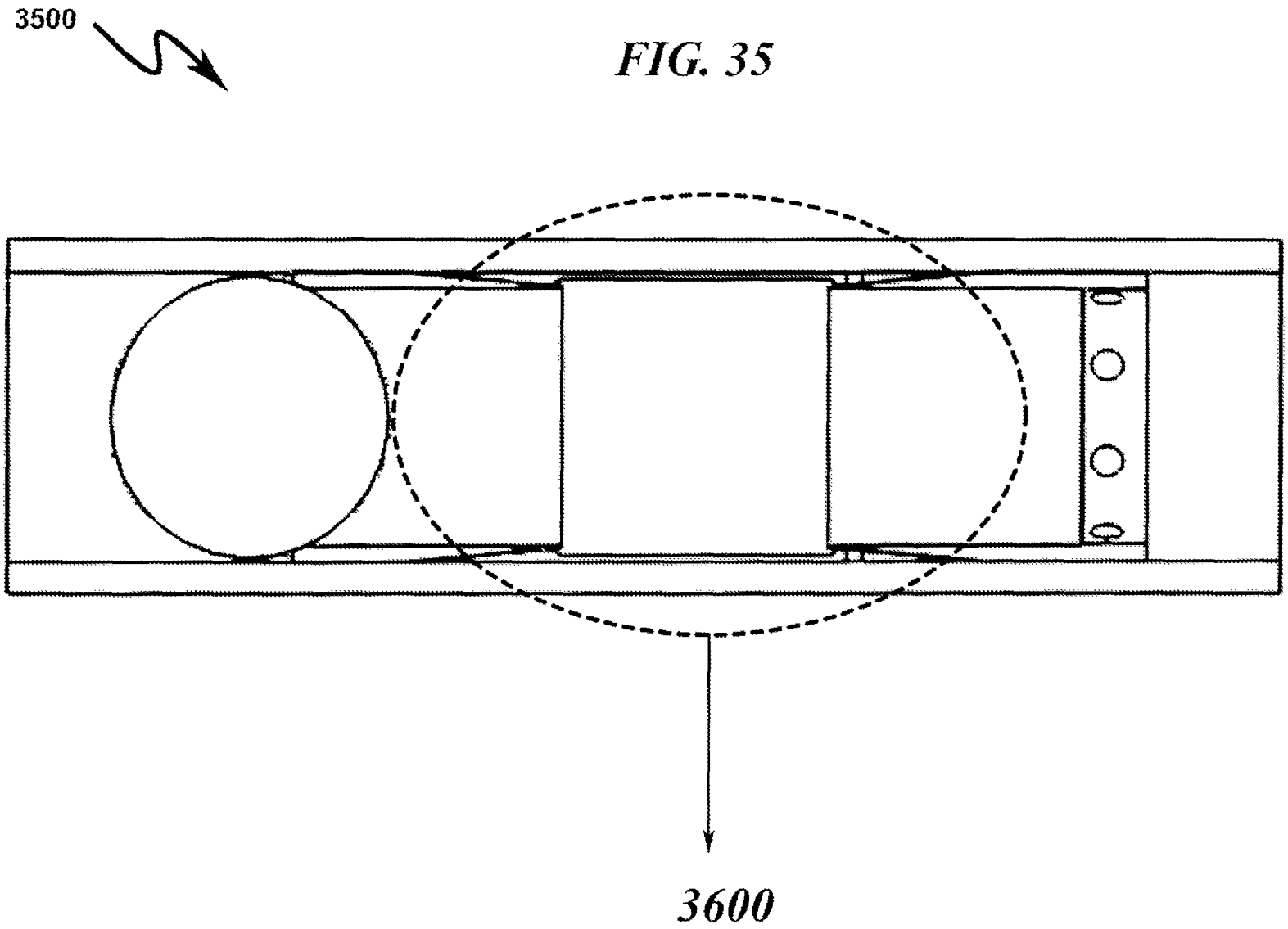
FIG. 35 illustrates a cross section view of a double set restriction sleeve member according to a preferred exemplary system embodiment.
Figure 36:
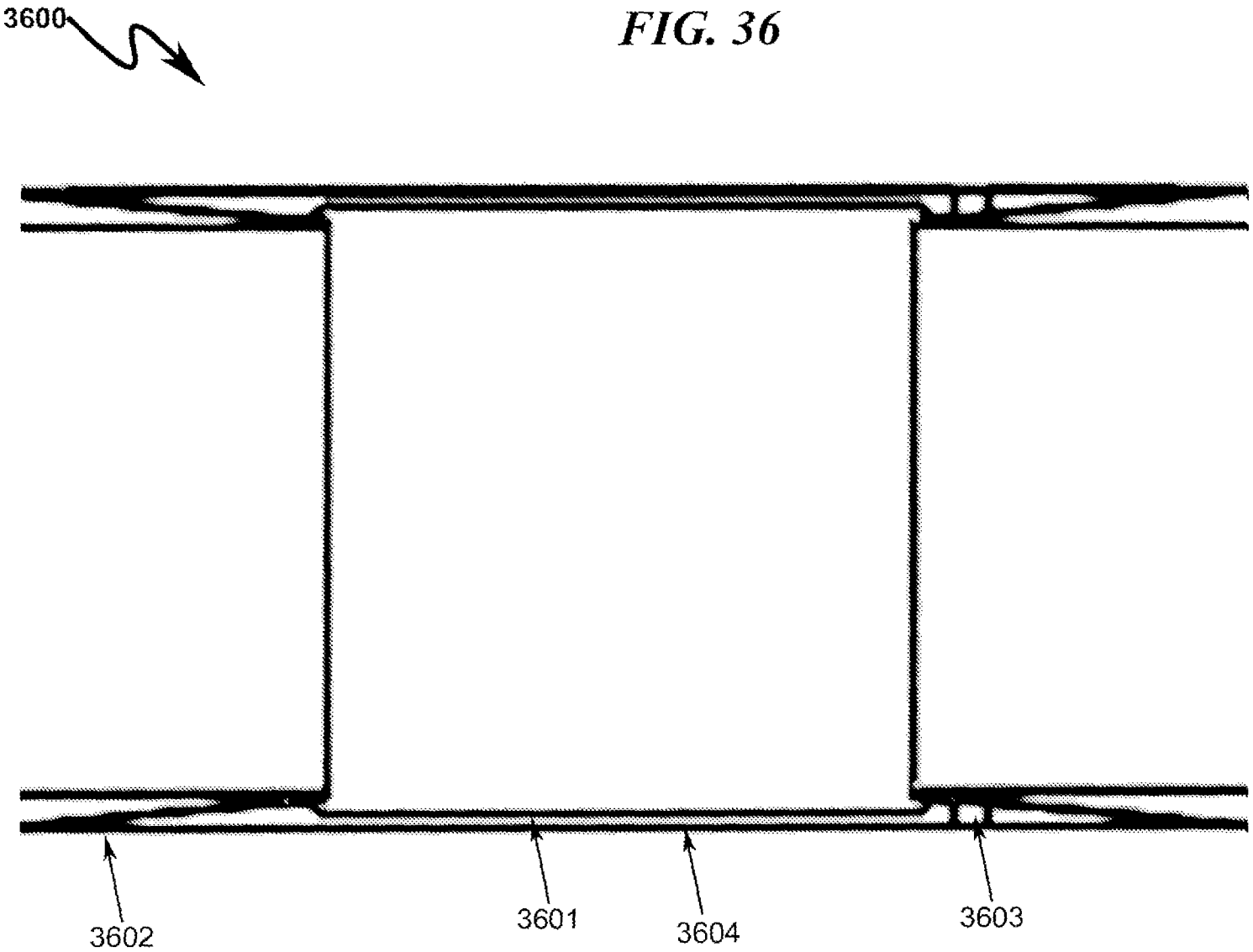
FIG. 36 illustrates a detailed cross section view of a double set restriction sleeve member according to a preferred exemplary system embodiment.
Figure 37:
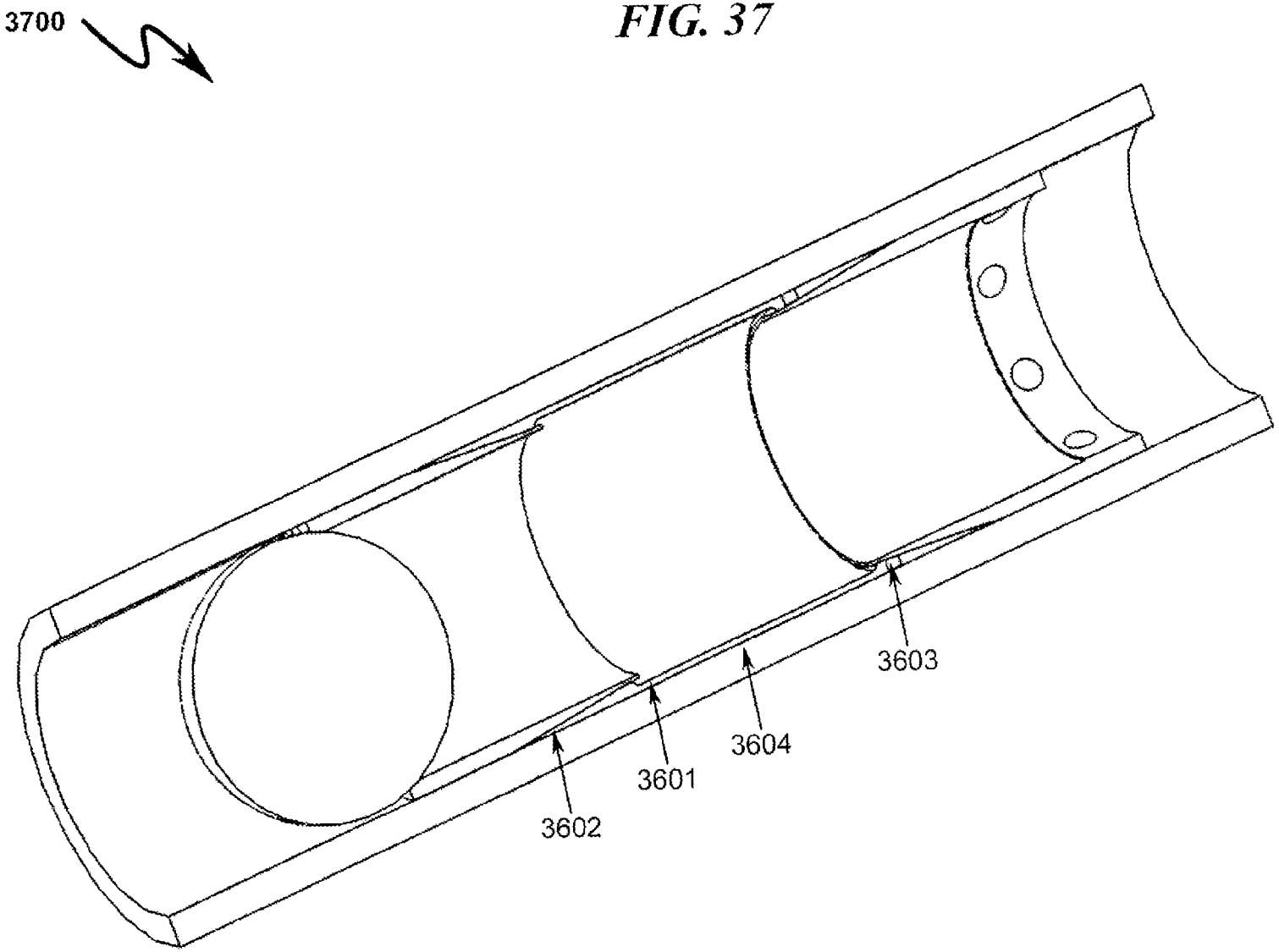
FIG. 37 illustrates a perspective view of a double set restriction sleeve member according to a preferred exemplary system embodiment.

As generally illustrated in FIG. 35 (3500), FIG. 36 (3600) and FIG. 37 (3700) a wellbore setting tool sets or seals on both sides of a restriction sleeve member (RSM) (3601) on the inner surface (3604) of a wellbore casing. In this context the WST swags the RSM on both sides (double set) and sets it to the inside surface of the wellbore casing. On one end of the RSM (3601), a RSM-ICD expanding sleeve in the WST may hoop outward to create a sealing surface between the RSM (3601) and inner casing diameter (ICS) (3604). On the other side of the RSM (3601), when WST actuation is complete, the WST may hold the RSM (3601) to the ICS (3604) by means of sealing force and potential use of other traction adding gripping devices (3603) such as elastomers, carbide buttons or wicker forms.

According to a preferred exemplary embodiment, a double set option is provided with a WST to seal one end of the RSM directly to the inner surface of the wellbore casing while the other end is sealed with a gripping element to prevent substantial axial and longitudinal movement.

Preferred Embodiment Wellbore Setting Tool (WST) System Multiple Set Block Diagram (3800-4100)

Figure 38:
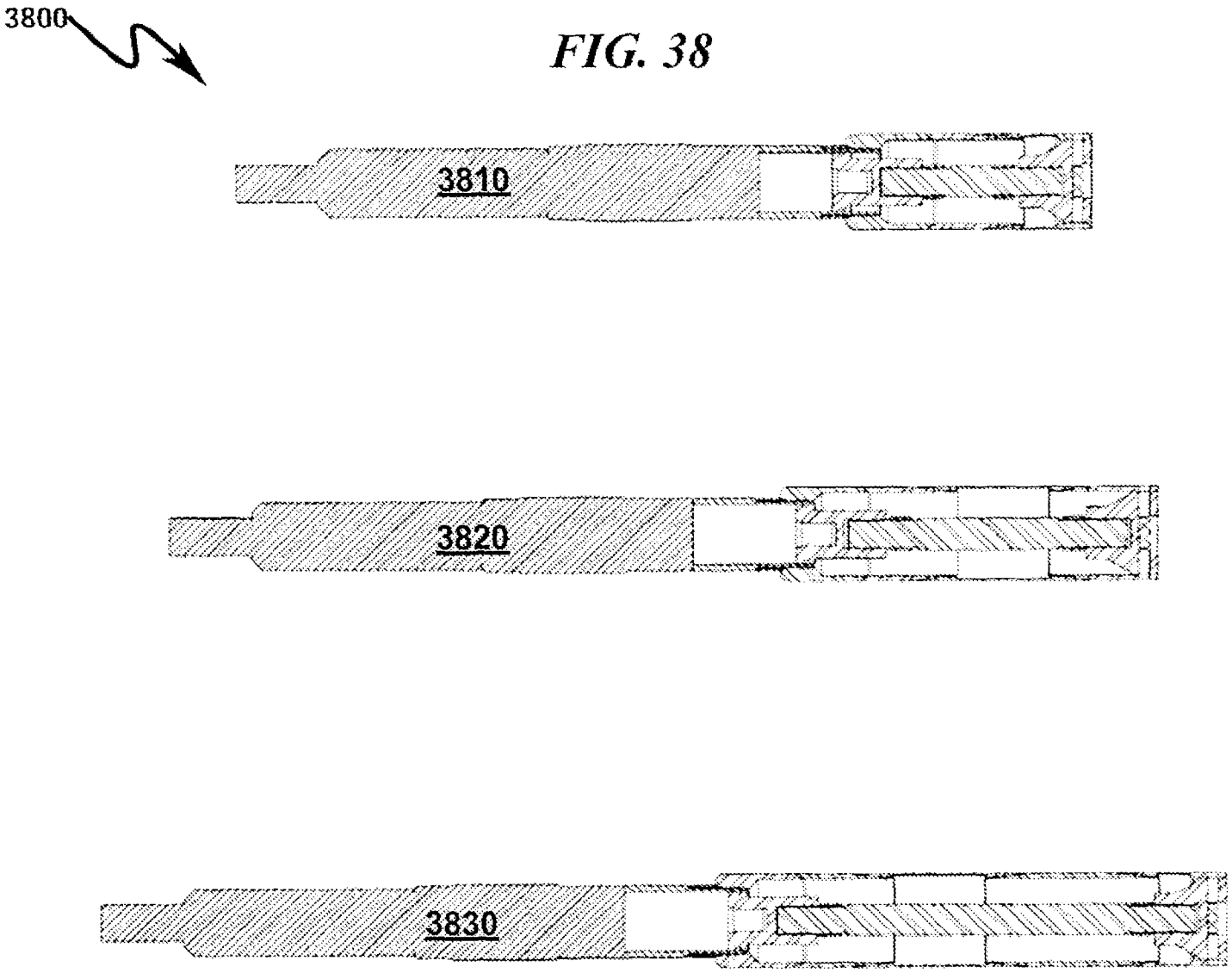
FIG. 38 illustrates a cross section view of a WST setting restriction sleeve member at single, double and triple locations according to a preferred exemplary system embodiment.
Figure 39:
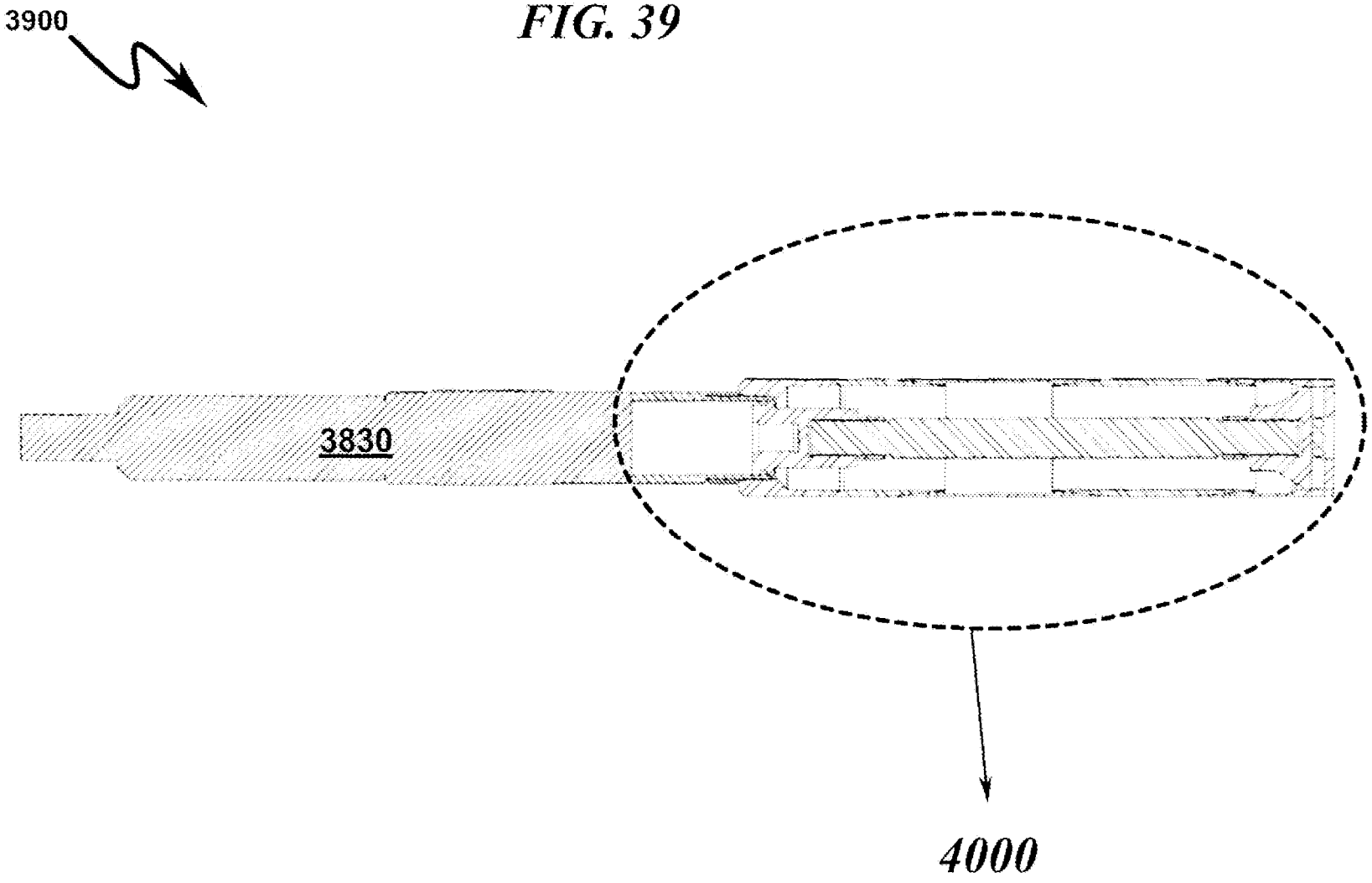
FIG. 39 illustrates a cross section view of a WST with triple set restriction sleeve member according to a preferred exemplary system embodiment.
Figure 40:
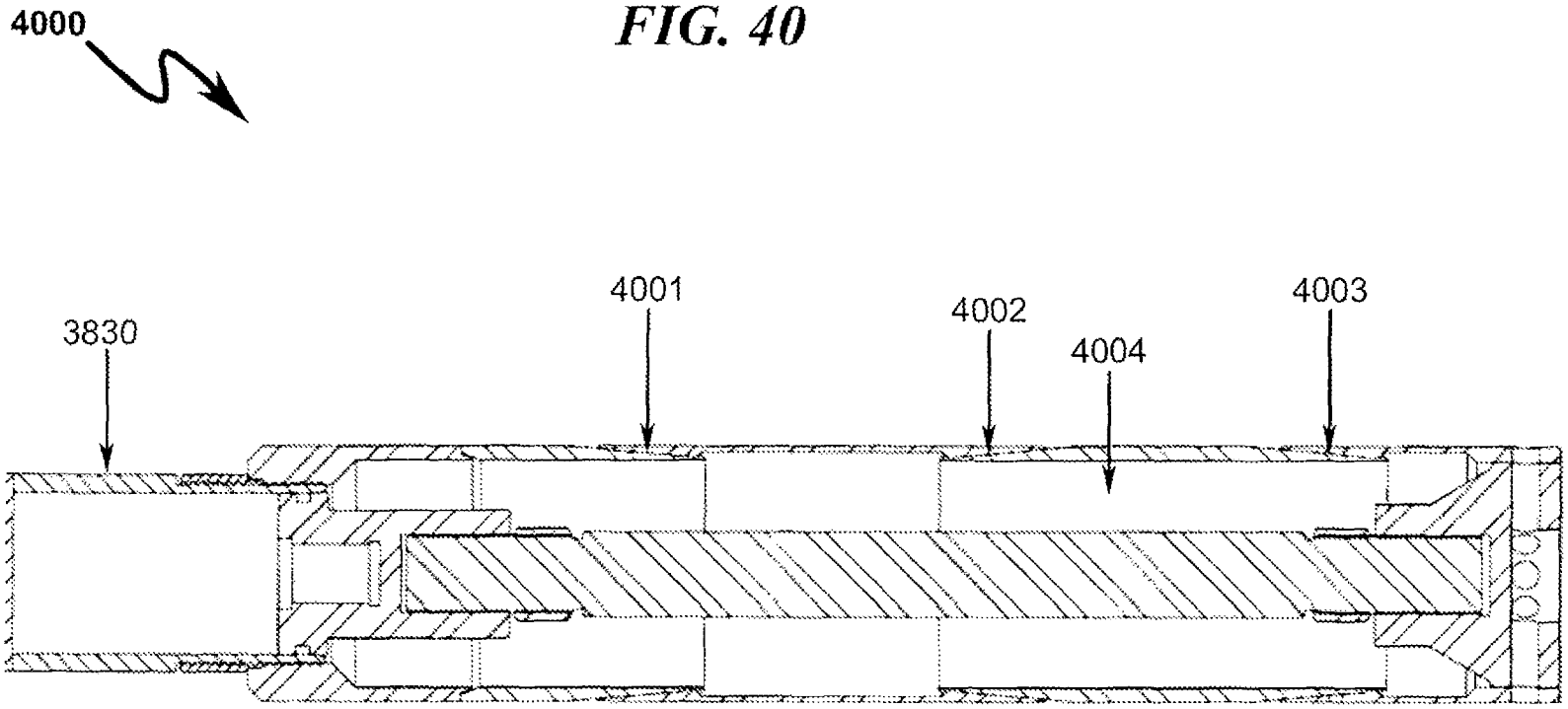
FIG. 40 illustrates a detailed cross section view of a triple set restriction sleeve member according to a preferred exemplary system embodiment.
Figure 41:
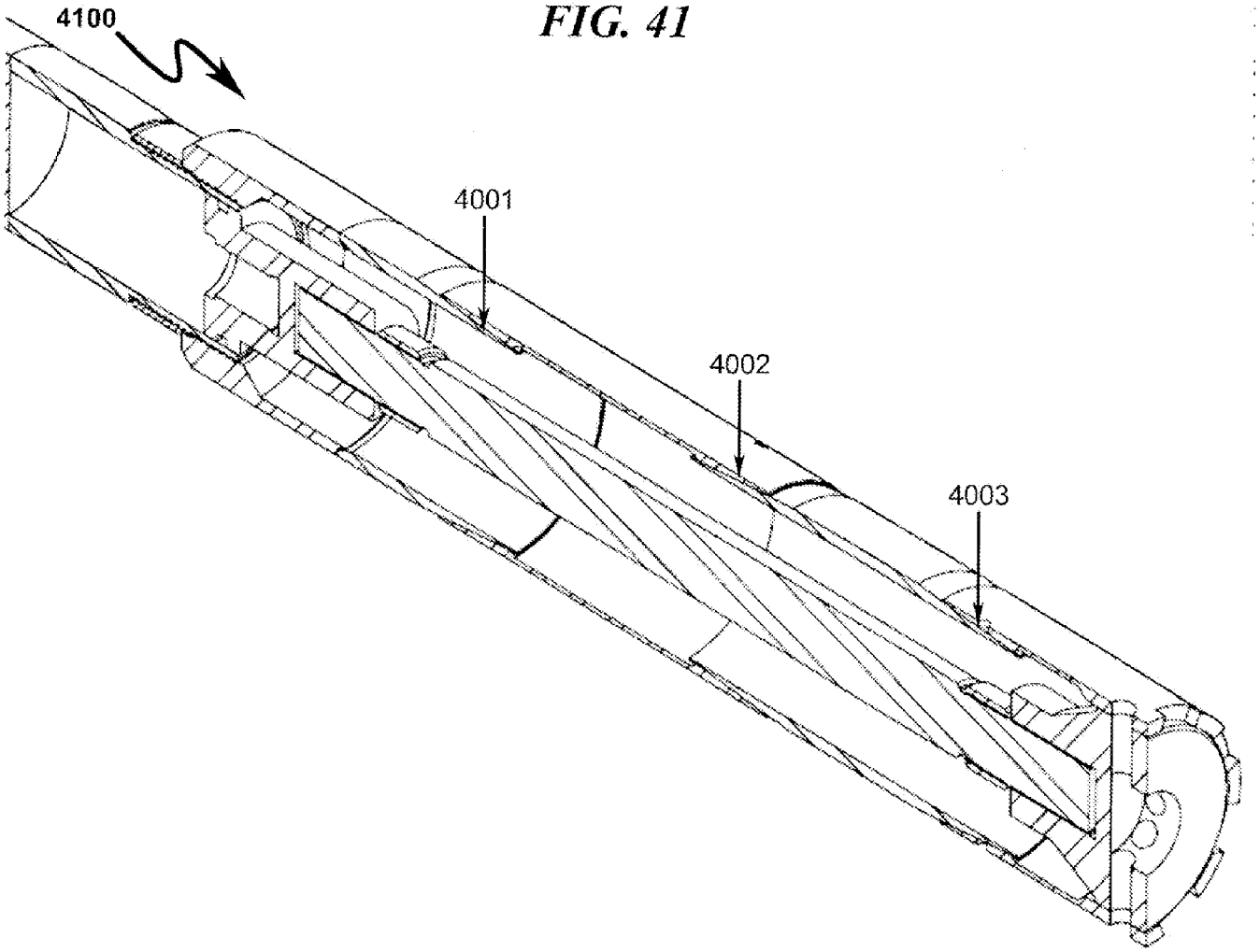
FIG. 41 illustrates a detailed perspective view of a triple set restriction sleeve member according to a preferred exemplary system embodiment.

As generally illustrated in FIG. 38 (3800), FIG. 39 (3900), FIG. 40 (4000), and FIG. 41 (4100) a wellbore setting tool sets or seals RSM at multiple locations. FIG. 38 (3800) shows a WST (3810) that may set or seal RSM at single location (single set), a WST (3820) that may set or seal RSM at double locations (double set), or a WST (3830) that may set or seal RSM 3 locations (triple set). A more detail illustration of WST (3830) may be seen in FIG. 40 (4000). The WST (3830) sets RSM (4004) at 3 locations (4001), (4002), and (4003). According to a preferred exemplary embodiment, WST sets or seals RSM at multiple locations to prevent substantial axial or longitudinal movement of the RSM. It should be noted that single, double and triple sets have been shown for illustrations purposes only and should not be construed as a limitation. The WST could set or seal RSM at multiple locations and not limited to single, double, or triple set as aforementioned. An isometric view of the triple set can be seen in FIG. 41 (4100).

Preferred Embodiment Restriction Sleeve Member Polished Bore Receptacle (PBR)

According to a preferred exemplary embodiment, the restricted sleeve member could still be configured with or without a CSS. The inner sleeve surface (ISS) of the RSM may be made of a polished bore receptacle (PBR). Instead of an independently pumped down RPE, however, a sealing device could be deployed on a wireline or as part of a tubular string. The sealing device could then seal with sealing elements within the restricted diameter of the internal sleeve surface (ISS), but not in the ICS surface. PBR surface within the ISS provides a distinct advantage of selectively sealing RSM at desired wellbore locations to perform treatment or re-treatment operations between the sealed locations, well production test, or test for casing integrity.

System Summary

The present invention system anticipates a wide variety of variations in the basic theme of extracting gas utilizing wellbore casings, but can be generalized as a wellbore isolation plug system comprising:

(a) restriction sleeve member (RSM); and (b) restriction plug element (RPE);

wherein the RSM is configured to fit within a wellbore casing;

the RSM is configured to be positioned at a desired wellbore location by a wellbore setting tool (WST);

the WST is configured to set and form a seal between the RSM and an inner surface of the wellbore casing to prevent substantial movement of the RSM; and the RPE is configured to position to seat in the RSM.

This general system summary may be augmented by the various elements described herein to produce a wide variety of invention embodiments consistent with this overall design description.

Method Summary

The present invention method anticipates a wide variety of variations in the basic theme of implementation, but can be generalized as a wellbore plug isolation method wherein the method is performed on a wellbore plug isolation system comprising:

(a) restriction sleeve member (RSM); and (b) restriction plug element (RPE);

wherein the RSM is configured to fit within a wellbore casing;

the RSM is configured to be positioned at a desired wellbore location by a wellbore setting tool (WST);

the WST is configured to set and form a seal between the RSM and an inner surface of the wellbore casing to prevent substantial movement of the RSM; and the RPE is configured to position to seat in the RSM;

wherein the method comprises the steps of:

(1) installing the wellbore casing;

(2) deploying the WST along with the RSM and a perforating gun string assembly (GSA) to a desired wellbore location in the wellbore casing;

(3) setting the RSM at the desired wellbore location with the WST and forming a seal;

(4) perforating the hydrocarbon formation with the perforating GSA;

(5) removing the WST and perforating GSA from the wellbore casing;

(6) deploying the RPE into the wellbore casing to seat in the RSM and creating a hydraulic fracturing stage;

(7) fracturing the stage with fracturing fluids;

(8) checking if all hydraulic fracturing stages in the wellbore casing have been completed, if not so, proceeding to the step (2);

(9) enabling fluid flow in production direction; and

(10) commencing oil and gas production from the hydraulic fracturing stages.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein said WST is further configured to form a conforming seating surface (CSS) in said RSM; and said RPE is configured in complementary shape to said CSS shape to seat to seat in said CSS.

An embodiment wherein a conforming seating surface (CSS) is machined in said RSM; and said RPE is configured in complementary shape to said CSS shape to seat to seat in said CSS.

An embodiment wherein the WST grips the RSM to the inside of the casing with gripping elements selected from a group consisting of: elastomers, carbide buttons, and wicker forms.

An embodiment wherein said RSM is degradable.

An embodiment wherein said RPE is degradable.

An embodiment wherein said RSM material is selected from a group consisting of: aluminum, iron, steel, titanium, tungsten, copper, bronze, brass, plastic, and carbide.

An embodiment wherein said RPE material is selected from a group consisting of: a metal, a non-metal, and a ceramic.

An embodiment wherein said RPE shape is selected from a group consisting of: a sphere, a cylinder, and a dart.

An embodiment wherein said wellbore casing comprises an inner casing surface (ICS) associated with an inner casing diameter (ICD);

said RSM comprises an inner sleeve surface (ISS) associated with an inner sleeve diameter (ISD); and ratio of said ISD to said ICD ranges from 0.5 to 0.99.

An embodiment wherein said plural RPEs are configured to create unevenly spaced hydraulic fracturing stages.

An embodiment wherein said RPE is not degradable;

said RPE remains in between RSMs; and fluid flow is enabled through flow channels the RSMs in production direction.

An embodiment wherein said RPE is not degradable; and said RPE is configured to pass through said RSMs in the production direction.

An embodiment wherein the WST sets the RSM to the inside surface of the wellbore casing at multiple points of the RSM.

An embodiment wherein said inner sleeve surface of said RSM comprises polished bore receptacle (PBR).

One skilled in the art will recognize that other embodiments are possible based on combinations of elements taught within the above invention description.

CONCLUSION

A wellbore plug isolation system and method for positioning plugs to isolate fracture zones in a horizontal, vertical, or deviated wellbore has been disclosed. The system/method includes a wellbore casing laterally drilled into a hydrocarbon formation, a wellbore setting tool (WST) that sets a large inner diameter (ID) restriction sleeve member (RSM), and a restriction plug element (RPE). The WST is positioned along with the RSM at a desired wellbore location. After the WST sets and seals the RSM, a conforming seating surface (CSS) is formed in the RSM. The CSS is shaped to engage/receive RPE deployed into the wellbore casing. The engaged/seated RPE isolates toe ward and heel ward fluid communication of the RSM to create a fracture zone. The RPE's are removed or left behind prior to initiating well production without the need for a milling procedure. A large ID RSM diminishes flow constriction during oil production.

What is claimed is:

1. A wellbore milling method, said method operating in conjunction with a wellbore milling system, said system comprising a plurality of restriction sleeve members (RSMs):

wherein said plurality of restriction sleeve members are configured to fit within a wellbore casing;

said plurality of restriction sleeve members are configured to be positioned at a desired wellbore location by a wellbore setting tool (WST);

said plurality of restriction sleeve members are configured with protruding fingers on either end; and said plurality of restriction sleeve members are pushed to interlock to each other such that said plurality of restriction sleeve members are milled out in a single milling operation prior to production;

wherein said method comprises the steps of:

(1) installing said wellbore casing;

(2) deploying said wellbore setting tool along with said at least one restriction sleeve member and a perforating gun string assembly (GSA) to a desired wellbore location in said wellbore casing;

(3) setting said at least one restriction sleeve member at said desired wellbore location with said wellbore setting tool and forming a seal;

(4) perforating the hydrocarbon formation with said perforating gun string assembly;

(5) removing said wellbore setting tool and perforating gun string assembly from said wellbore casing;

(6) deploying said restriction plug element into said wellbore casing to seat in said restriction sleeve member and creating a hydraulic fracturing stage;

(7) fracturing said stage with fracturing fluids;

(8) checking if all hydraulic fracturing stages in said wellbore casing have been completed, if not so, proceeding to said deploying said wellbore setting tool step;

(9) removing all restriction plug elements;

(10) with a milling tool, interlocking said fingers of each of said plurality of restriction sleeve members to an adjacent restriction sleeve member starting from the heel end to toe end;

(11) milling said plurality of restriction sleeve members in a single step;

(12) enabling fluid flow in production direction; and

(13) commencing oil and gas production from said hydraulic fracturing stages.

2. The wellbore milling method of claim 1 wherein said wellbore setting tool grips said plurality of restriction sleeve members to the inside of said casing with gripping elements selected from a group consisting of: elastomers, carbide buttons, and wicker forms.

3. The wellbore milling method of claim 1 wherein said plurality of restriction sleeve members are degradable.

4. The wellbore milling method of claim 1 wherein said plurality of restriction sleeve members material is selected from a group consisting of: aluminum, iron, steel, titanium, tungsten, copper, bronze, brass, plastic, composite, natural fiber, and carbide.

5. The wellbore milling method of claim 1 wherein said wellbore casing comprises an inner casing surface (ICS) associated with an inner casing diameter (ICD);

said plurality of restriction sleeve members comprises an inner sleeve surface (ISS) associated with an inner sleeve diameter (ISD); and ratio of said inner sleeve diameter to said inner casing diameter ranges from 0.5 to 0.99.

6. The wellbore milling method of claim 1 wherein said desired wellbore location is configured such that unevenly spaced hydraulic fracturing stages are created.

7. The wellbore milling method of claim 1 wherein said wellbore setting tool sets each of said plurality of restriction sleeve members at plurality of points of said inside surface of said casing.

* * * * *